US012372253B2

(12) United States Patent
Bae et al.

(10) Patent No.: US 12,372,253 B2
(45) Date of Patent: Jul. 29, 2025

(54) INDOOR UNIT OF AN AIR CONDITIONER

(71) Applicant: LG ELECTRONICS INC., Seoul (KR)

(72) Inventors: Junseok Bae, Seoul (KR); Kangyoung Kim, Seoul (KR); Hakjae Kim, Seoul (KR); Eunsun Lee, Seoul (KR); Taeyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 895 days.

(21) Appl. No.: 16/978,555

(22) PCT Filed: Mar. 7, 2019

(86) PCT No.: PCT/KR2019/002684
§ 371 (c)(1),
(2) Date: Sep. 4, 2020

(87) PCT Pub. No.: WO2019/172695
PCT Pub. Date: Sep. 12, 2019

(65) Prior Publication Data

US 2021/0018186 A1 Jan. 21, 2021

(30) Foreign Application Priority Data

Mar. 7, 2018 (KR) ..... 10-2018-0027005
Mar. 7, 2019 (KR) ..... 10-2019-0026056

(51) Int. Cl.
*F24F 1/0011* (2019.01)
*F24F 1/0007* (2019.01)
(Continued)

(52) U.S. Cl.
CPC ..... *F24F 1/0018* (2013.01); *F24F 1/0007* (2013.01); *F24F 1/0011* (2013.01);
(Continued)

(58) Field of Classification Search
CPC ..... F24F 1/0018; F24F 1/005; F24F 1/0007; F24F 1/0011; F24F 1/0029; F24F 13/082;
(Continued)

(56) References Cited

U.S. PATENT DOCUMENTS 9,903,608 B2 2/2018 Lee et al.
10,914,488 B2 2/2021 Chun et al.
(Continued)

FOREIGN PATENT DOCUMENTS

CN 1782516 A 6/2006
CN 104329786 A 2/2015
(Continued)

OTHER PUBLICATIONS

Jia, Feifei, CN107940566 Translation.pdf, "Air outlet hiden type air conditioner", Mar. 2018, pp. 1-10.*
(Continued)

*Primary Examiner* — Michael G Hoang
*Assistant Examiner* — Ryan L Faulkner
(74) *Attorney, Agent, or Firm* — Bryan Cave Leighton Paisner LLP

(57) ABSTRACT

A door cover assembly closes a front discharge port when a fan assembly is not operated and allows the door cover assembly to move out of the front discharge port, and the front discharge port opens when the fan assembly is operated, and a fan housing assembly can protrude out of a door assembly by means of an actuator when the front discharge port is opened.

18 Claims, 56 Drawing Sheets

(51) Int. Cl.

| | |
|---|---|
| ***F24F 1/0018*** | (2019.01) |
| ***F24F 1/0029*** | (2019.01) |
| ***F24F 1/005*** | (2019.01) |
| ***F24F 13/08*** | (2006.01) |
| ***F24F 13/14*** | (2006.01) |

(52) U.S. Cl.
CPC ..... *F24F 1/0029* (2013.01); *F24F 1/005* (2019.02); *F24F 13/082* (2013.01); *F24F 13/1426* (2013.01); *F24F 2013/1446* (2013.01); *F24F 2013/146* (2013.01)

(58) Field of Classification Search
CPC ..... F24F 13/1426; F24F 2013/1446; F24F 2013/146; F24F 2013/1433; F24F 2013/1473; F24F 13/15; F24F 13/16; F24F 13/14; F24F 13/1413; F24F 6/16; F24F 13/065; F24F 13/08
USPC ..... 454/233
See application file for complete search history.

(56) References Cited

U.S. PATENT DOCUMENTS

| | | | | |
|---|---|---|---|---|
| 11,022,338 | B2 | 6/2021 | Chun et al. | |
| 11,300,129 | B2 | 4/2022 | Lee et al. | |
| 11,346,575 | B2 | 5/2022 | Chun et al. | |
| 11,346,576 | B2 | 5/2022 | Chun et al. | |
| 11,346,577 | B2 | 5/2022 | Chun et al. | |
| 2015/0192323 | A1 | 7/2015 | Lee et al. | |
| 2017/0167748 | A1 | 6/2017 | Wang et al. | |
| 2017/0205082 | A1 | 7/2017 | Kim et al. | |
| 2018/0209687 | A1* | 7/2018 | Chun | F24F 1/005 |
| 2018/0274813 | A1 | 9/2018 | Chun et al. | |
| 2021/0071880 | A1 | 3/2021 | Kim et al. | |
| 2021/0254856 | A1 | 8/2021 | Chun et al. | |
| 2021/0356163 | A1 | 11/2021 | Chun et al. | |
| 2021/0356164 | A1 | 11/2021 | Chun et al. | |
| 2021/0356165 | A1 | 11/2021 | Chun et al. | |
| 2021/0381514 | A1 | 12/2021 | Lee et al. | |

FOREIGN PATENT DOCUMENTS

| | | | | | |
|---|---|---|---|---|---|
| CN | 106979554 | A | | 7/2017 | |
| CN | 107429936 | A | | 12/2017 | |
| CN | 107940566 | A | * | 4/2018 | F24F 1/0011 |
| CN | 108194987 | A | | 6/2018 | |
| CN | 108709247 | A | | 10/2018 | |
| CN | 211778078 | U | | 10/2020 | |
| JP | 2017-144898 | A | | 8/2017 | |
| KR | 10-04584468 | B1 | | 11/2004 | |
| KR | 10-2010-0086314 | A | | 7/2010 | |
| KR | 10-2011-0029871 | A | | 3/2011 | |
| KR | 20140012437 | A | * | 3/2011 | F24F 1/0014 |
| KR | 1020110023980 | A | | 3/2011 | |
| KR | 10-2012-0064492 | A | | 6/2012 | |
| KR | 10-2014-0012437 | A | | 2/2014 | |
| KR | 10-2014-0019106 | A | | 2/2014 | |
| KR | 20110023980 | A | * | 2/2014 | F04D 29/36 |
| KR | 10-1561738 | B1 | | 5/2015 | |
| KR | 1020150055740 | A | | 5/2015 | |
| KR | 20150082969 | A | | 7/2015 | |
| KR | 10-2016-0051095 | A | | 5/2016 | |
| KR | 20170010293 | A | | 1/2017 | |

OTHER PUBLICATIONS

Hur, Dong, KR20110023980 Translation.pdf, "Multi-way discharge type air conditioner", Mar. 2011, pp. 1-5.*

* cited by examiner

1080

INDOOR UNIT OF AN AIR CONDITIONER

TECHNICAL FIELD

The present disclosure relates to an indoor unit of an air conditioner, and more particularly, to an indoor unit of an air conditioner including a door assembly capable of vertically moving a door cover to open and close a front discharge outlet.

BACKGROUND ART

A split-type air conditioner may include an indoor unit disposed in an indoor space and an outdoor unit disposed in an outdoor space and may cool, heat, or dehumidify indoor air through refrigerants circulating between the indoor unit and the outdoor unit.

Examples of indoor unit of the split-type air conditioner include a stand-type indoor unit vertically installed on the indoor floor, a wall-mounted indoor unit mounted on the indoor wall, and a ceiling-type indoor unit mounted on the indoor ceiling.

The indoor unit of the split-type air conditioner in related art includes an indoor fan disposed inside a cabinet. However, there is a problem in that conditioned air may not be remotely discharged.

According to Korean Patent No. 10-1191413, an air circulator remotely flows air around the indoor unit.

According to Korean Patent No. 10-1191413, the air circulator is disposed in the indoor unit and may not directly flow the conditioned air, but may remotely flow indoor air above the indoor unit.

As the air circulator does not directly flow the conditioned air, there is a problem in that the air circulator may not supply the conditioned air in concentration to a target area and may not selectively condition the target area where temperature imbalance is generated.

According to Korean Patent Publication No. 10-2017-0010293, a cabinet of an indoor unit defines an opening and includes a door unit to open and close the opening. According to Korean Patent Publication No. 10-2017-0010293, the door unit is movable in a forward and rearward direction, and when the indoor unit is not operated, the door unit closes the opening, and when the indoor unit is operated, the door unit is moved forward to open the opening.

However, according to Korean Patent Publication No. 10-2017-0010293 (hereinafter; referred to as "related art document 1"), a door unit moves in a forward and rearward direction to open and close an opening, but the door unit is disposed in front of the opened opening to block flow of air discharged through the opening. In the example according to related art document 1, the opening opened by the door unit is not suitable for remotely flowing the air.

In addition, according to Korean Patent Publication No. 10-2017-0010293 (hereinafter; "referred to as related art document 2"), the door is moved forward to open the opening, and as a blowing fan is disposed inside an exterior panel, the air flowed by the blowing fan is used to generate resistance to a structure inside the exterior panel, which causes a lot of flow loss to remotely flow the air.

Chinese Utility Model No. 203375535 U (hereinafter; referred to as "related art document 3") discloses a structure capable of rotating an axial fan within a predetermined angle distance. According to the related art document 3, as both sides of the axial fan are coupled to a rotary shaft, the axial fan may only rotate about the rotary shaft disposed at both sides thereof. In the related art document 3, there is a problem in that the axial flow fan may not be rotated in other directions that are not provided by the rotary shaft. For example, according to the related art document 3, there is a problem in that the axial fan is only rotated in a vertical direction or a horizontal direction provided by the rotary shaft.

SUMMARY

The present disclosure provides an indoor unit of an air conditioner in which, when a long-distance fan assembly is not operated, a door cover assembly closes a front discharge outlet, and when the long-distance fan assembly is operated, the door cover assembly is moved out of the front discharge outlet to open the front discharge outlet, and a fan housing assembly protrudes outside the door assembly through the open front discharge outlet.

The present disclosure provides an indoor unit of an air conditioner in which, when the long-distance fan assembly is not operated, the door cover assembly closes the front discharge outlet, and when the long-distance fan assembly is operated, the door cover assembly is moved downward to open the front discharge outlet.

The present disclosure provides an indoor unit of an air conditioner in which, when the long-distance fan assembly is not operated, a fan housing assembly is concealed inside the cabinet assembly, and when the long-distance fan assembly is operated, the fan housing assembly protrudes out of the door assembly through the front discharge outlet.

The present disclosure provides an indoor unit of an air conditioner to prevent cold air of a cabinet assembly from leaking through the front discharge outlet when the fan housing assembly protrudes out of the door assembly.

The present disclosure provides an indoor unit of an air conditioner in which a door cover assembly to open and close the front discharge outlet may be vertically moved in a door assembly.

The present disclosure provides an indoor unit of an air conditioner in which a door cover of a door cover assembly provides a continuous surface with a front panel when the front discharge outlet is closed.

The present disclosure provides an indoor unit of an air conditioner in which the door cover of the door cover assembly is disposed inside the door assembly when the front discharge outlet is opened.

The present disclosure provides an indoor unit of an air conditioner capable of minimizing operating noise occurring when the door cover assembly is vertically moved.

The present disclosure provides an indoor unit of an air conditioner capable of minimizing a thickness in a forward and rearward direction and weight of a door assembly.

The present disclosure provides an indoor unit of an air conditioner capable of preventing noise occurring due to collision of the door cover assembly with an upper structure or a lower structure when the door cover assembly vertically moves.

The present disclosure provides an indoor unit of an air conditioner to tilt a steering grill in at least one of an upward direction, a downward direction, a leftward direction, a rightward direction, a leftward and upward direction, a leftward and downward direction, a rightward and upward direction, or a rightward and downward direction.

The present disclosure provides an indoor unit of an air conditioner in which a steering grill may be immediately tilted from one of the upward direction, the downward direction, the leftward direction, the rightward direction, the leftward and upward direction, the leftward and downward direction, the rightward and upward direction, or the rightward or downward direction to the other one thereof.

The present disclosure provides an indoor unit of an air conditioner to minimize interference between a discharged direct air flow and a cabinet assembly when the wheel steering grill is tilted.

TECHNICAL SOLUTION

According to the present disclosure, when a long-distance fan assembly is not operated, a door cover assembly closes a front discharge outlet, and when the long-distance fan assembly is operated, the door cover assembly is moved out of the front discharge outlet to open the front discharge outlet, and thus, a fan housing assembly may protrude out of a door assembly based on operation of an actuator when the front discharge outlet is opened.

The steering grill is in a projection state in which the front end of the steering grill passes through the front discharge outlet when the actuator is operated to protrude the fan housing assembly out of the door assembly, and as the front end of the steering grill protrudes forward from the front surface of the door assembly in the projection state, the conditioned air may be provided as direct air flow to a remote target area.

In the projection state, a rear end of the steering grill is disposed behind the front surface of the door assembly to effectively guide the air inside the cabinet assembly to the inside of the front discharge outlet.

In the projection state, the front end of the fan housing is disposed in the door assembly to minimize leakage of conditioned air between an outer surface of the fan housing and the front discharge outlet. When the long-distance fan assembly is operated, the door cover assembly is moved below the front discharge outlet to open the front discharge outlet, thereby minimizing a moving distance of the door cover assembly.

As the fan housing assembly protrudes from the door assembly through the front discharge outlet when the long-distance fan assembly is operated, the long-distance fan assembly may be concealed inside the cabinet assembly when direct air flow is not provided. The front discharge outlet is selectively opened by the operation of the door cover assembly to prevent leakage of conditioned air through the front discharge outlet.

As the door cover assembly is vertically moved in the door assembly, the moved door cover assembly may be concealed inside the door assembly. The concealed door cover assembly may completely block interference with the discharged air.

When the door cover assembly closes the front discharge outlet, the door cover provides a continuous surface with the front panel and the door cover housing is disposed at a rear side of the door cover to prevent the leakage of the conditioned air to the front discharge outlet. Therefore, dew condensation may be prevented from occurring around the front discharge outlet due to the conditioned air.

The door cover assembly is vertically moved inside the door assembly to minimize operating noise.

When the door cover assembly is vertically moved, both sides thereof are supported by two gear drive motors to minimize operating noise due to a difference in moving distance between the both sides of the door cover assembly.

The door cover assembly is concealed inside the door assembly because the door cover assembly is moved vertically, to minimize a thickness in a forward and rearward direction of the door assembly.

The fan housing assembly protrudes out of the door assembly through the front discharge outlet of the door assembly to minimize the moving distance of the fan housing assembly.

In the projection state, the door cover assembly is disposed below the fan housing to minimize the moving distance in which the door cover assembly returns to the front discharge outlet.

When the front discharge outlet is closed, the door cover assembly is disposed in front of the steering grill to minimize the moving distance of the fan housing assembly.

The door cover assembly and the steering grill are spaced apart from each other by a predetermined distance in the forward and rearward direction to prevent interference with the steering grill when the door cover assembly vertically moves.

The actuator includes: a guide motor disposed in the fan housing; a guide shaft horizontally disposed on the fan housing, rotatably assembled to the fan housing, and rotated by receiving a rotational force of the guide motor; a first guide gear coupled to the left side of the guide shaft and rotated together with the guide shaft; a second guide gear coupled to the right side of the guide shaft and rotated together with the guide shaft; a first rack disposed on the guide housing and engaged with the first guide gear; a second rack disposed on the guide housing and engaged with the second guide gear, and when the guide motor is operated, the first guide gear is moved along the first rack when the first guide gear is engaged with the first rack and the second guide gear is moved along the second rack when the second guide gear is engaged with the second rack to prevent movement of the fan housing from one side to the other side when the fan housing moves forward or rearward.

The first rack is disposed under the first guide gear and the second rack is disposed under the second guide gear to distribute load of the fan housing assembly and reduce operating load applied to the first guide gear and the second guide gear.

The first rack and the second rack are each disposed below the front discharge outlet to prevent interference with the discharged air flow and exposure to the outside through the front discharge outlet.

When viewed from the front, the first rack and the second rack are bilaterally symmetrical to each other with respect to a central axis (C1) passing a center of the front discharge outlet in the forward and rearward direction to laterally balance the fan housing assembly when the fan housing assembly moves forward or rearward and prevent the occurrence of eccentricity on either side during the movement.

When viewed from the front, the first guide gear and the second guide gear are bilaterally symmetrical to each other with respect to the central axis (C1) passing the center of the front discharge outlet in the forward and rearward direction to laterally balance the fan housing assembly when the fan housing assembly moves forward or rearward and prevent the occurrence of eccentricity on either side during the movement.

When viewed from the front, the first guide rail and the second guide rail are bilaterally symmetrical to each other with respect to the central axis (C1) passing the center of the front discharge outlet in the forward and rearward direction to prevent the occurrence of eccentricity on either side during the movement.

The indoor unit of the air conditioner includes a first guide roller disposed on the left side of the fan housing and rotatably assembled to the fan housing; a second guide roller disposed on the right side of the fan housing and rotatably assembled to the fan housing; a first guide groove defined in the guide housing and extending longitudinally in the forward and rearward direction and configured to support the first guide roller and guide a moving direction of the first guide roller;

and a second guide groove defined in the guide housing and extending longitudinally in the forward and rearward direction and configured to support the second guide roller and guide a moving direction of the second guide roller. The first guide roller is supported by the first guide groove and moved and the second guide roller is supported by the second guide groove and moved to distribute the load of the fan housing assembly to the guide housing and reduce operating load of the actuator. In particular, the load of the fan housing assembly is distributed to the guide housing to minimize frictional noise of the rack and the guide gear.

The first guide roller and the second guide roller are bilaterally symmetrical to each other and the first guide roller and the second guide roller are each disposed below the central axis to firmly support the movable fan housing assembly.

Advantageous Effects

According to the present disclosure, an indoor unit of an air conditioner has one or more of following effects.

First, according to the present disclosure, there is an advantage in that, when a long-distance fan assembly is not operated, a door cover assembly closes a front discharge outlet, and when the long-distance fan assembly is operated, the door cover assembly is moved out of the front discharge outlet to open the front discharge outlet to protrude the fan housing assembly out of the door assembly based on operation of an actuator when the front discharge outlet is opened.

Second, according to the present disclosure, there is an advantage in that a steering gill provides a projection state in which a front end of the steering grill protrudes forward from a front surface of the door assembly through the front discharge outlet based on the operation of the actuator, and in the projection state, the steering grill provides the conditioned air as direct air flow to a remote target area.

Third, according to the present disclosure, in the projection state, a rear end of the steering grill is disposed behind a front surface of the door assembly to effectively guide air inside the cabinet assembly to an inside of the front discharge outlet.

Fourth, according to the present disclosure, there is an advantage in that the front end of the fan housing is disposed in the door assembly to prevent conditioned air leakage between the outer surface of the fan housing and the front discharge outlet.

Fifth, according to the present disclosure, there is an advantage in that the door cover assembly is moved below the front discharge outlet to open the front discharge outlet when the long-distance fan assembly is operated to minimize the moving distance of the door cover assembly.

Sixth, according to the present disclosure, there is an advantage in that the fan housing assembly protrudes out of the door assembly through the front discharge outlet when the long-distance fan assembly is operated to conceal the long-distance fan assembly inside the cabinet assembly when direct air flow is not provided.

Seventh, according to the present disclosure, there is an advantage in that the front discharge outlet is selectively opened by the operation of the door cover assembly to prevent the conditioned air from leaking through the front discharge outlet.

Eighth, according to the present disclosure, there is an advantage in that the door cover assembly is vertically moved within the door assembly to conceal the moved door cover assembly inside the door assembly.

Ninth, according to the present disclosure, there is an advantage in that the concealed door cover assembly may completely prevent interference with the discharged air.

Tenth, according to the present disclosure, there is an advantage in that, when the door cover assembly closes the front discharge outlet, the door cover provides a continuous surface with the front panel and the door cover housing is disposed at a rear side of the door cover to prevent the conditioned air from leaking through the front discharge outlet.

Eleventh, according to the present disclosure, there is an advantage in that the door cover closes the front discharge outlet to prevent dew condensation from being generated around the front discharge outlet due to the conditioned cool air.

Twelfth, according to the present disclosure, there is an advantage in that the door cover assembly is vertically moved inside of door assembly to minimize operating noise.

Thirteenth, according to the present disclosure, there is an advantage in that, when the door cover assembly is vertically moved, both sides of the door cover assembly are supported by two gear drive motors to minimize operating noise due a moving distance difference between both sides of the door cover assembly.

Fourteenth, according to the present disclosure, there is an advantage in that the door cover assembly is concealed inside the door assembly because the door cover assembly is vertically moved to minimize the thickness in the forward and rearward direction of the door assembly.

Fifteenth, according to the present disclosure, there is an advantage in that the fan housing assembly protrudes out of the door assembly through the front discharge outlet of the door assembly to minimize the moving distance of the fan housing assembly.

Sixteenth, according to the present disclosure, there is an advantage in that the door cover assembly is disposed below the fan housing in the projection state to minimize the moving distance in which the door cover assembly returns to the front discharge outlet.

Seventeenth, according to the present disclosure, there is an advantage in that, when the front discharge outlet is closed, the door cover assembly is disposed in front of the steering grill to minimize the moving distance of the fan housing assembly.

Nineteenth, according to the present disclosure, there is an advantage in that the door cover assembly and the steering grill are spaced apart from each other by a predetermined distance in a forward and rearward direction to prevent interference with the steering grill when the door cover assembly is vertically moved.

Twentieth, according to the present disclosure, there is an advantage in that the first guide gear of the actuator is moved along the first rack when the first guide gear is engaged with the first rack and the second guide gear is moved along the second rack when the second guide gear is engaged with the second rack to prevent horizontal movement from one side to the other of the fan housing when the fan housing is moved forward or rearward.

Twenty-first, according to the present disclosure, there is an advantage in that the first rack is disposed under the first guide gear and the second rack is disposed under the second guide gear to distribute load of the fan housing assembly and reduce the operating load applied to the first guide gear and the second guide gear.

Twenty-third, according to the present disclosure, there is an advantage in that the first rack and the second rack are each disposed below the front discharge outlet to prevent interference with the discharged air flow and prevent exposure to the outside through the front discharge outlet.

Twenty-fourth, according to the present disclosure, there is an advantage in that, when viewed from the front, the first rack and the second rack are bilaterally symmetrical to each other with respect to a central axis (C1) passing a center of the front discharge outlet in the forward and rearward direction to laterally balance the fan housing assembly when the fan housing assembly moves forward or rearward and prevent the occurrence of eccentricity on either side during the movement.

Twenty-fifth, according to the present disclosure, there is an advantage in that, when viewed from the front, the first guide gear and the second guide gear are bilaterally symmetrical to each other with respect to the central axis (C1) passing the center of the front discharge outlet in the forward and rearward direction to laterally balance the fan housing assembly when the fan housing assembly moves forward or rearward and prevent the occurrence of eccentricity on either side during the movement.

Twenty-sixth, according to the present disclosure, there is an advantage in that, when viewed from the front, the first guide rail and the second guide rail are bilaterally symmetrical to each other with respect to the central axis (C1) passing the center of the front discharge outlet in the forward and rearward direction to prevent the occurrence of eccentricity on either side during the movement of the fan housing assembly.

Twenty-ninth, according to the present disclosure, there is an advantage in that the first guide roller of the fan housing assembly is moved by being supported on the first guide groove and the second guide roller is moved by being supported on the second guide groove to distribute the load of the fan housing assembly to the guide housing and to reduce operating load of the actuator.

Thirtieth, according to the present disclosure, there is an advantage in that the load of the fan housing assembly is distributed to minimize frictional noise of the rack and guide gear.

Thirty-first, according to the present disclosure, there is an advantage in that the front end of the steering grill protrudes than the front surface of the door assembly when the steering grill is tilted to prevent interference between the discharged air and the door assembly.

Thirty-second, according to the present disclosure, there is an advantage in that the steering grill is tilted when the center of the steering grill is disposed on the central axis (C1) passing the front discharge outlet in the forward and rearward direction to minimize air leakage between the front discharge outlet and the steering grill even when tilting.

Thirty-third, according to the present disclosure, there is an advantage in that a first steering assembly and a second steering assembly are rotatably coupled to two portions of the steering grill and rotate upward, downward, leftward, rightward, leftward and upward, rightward and upward, leftward and downward, and rightward and downward with respect to the central axis (C1) passing the front discharge outlet in the forward and rearward direction based on the operation of pushing or pulling coupled portions.

Thirty-fourth, according to the present disclosure, there is an advantage in that the first steering assembly and the second steering assembly form an angle of 90 degrees with respect to the central axis (C1) to minimize the operations of the first steering assembly and the second steering assembly during steering.

Thirty-fifth, according to the present disclosure, there is an advantage in that the first steering assembly is disposed above or below the central axis (C1) and the second steering assembly is disposed on the left or right side of the central axis (C1) to rotate at least one of the first steering assembly or the second steering assembly upward, downward, leftward, and rightward.

DETAILED DESCRIPTION

Figure 1:
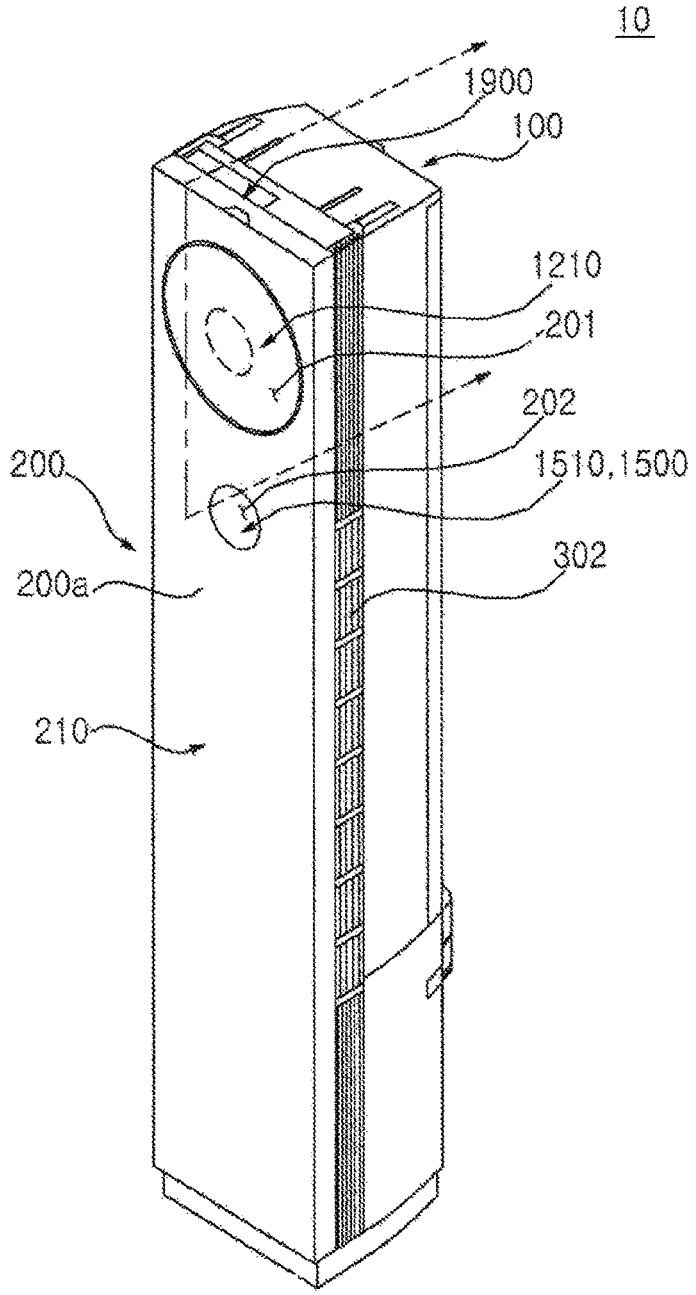
FIG. 1 is a perspective view showing an indoor unit of an air conditioner according to an embodiment of the present disclosure.

Advantages, features, and methods for achieving the foregoing will be clarified with reference to embodiments described below in detail together with the accompanying drawings. Exemplary embodiments may, however, be embodied in many different manners and should not be construed as being limited to the exemplary embodiments set forth herein. Rather, the exemplary embodiments are provided so that this disclosure will be thorough and complete, and will fully convey the scope of the exemplary embodiments to those skilled in the art. Same reference numerals may be used throughout the present disclosure to designate the same or similar components.

Hereinafter, the present disclosure will be described in detail with reference to the accompanying drawings.

Figure 2:
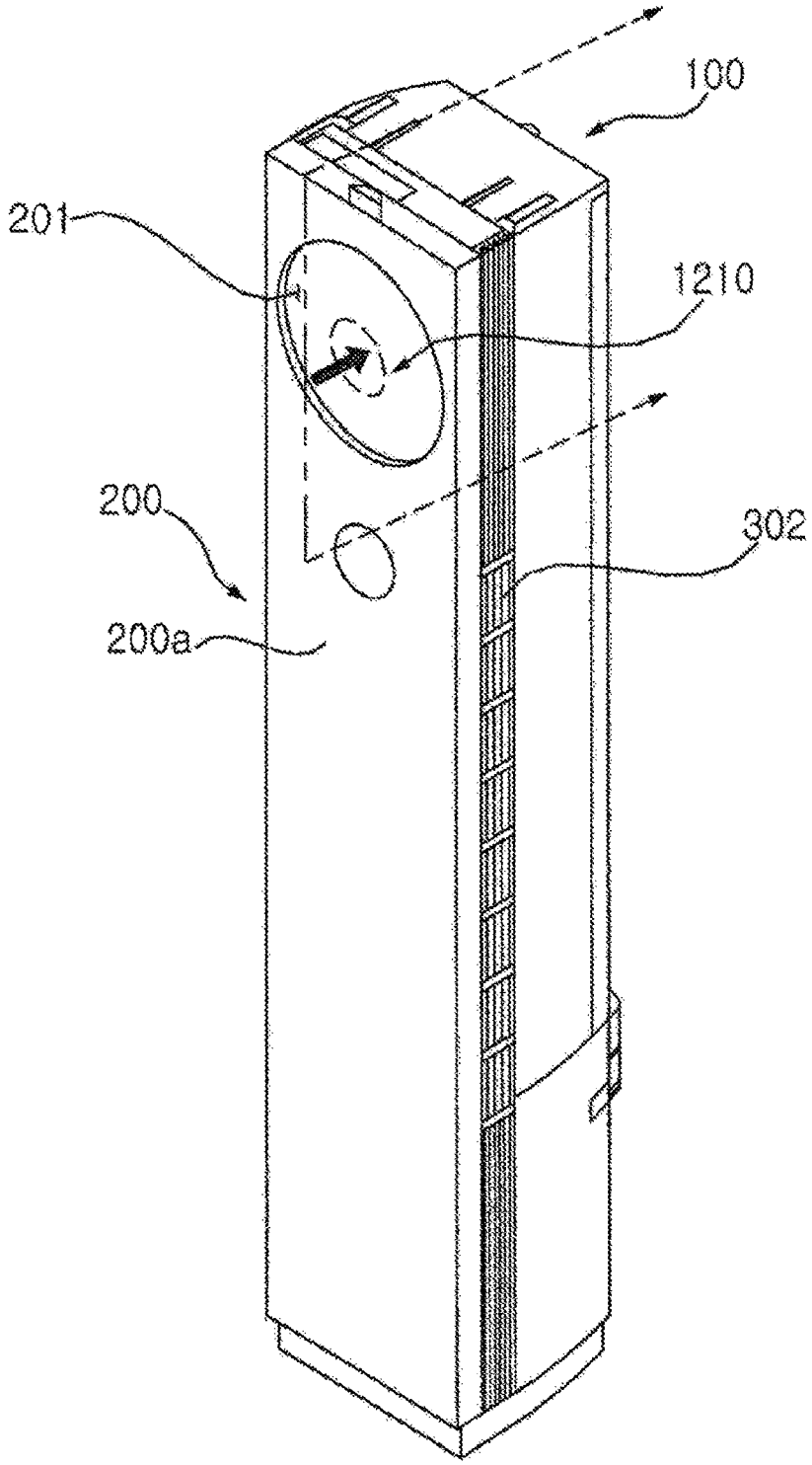
FIG. 2 is an exemplary view showing a door cover in FIG. 1 moving rearward.
Figure 3:
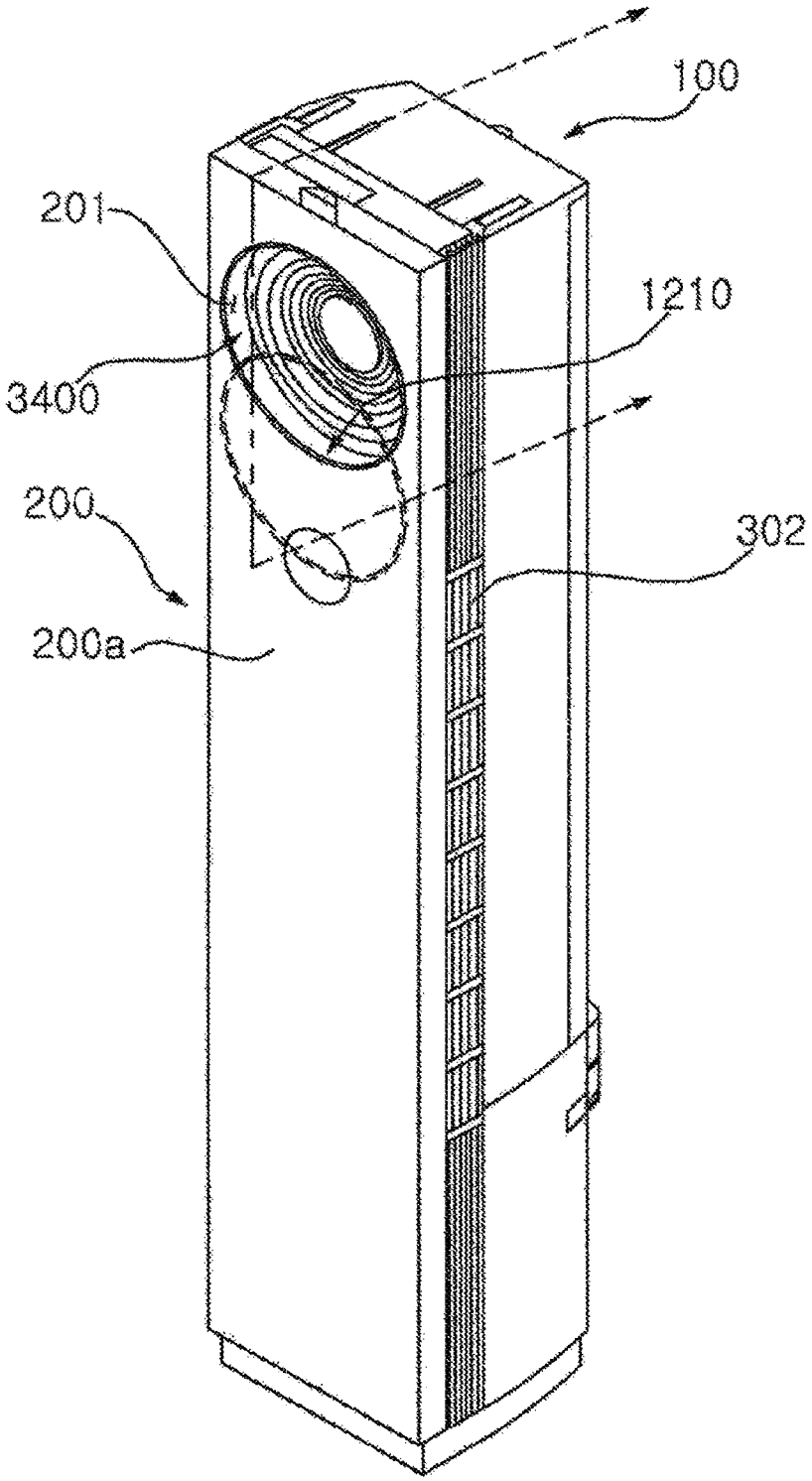
FIG. 3 is an exemplary view showing a door cover assembly in FIG. 2 moving down.
Figure 4:
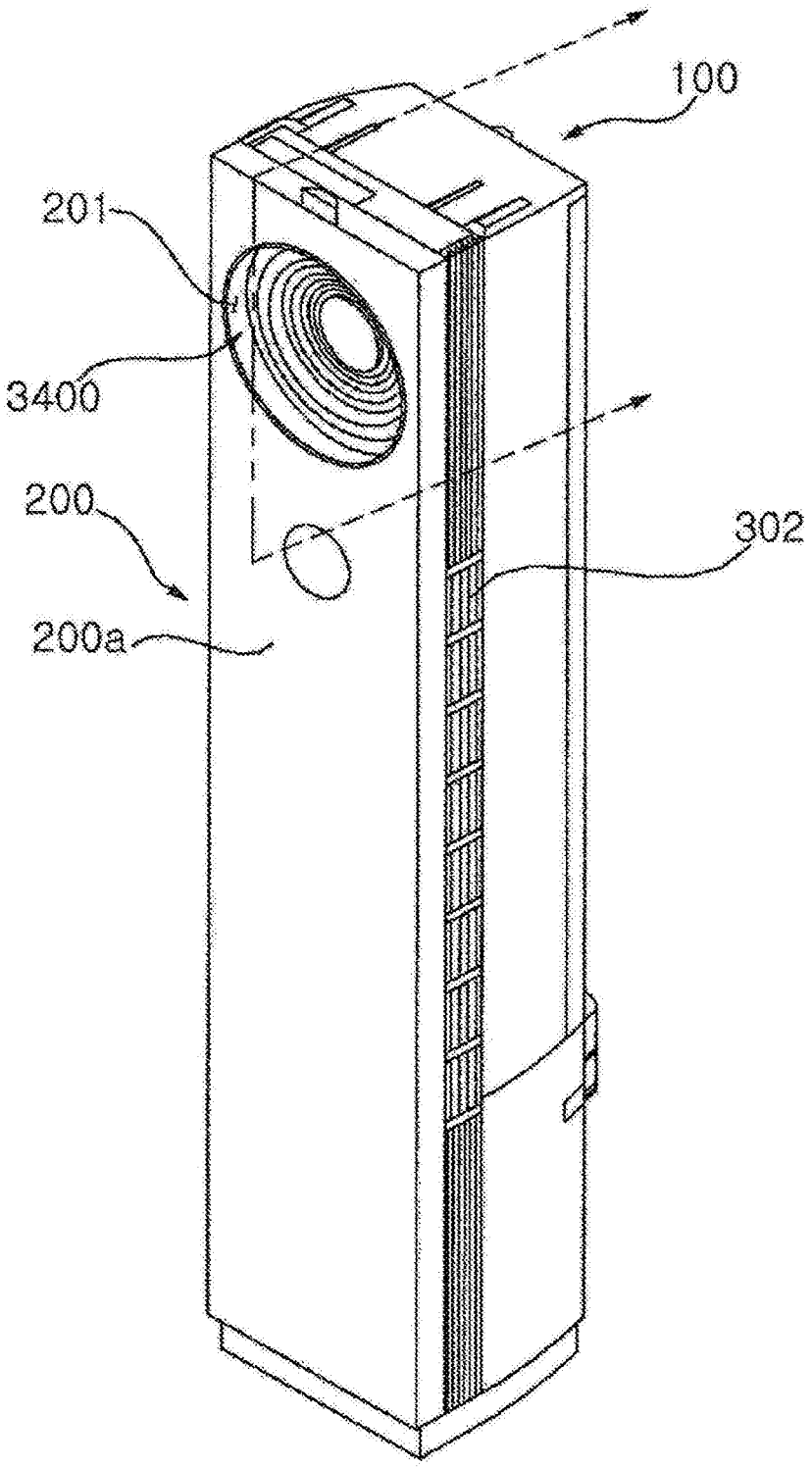
FIG. 4 is an exemplary view showing a front discharge outlet in FIG. 3 that is open.
Figure 5:
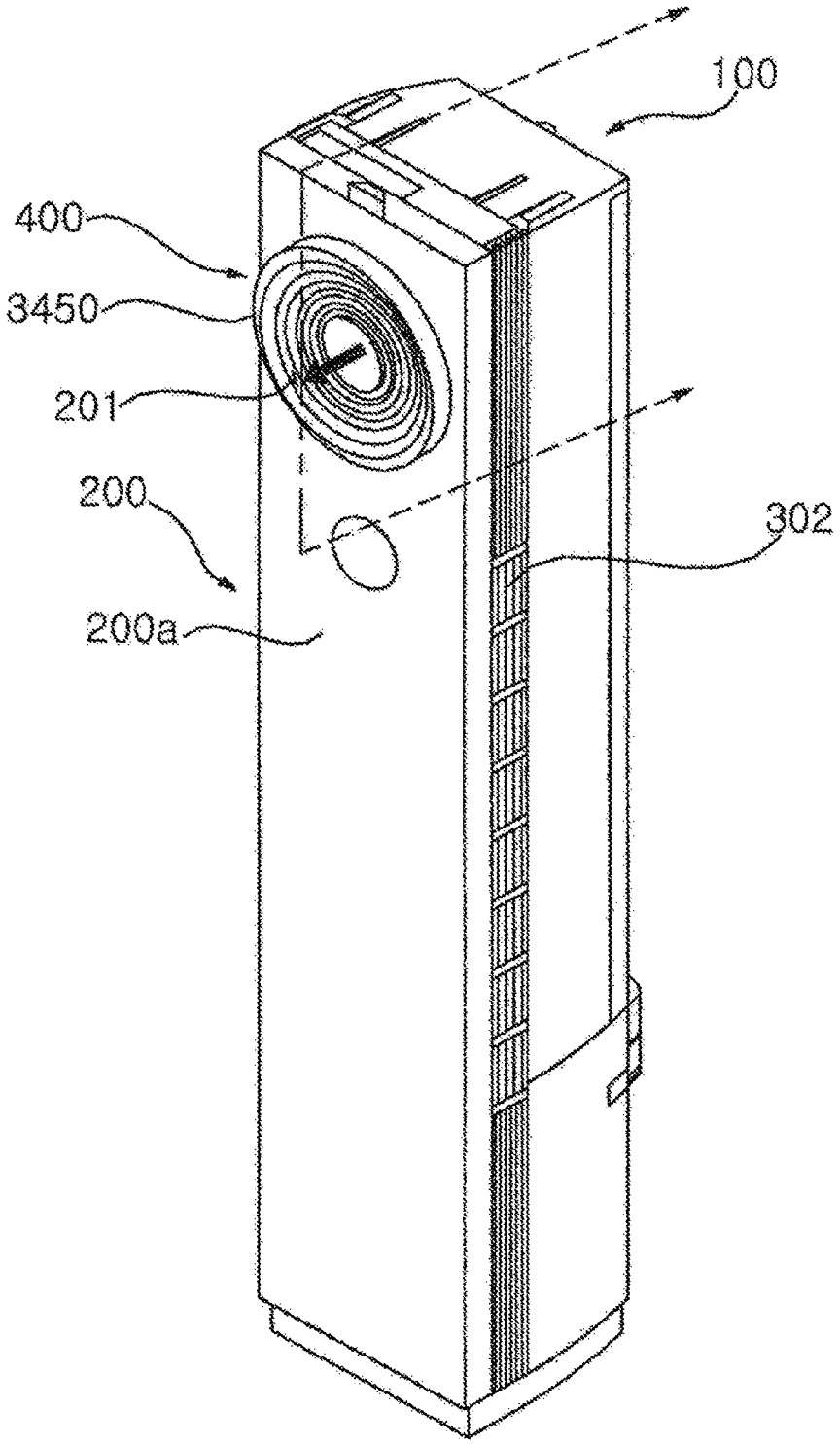
FIG. 5 is an exemplary view showing a fan housing assembly in FIG. 4 moving forward.
Figure 6:
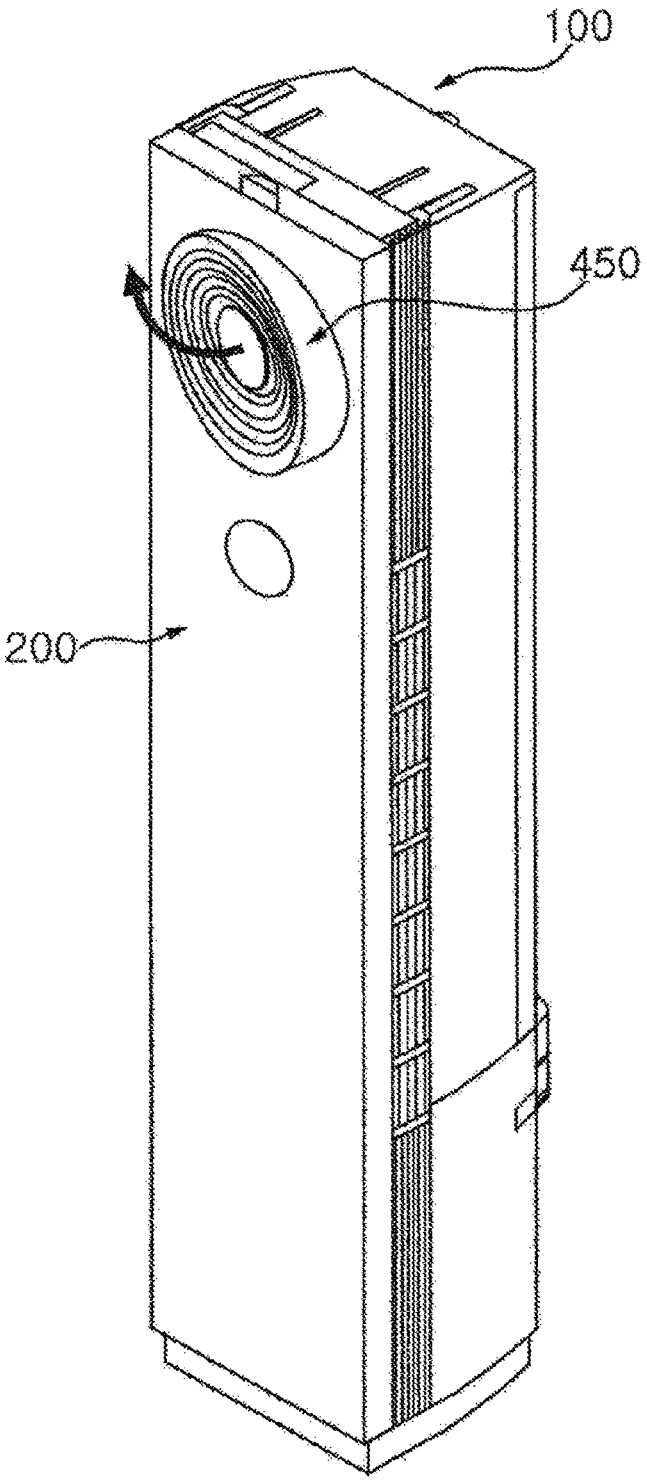
FIG. 6 is an exemplary view showing a steering grill in FIG. 5 tilted leftward.
Figure 7:
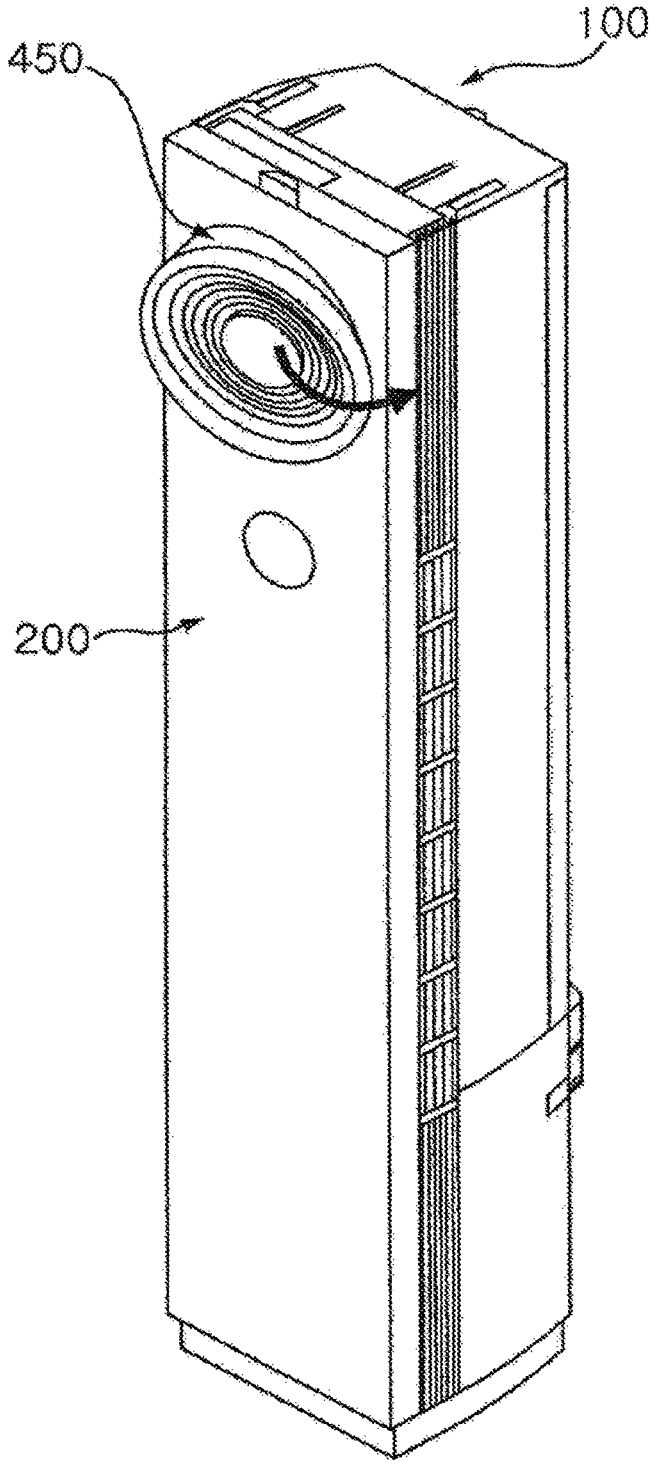
FIG. 7 is an exemplary view showing a steering grill in FIG. 5 tilted rightward.
Figure 8:
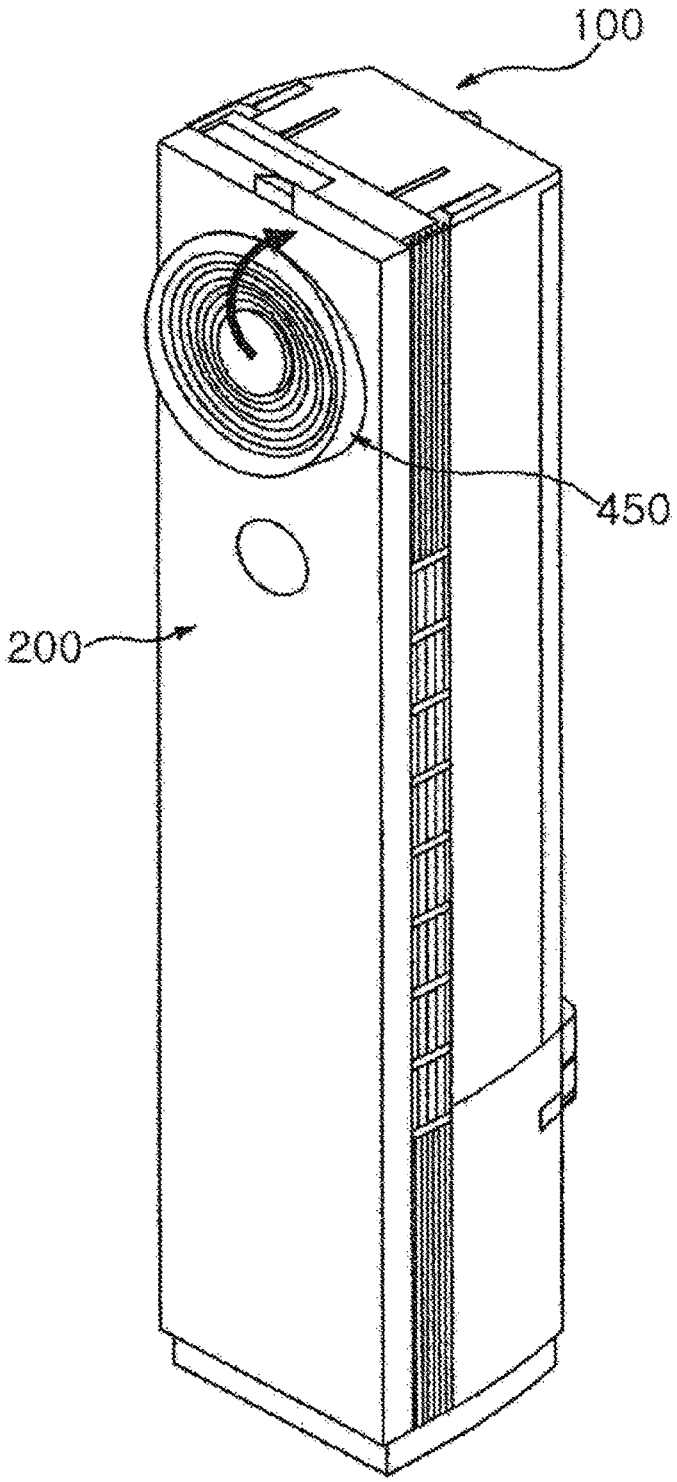
FIG. 8 is an exemplary view showing a steering grill in FIG. 5 tilted upward.
Figure 9:
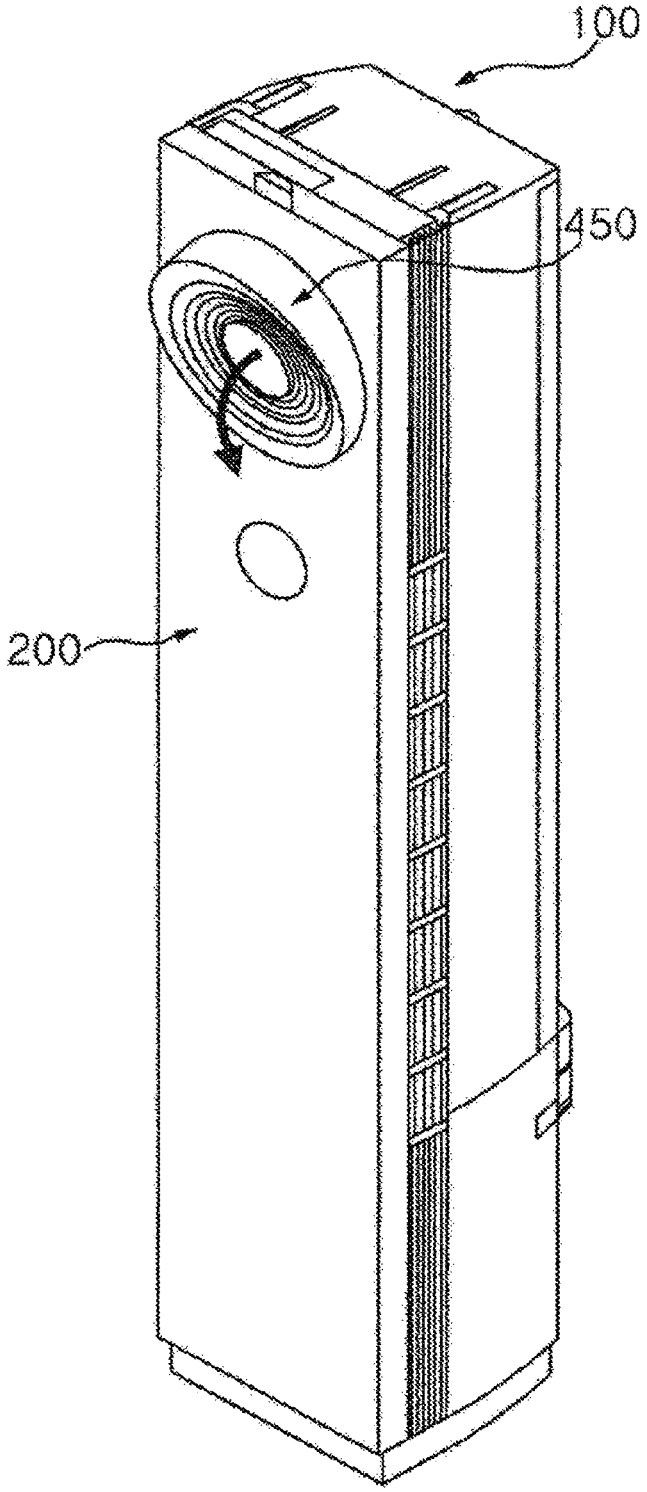
FIG. 9 is an exemplary view showing a steering grill in FIG. 5 tilted downward.
Figure 10:
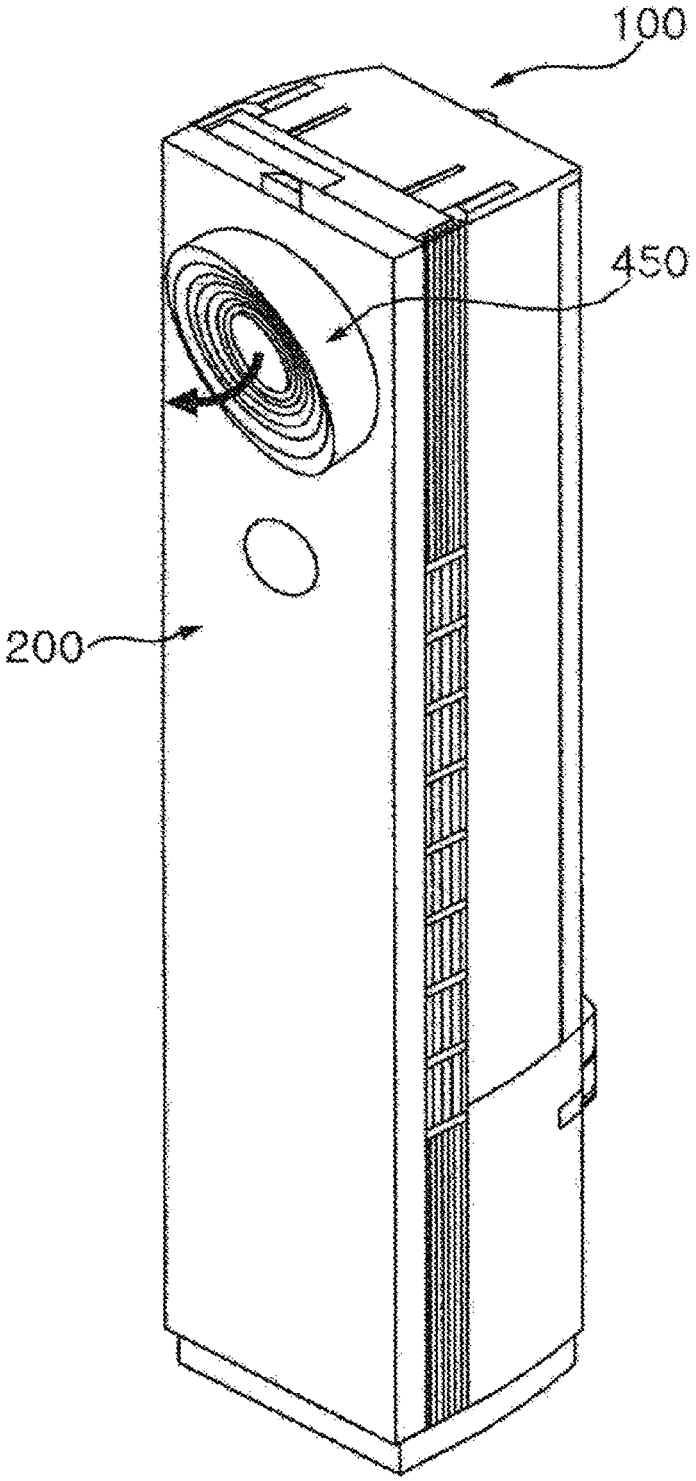
FIG. 10 is an exemplary view showing a steering grill in FIG. 5 tilted rightward and downward.
Figure 11:
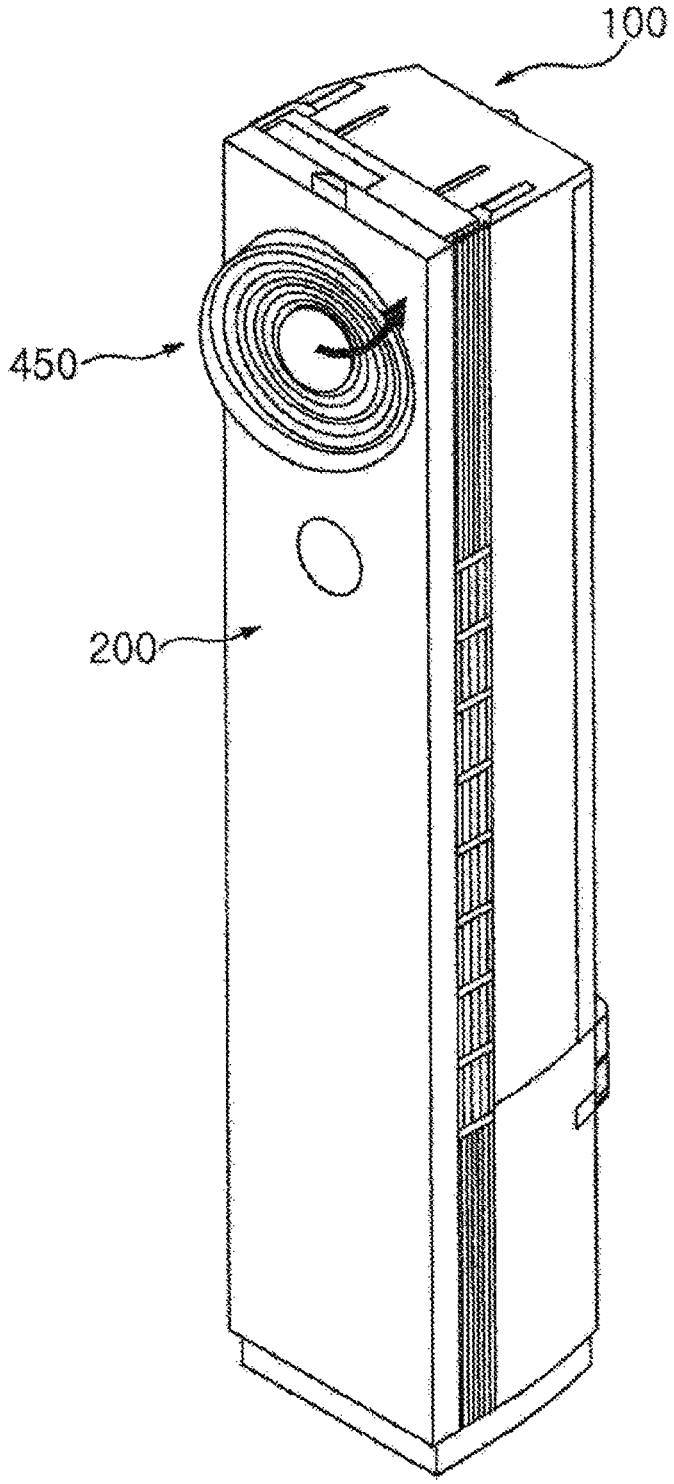
FIG. 11 is an exemplary view showing a steering grill in FIG. 5 tilted leftward and upward.

FIG. 1 is a perspective view showing an indoor unit of an air conditioner according to an embodiment of the present disclosure. FIG. 2 is an exemplary view showing a door cover in FIG. 1 moving rearward. FIG. 3 is an exemplary view showing a door cover assembly in FIG. 2 moving down. FIG. 4 is an exemplary view showing a front discharge outlet in FIG. 3 that is open. FIG. 5 is an exemplary view showing a fan housing assembly in FIG. 4 moving forward. FIG. 6 is an exemplary view showing a steering grill in FIG. 5 tilted leftward. FIG. 7 is an exemplary view showing a steering grill in FIG. 5 tilted rightward. FIG. 8 is an exemplary view showing a steering grill in FIG. 5 tilted upward. FIG. 9 is an exemplary view showing a steering grill in FIG. 5 tilted downward. FIG. 10 is an exemplary view showing a steering grill in FIG. 5 tilted rightward and downward. FIG. 11 is an exemplary view showing a steering grill in FIG. 5 tilted leftward and upward.

According to this embodiment, the air conditioner includes an indoor unit 10 and an outdoor unit (not shown) connected to the indoor unit 10 through a refrigerant pipe and circulates refrigerant.

The outdoor unit includes a compressor (not shown) to compress the refrigerant, an outdoor heat exchanger (not shown) to receive the refrigerant from the compressor and condense the refrigerant, an outdoor fan (not shown) to supply air to the outdoor heat exchanger, and an accumulator (not shown) to receive the refrigerant discharged by the indoor unit 10 and provide gas refrigerant to the compressor.

The outdoor unit may further include a four-way valve (not shown) to operate the indoor unit in a cooling mode or a heating mode. When the air conditioner is operated in the cooling mode, the indoor unit 10 evaporates the refrigerant and cools the indoor air. When the air conditioner is operated in the heating mode, the indoor unit 10 condenses the refrigerant to heat the indoor air.

<<<Configuration of Indoor Unit>>>

The indoor unit includes a cabinet assembly 100 to define an opening at a front surface thereof, a suction inlet 101 at a rear surface thereof, and an inner space (S), a door assembly 200 assembled to the cabinet assembly 100, to define a front discharge outlet 201, cover a front surface of the cabinet assembly 100, and open and close a front surface of the cabinet assembly 100, fan assemblies 300 and 400 disposed in the cabinet assembly 100 and to discharge air in the inner space (S) to an indoor space, a heat exchange assembly 500 disposed between the fan assemblies 300, 400 and the cabinet assembly 100 and to exchange the suctioned indoor air with refrigerant, and a filter assembly 600 disposed at a rear surface of the cabinet assembly 100 and to filter air flowing through the suction inlet 101.

The indoor unit includes the suction inlet 101 disposed on the rear surface of the cabinet assembly 100, a side discharge outlet 302 disposed at a side surface of the cabinet assembly 100, and a front discharge outlet 201 disposed on a front surface of the cabinet assembly 100.

The air suctioned through the suction inlet 101 is discharged into the indoor space through the front discharge outlet 201 or the side discharge outlet 302. The suction inlet 101 is disposed on the rear surface of the cabinet assembly 100.

The side discharge outlets 302 are disposed on the left side and the right side of the cabinet assembly 100.

The front discharge outlet 201 is disposed in the door assembly 200. The front discharge outlet 201 penetrates the door assembly 200.

When viewed from the front, the front discharge outlet 201 is disposed at an upper portion of the door assembly 200 to flow the air discharged from the front discharge outlet 201 to a remote indoor space. The front discharge outlet 201 is preferably disposed above the middle of the door assembly 200.

In this embodiment, the fan assemblies 300 and 400 include a short-distance fan assembly 300 and a long-distance fan assembly 400. In contrast to this embodiment, in an alternative embodiment, the short-distance fan assembly 300 is omitted and only the long-distance fan assembly 400 may be disposed. When the short-distance fan assembly 300 is omitted, the side discharge outlet 302 is also omitted and the conditioned air may only be discharged through the front discharge outlet 201.

The short-distance fan assembly 300 and the long-distance fan assembly 400 are each disposed in front of the heat exchange assembly 500. In addition, the short-distance fan assembly 300 and the long-distance fan assembly 400 are each disposed in front of the filter assembly 600. In this embodiment, the heat exchange assembly 500 is disposed in front of the filter assembly 600 and the fan assemblies 300 and 400 are each disposed in front of the heat exchange assembly 500.

The air is introduced into the short-distance fan assembly 300 and the long-distance fan assembly 400 through the heat exchange assembly 500. In this case, the air is conditioned while passing through the heat exchange assembly 500 and the conditioned air is introduced into the short-distance fan assembly 300 and the long-distance fan assembly 400.

The heat exchange assembly 500 is disposed inside the cabinet assembly 100, is disposed in front of the suction inlet 101, and covers the entire suction inlet 101.

The suction inlet 101 is disposed on the rear surface of the cabinet assembly 100 and is disposed vertically. The heat exchange assembly 500 covers the entire suction inlet 101 to pass the air suctioned at the suction inlet 101 through the heat exchange assembly 500.

The heat exchange assembly 500 faces the suction inlet 101 and the rear surface of the cabinet assembly 100 and is disposed vertically.

The heat exchange assembly 500 may be vertically disposed to minimize an installation space of the heat exchange assembly 500 and contact the short-distance fan assembly 300 and the long-distance fan assembly 400 with the front surface of the heat exchange assembly 500.

The short-distance fan assembly 300 and the long-distance fan assembly 400 each contact the front surface of the heat exchange assembly 500 to effectively minimize the inner space of the cabinet assembly 100.

In particular, the filter assembly 600, the heat exchange assembly 500, and the fan assemblies 300, 400 are all vertically disposed and sequentially stacked from a rear side to a front side thereof to minimize a thickness in a forward and rearward direction of the indoor unit.

When the heat exchange assembly 500 is disposed inside the cabinet assembly 100, the heat exchange assembly 500 may be inclined forward and rearward to occupy more installation space than the heat exchange assembly 500 that is vertically disposed, which causes an increase in thickness in the forward and rearward direction of the indoor unit.

The short-distance fan assembly 300 and the long-distance fan assembly 400 are each manufactured to have a length corresponding to a height of the heat exchange assembly 500.

The short-distance fan assembly 300 and the long-distance fan assembly 400 may each be vertically stacked. In this embodiment, the long-distance fan assembly 400 is disposed above the short-distance fan assembly 300. As the long-distance fan assembly 400 is disposed above the short-distance fan assembly 300, the air discharged from the long-distance fan assembly 400 may flow to a remote place in the indoor space.

The short-distance fan assembly 300 discharges air laterally with respect to the cabinet assembly 100. The short-distance fan assembly 300 may provide an indirect airflow to a user. The short-distance fan assembly 300 may simultaneously discharge air from the left side and the right side of the cabinet assembly 100.

The long-distance fan assembly 400 is disposed above the short-distance fan assembly 300 and is disposed in the cabinet assembly 100 at an upper portion thereof.

The long-distance fan assembly 400 discharges air to the front discharge outlet 201 disposed in the cabinet assembly 100. The long-distance fan assembly 300 provides a direct airflow to the user.

The long-distance fan assembly 400 discharges the air to a remote space. If the long-distance fan assembly 400 only functions to supply the air to a remote space in the indoor space, the long-distance fan assembly 400 may be disposed on the upper portion of the indoor unit.

According to this embodiment, the long-distance fan assembly 400 may provide a direct airflow to an indoor target area. The target area may be an area having a large deviation between a target temperature and a room temperature. The target area may be an area where a user or a pet is located.

The long-distance fan assembly 400 includes a direction-adjustable steering grill 3450 to supply the direct airflow to the target area.

In this embodiment, the long-distance fan assembly 400 protrudes from the cabinet assembly 100 during operation and is concealed in the cabinet assembly 100 when not in operation.

When the long-distance fan assembly 400 is operated, the long-distance fan assembly 400 passes through the front discharge outlet 201 of the door assembly 200 and protrudes forward from the door assembly 200.

The long-distance fan assembly 400 protrudes from the front discharge outlet 201 to minimize interference of the direct airflow discharge with the door assembly 200. When the long-distance fan assembly 400 is disposed inside the cabinet assembly 100 and discharges the air, air resistance is generated with the cabinet assembly 100 during the passing of the discharged air through the front discharge outlet 201.

In this embodiment, when the long-distance fan assembly 400 provides a direct airflow to the indoor space, the steering grill 3450 of an exemplary component of the long-distance fan assembly 400 penetrates the front discharge outlet 201 and protrudes forward from the cabinet assembly 100.

Only the exemplary component of the long-distance fan assembly 400 (e.g., the steering grill in this embodiment)

penetrates the door assembly 200 to minimize a moving distance of the long-distance fan assembly 400 and obtain the desired effects.

In particular, the long-distance fan assembly 400 may adjust an angle of the steering grill 3450 protruding out of the front discharge outlet 201. A direction of the steering grill 3450 is not limited to a specific angle or direction.

The steering grill 3450 may be disposed upward, downward, leftward, rightward, or diagonally with respect to the front surface of the cabinet assembly 100 when the steering grill 3450 protrudes from the front discharge outlet 201.

In addition, in this embodiment, the long-distance fan assembly 400 may immediately change the direction of the steering grill 3450 from a first specific direction to a second specific direction.

The long-distance fan assembly 400 may protrude forward from the door assembly 200 through the front discharge outlet 201. In particular, the steering grill 3450 protrudes further forward than a front surface 200*a* of the door assembly 200.

A state in which the steering grill 3450 protrudes further forward than the door assembly 200 is referred to as "a projection state".

When the steering grill 3450 is in the projection state, the steering grill 3450 may entirely protrude from the front surface of the door assembly 200. The front surface of the steering grill 3450 may also partially protrude forward from the front surface 200*a* of the door assembly 200.

The steering grill 3450 may be tilted in any direction in the projection state.

When viewed from the front of the cabinet assembly 100, the steering grill 3450 is tiltable upward, downward, leftward, rightward, or diagonally.

In the projection state, the steering grill 3450 may be tilted in any direction to provide direct airflow to the indoor target area.

<<Configuration of Short-Distance Fan Assembly>>

The short-distance fan assembly 300 discharges air to a side discharge outlet 302 of the cabinet assembly 100. The short-distance fan assembly 300 discharges the air to the side discharge outlet 302 and provides indirect airflow to a user.

The short-distance fan assembly 300 is disposed in front of the heat exchange assembly 500. The short-distance fan assembly 300 includes a plurality of fans 310 stacked vertically. In this embodiment, the short-distance fan assembly 300 includes three fans 310 stacked vertically.

In this embodiment, the fan 310 uses a centrifugal mixed flow fan. The fan 310 suctions air in an axial direction and discharges the air in a circumferential direction.

The fan 310 suctions the air from the rear side thereof, discharges the air in the circumferential direction thereof, and the air discharged in the circumferential direction flows to the front side thereof.

The short-distance fan assembly 300 includes a fan casing 320 defining openings at a front side and a rear side thereof and coupled to the cabinet assembly 100. A plurality of fans 310 are coupled to the fan casing 320 and disposed in the fan casing 320.

The fan casing 320 has a box shape and defines openings at a front surface and a rear surface thereof. The fan casing 320 is coupled to the cabinet assembly 100.

The front surface of the fan casing 320 faces the door assembly 200. The rear surface of the fan casing 320 faces the heat exchange assembly 500.

The front surface of the fan casing 320 contacts the door assembly 200 and is closed.

In this embodiment, a portion of the side surface of the fan casing 320 is exposed to an outside. The fan casing 320 exposed to the outside defines a side discharge outlet 302. A steering grill is disposed in the side discharge outlet 302 to control an air discharge direction. The side discharge outlets 302 are disposed on the left side and the right side of the fan casing 320.

A fan 310 is disposed inside the fan casing 320. A plurality of fans 310 may be disposed on the same plane and are stacked vertically in a row.

The fan 310 uses the centrifugal mixed flow fan to suction the air from the rear surface of the fan casing 320 and then discharge the air forward in the circumferential direction.

Figure 12:
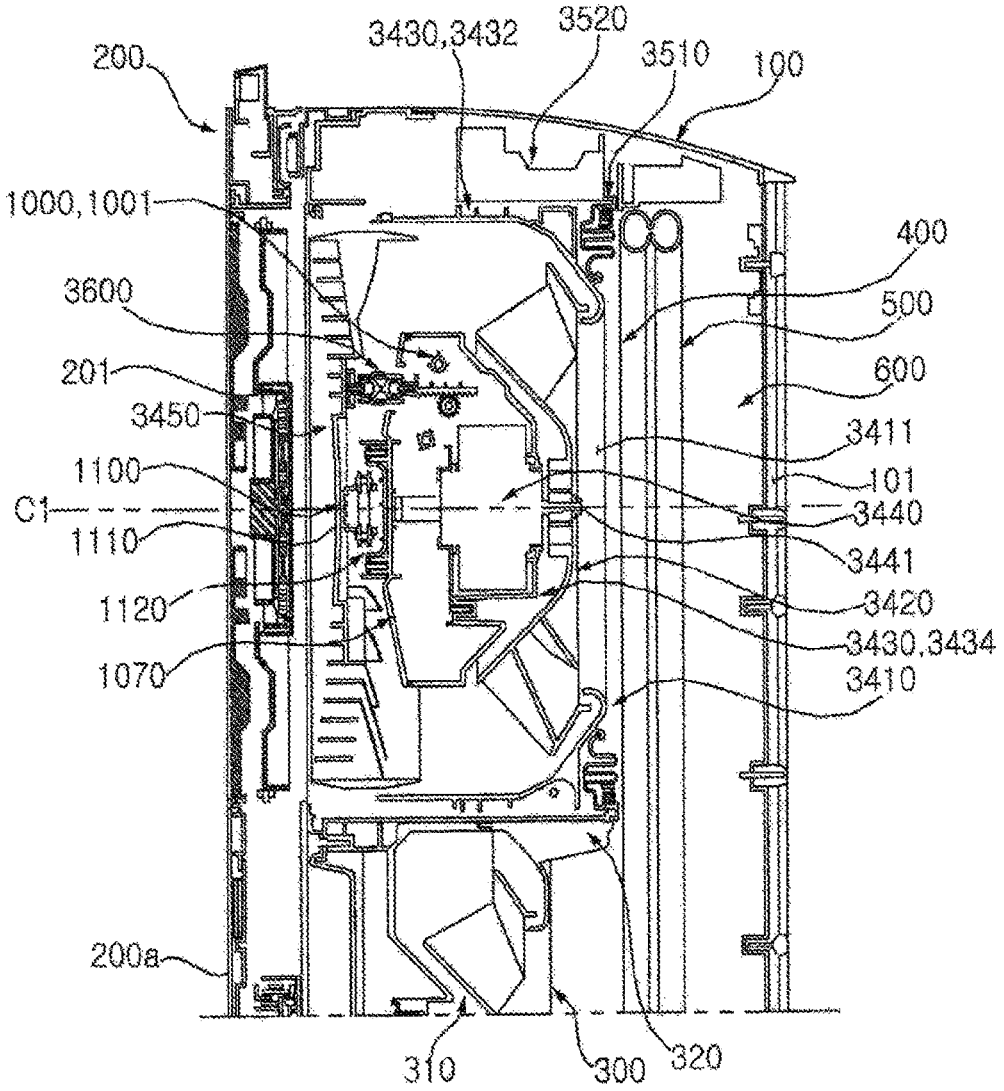
FIG. 12 is a right cross-sectional view showing a door cover assembly and a fan housing assembly in FIG. 1.
Figure 13:
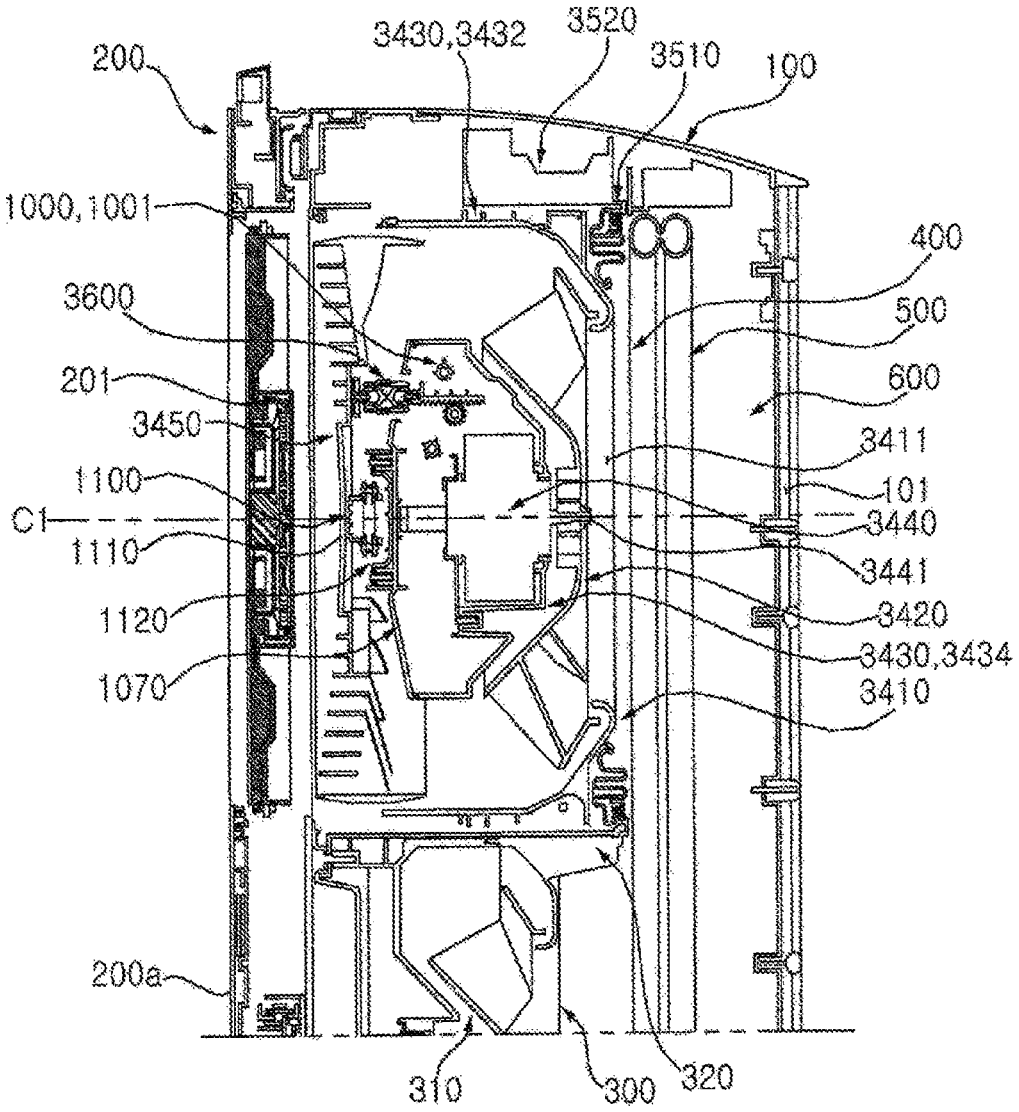
FIG. 13 is a right cross-sectional view showing a door cover assembly and a fan housing assembly in FIG. 2.
Figure 14:
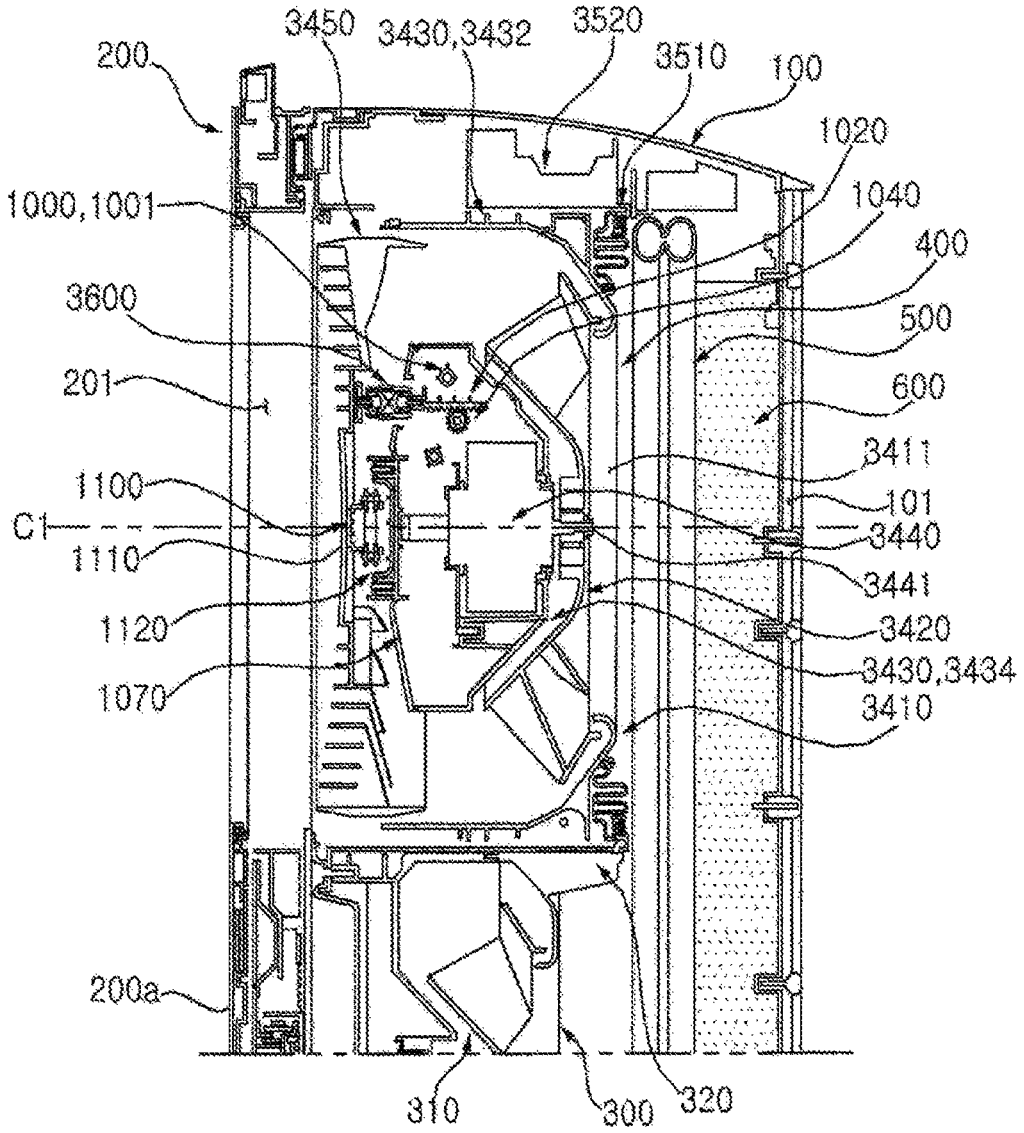
FIG. 14 is a right cross-sectional view showing a door cover assembly and a fan housing assembly in FIG. 4.
Figure 15:
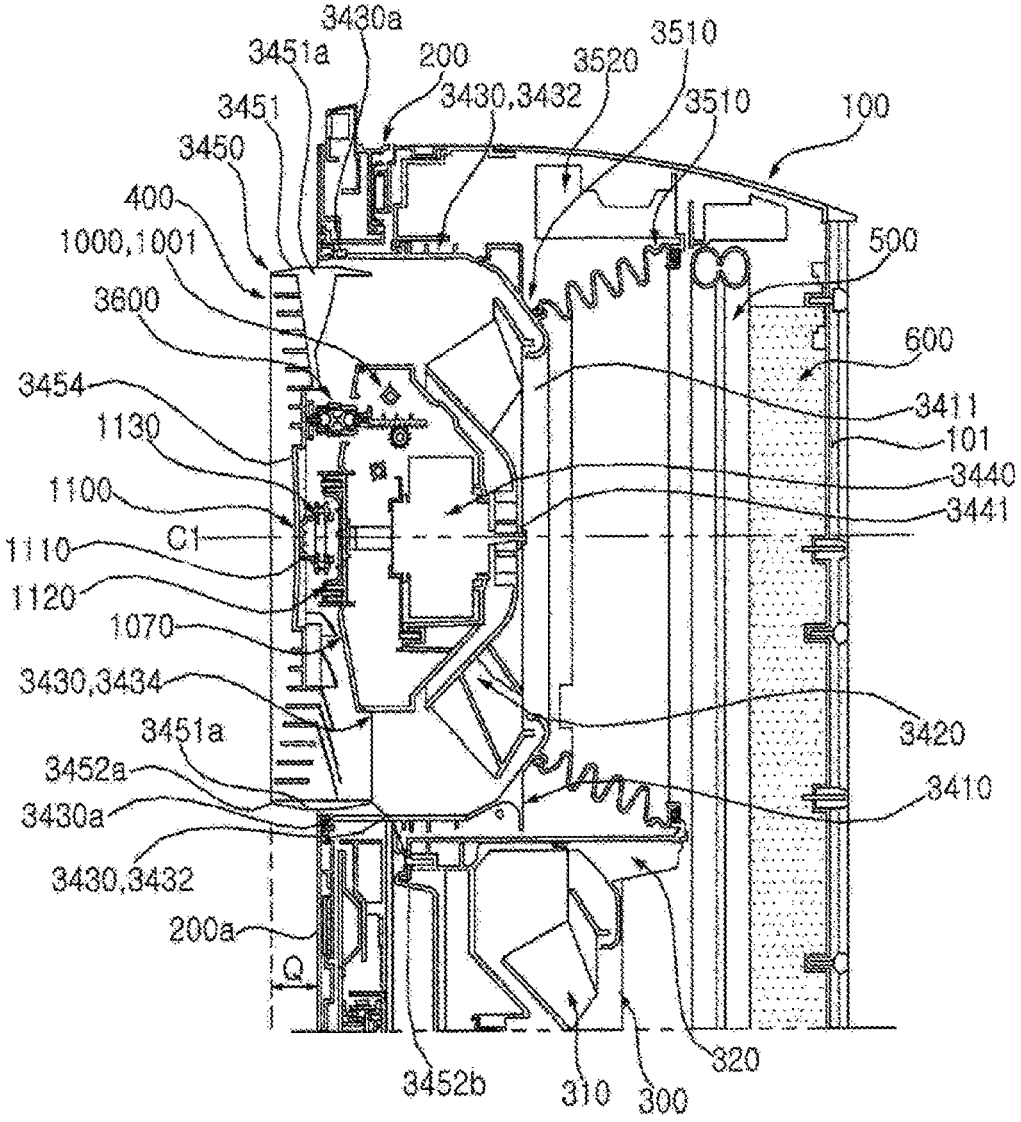
FIG. 15 is a right cross-sectional view showing a door cover assembly and a fan housing assembly in FIG. 5.
Figure 16:
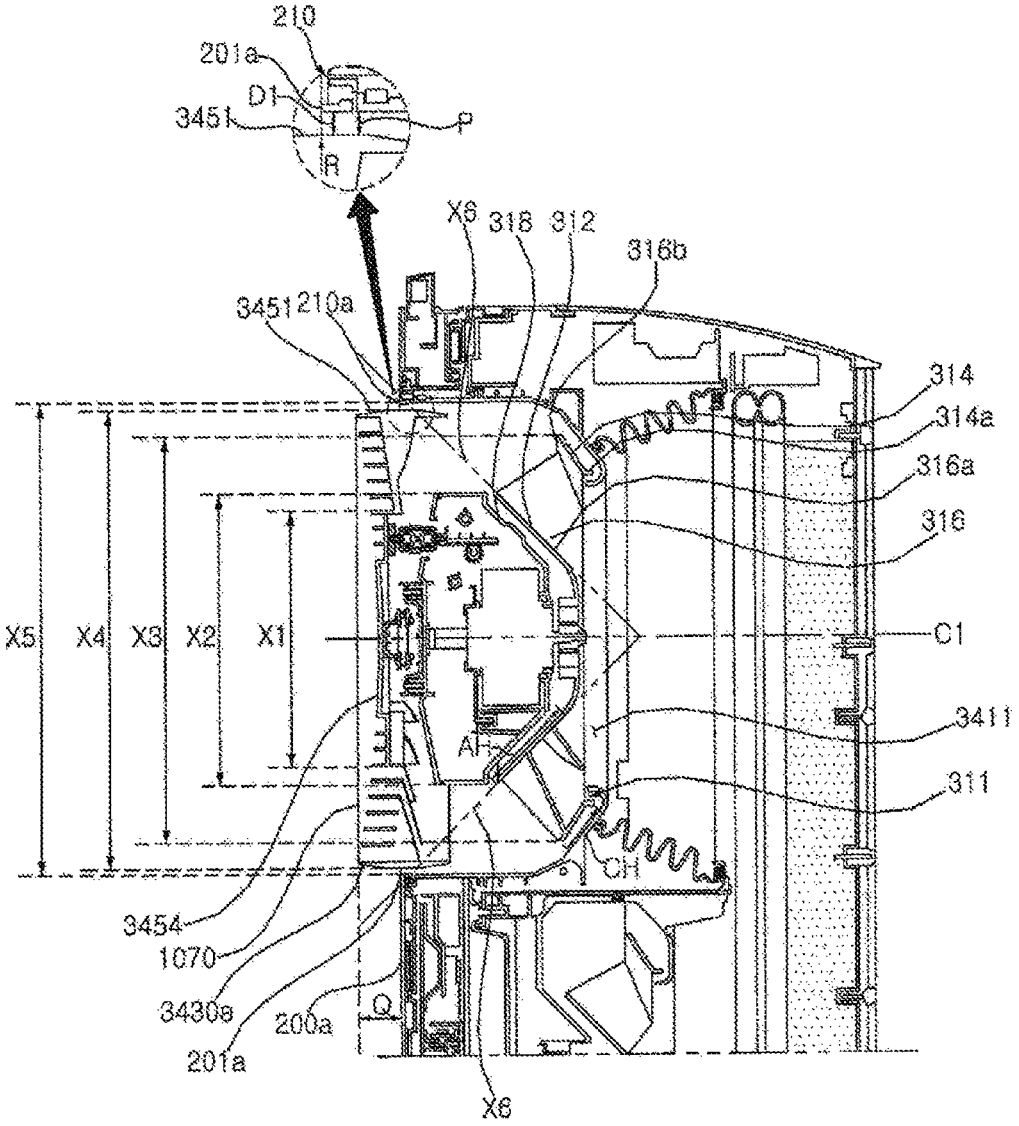
FIG. 16 is an exemplary view showing sizes and an angle of each of components in FIG. 15.
Figure 17:
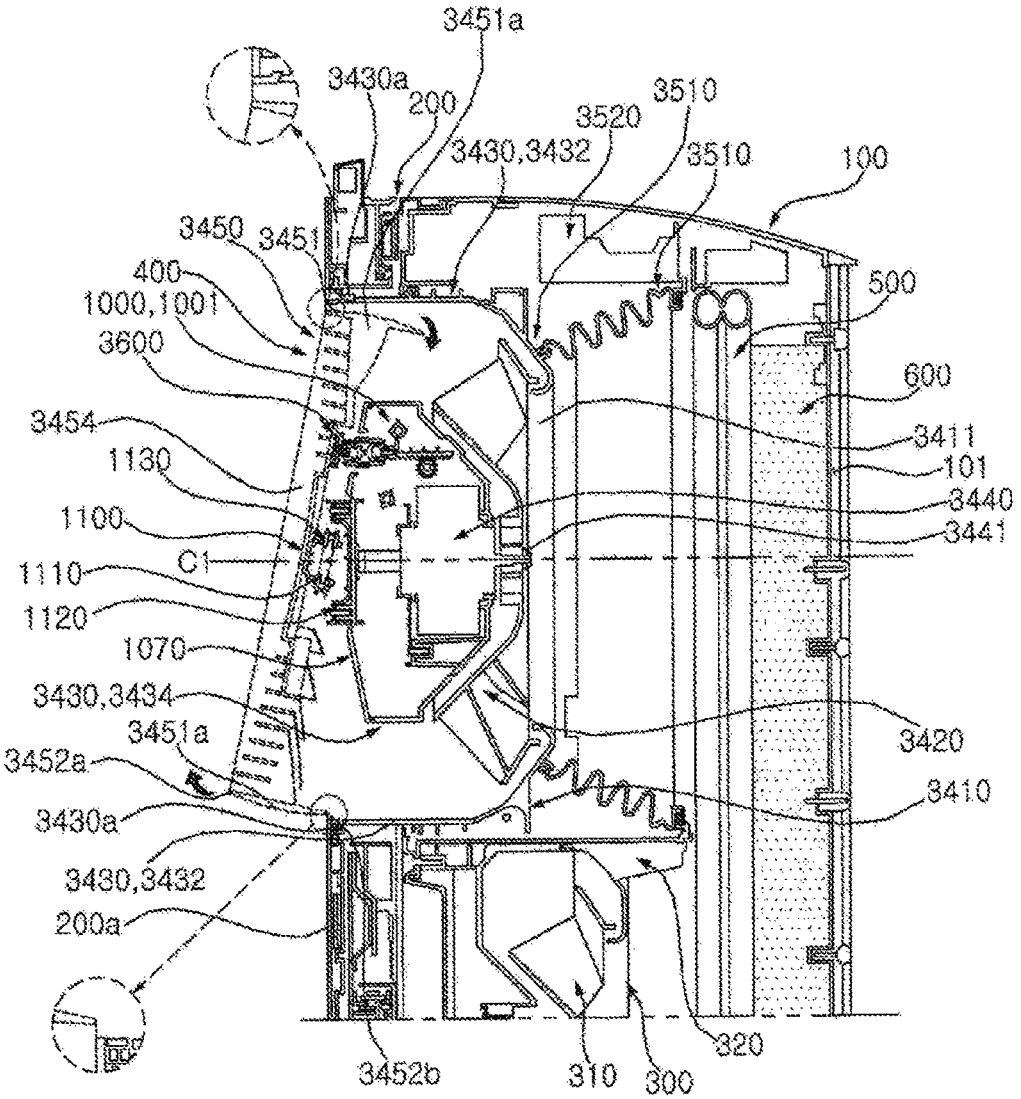
FIG. 17 is a right cross-sectional view showing a door cover assembly and the fan housing assembly in FIG. 8.
Figure 18:
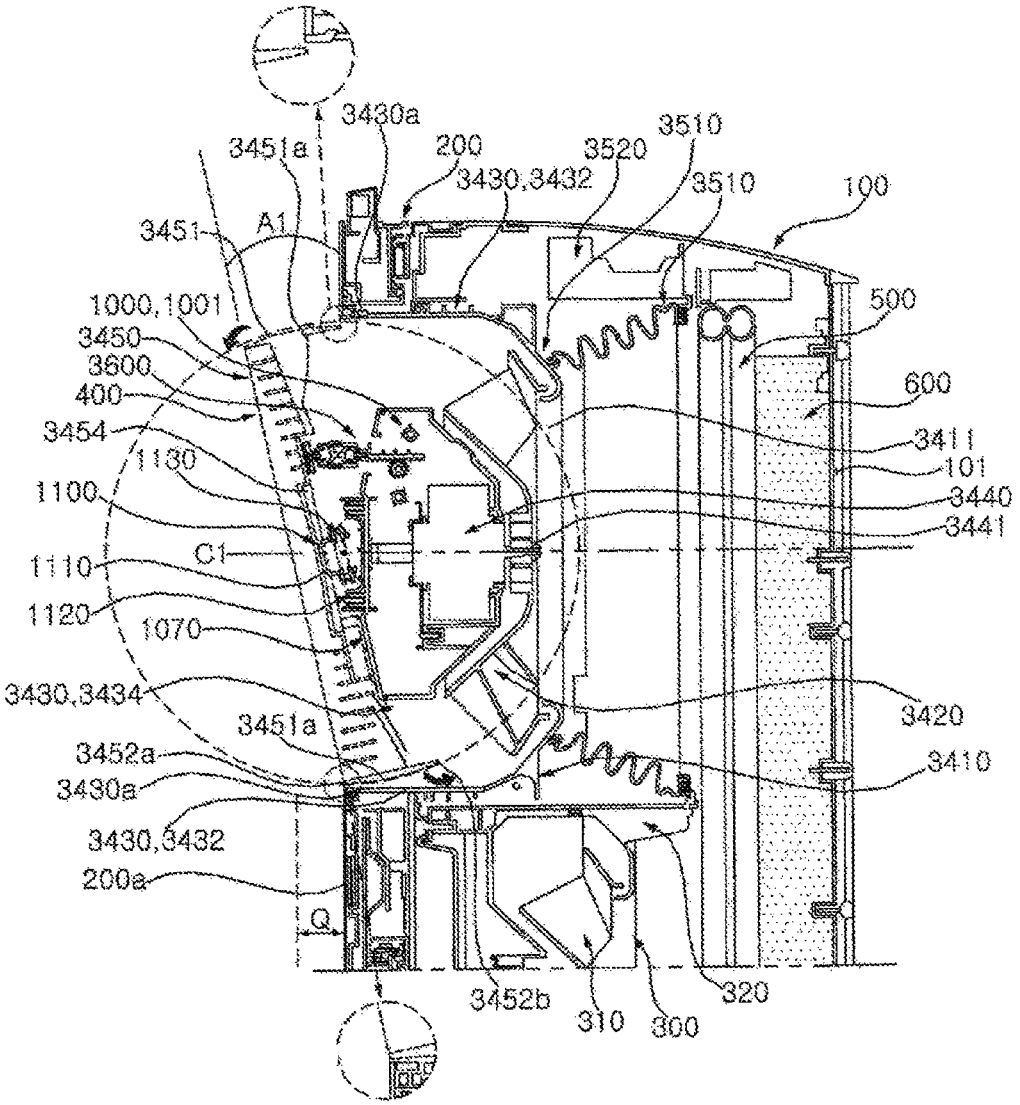
FIG. 18 is a right cross-sectional view showing a door cover assembly and a fan housing assembly in FIG. 9.
Figure 19:
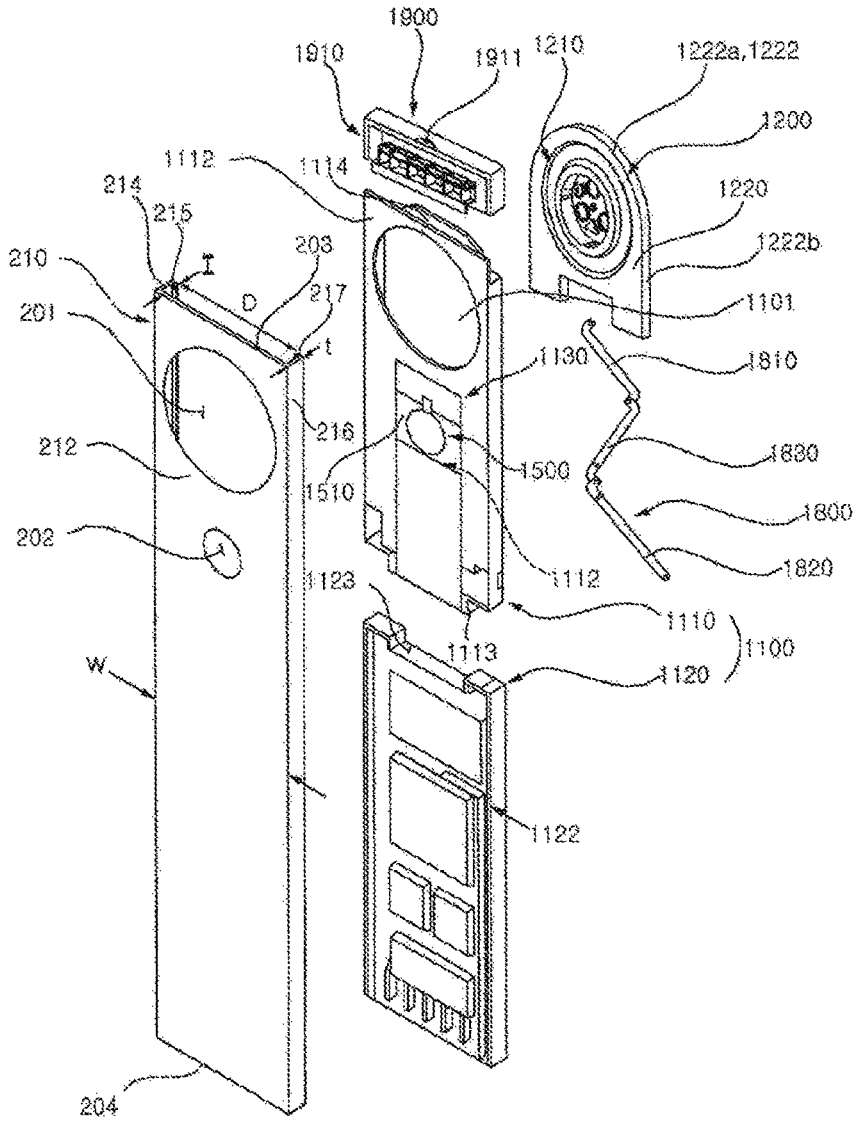
FIG. 19 is an exploded perspective view showing a door assembly in FIG. 1.
Figure 20:
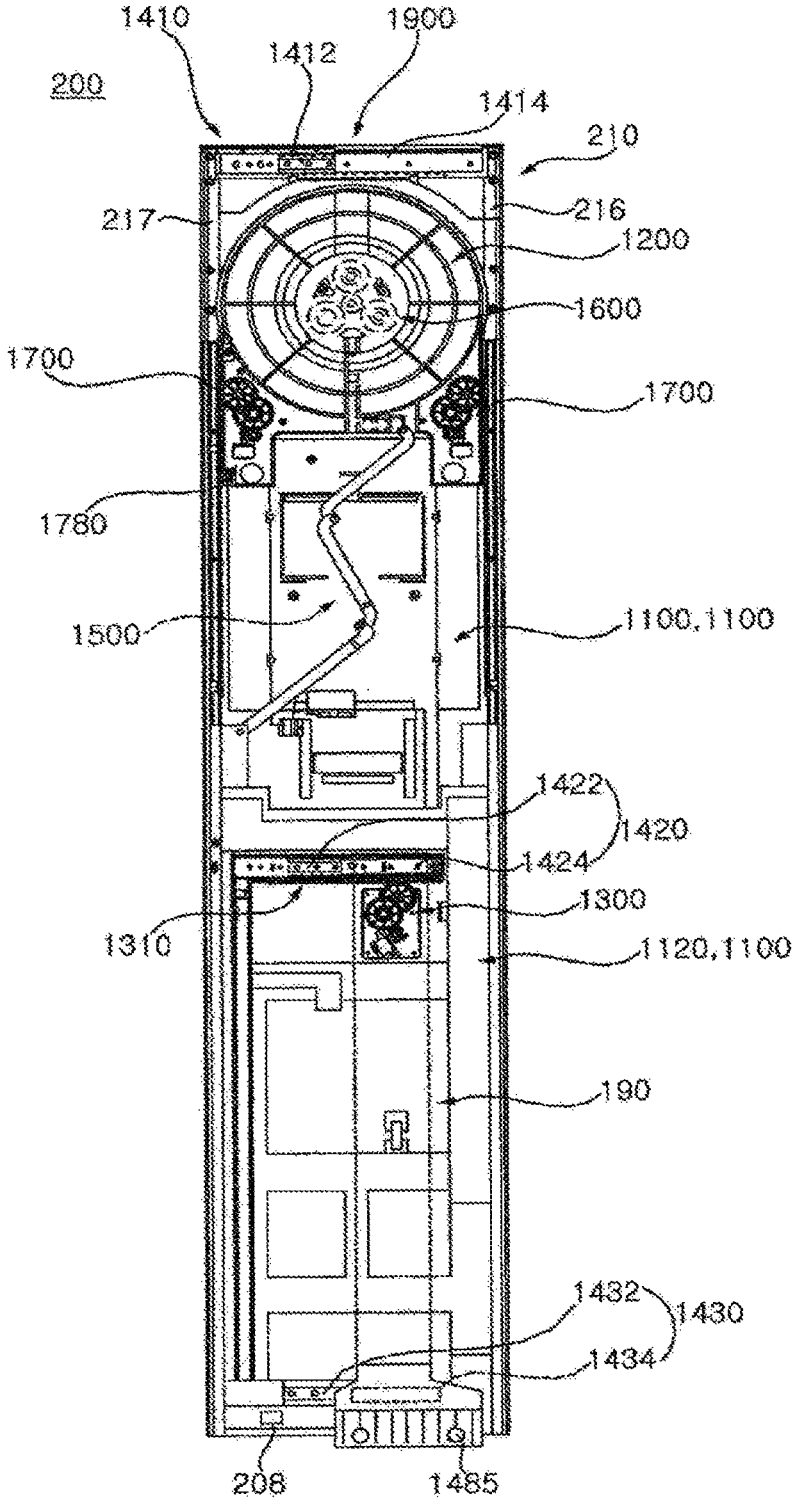
FIG. 20 is a rear view showing a door assembly in FIG. 1.
Figure 21:
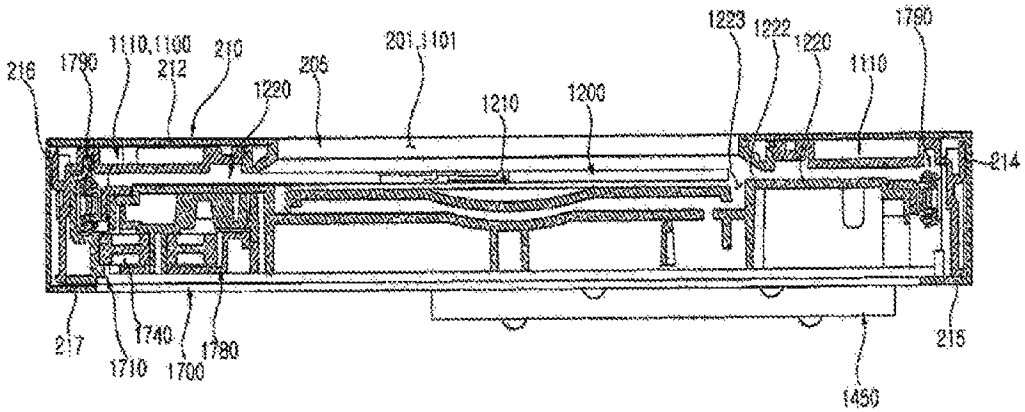
FIG. 21 is a plan cross-sectional view showing a door assembly in FIG. 2.
Figure 22:
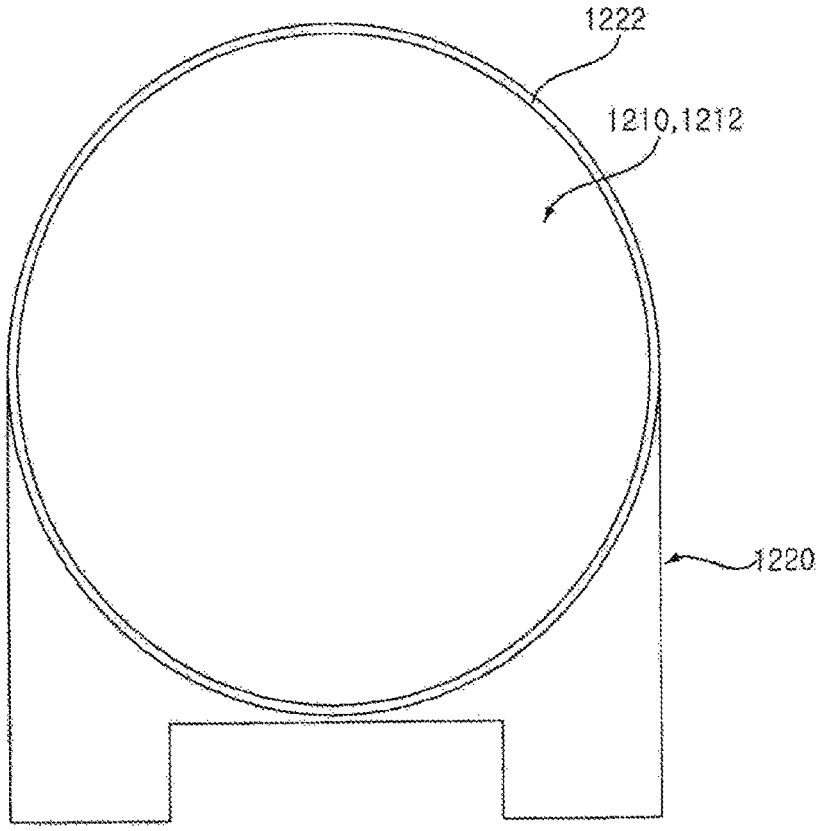
FIG. 22 is a front view showing a door cover assembly in FIG. 19.
Figure 23:
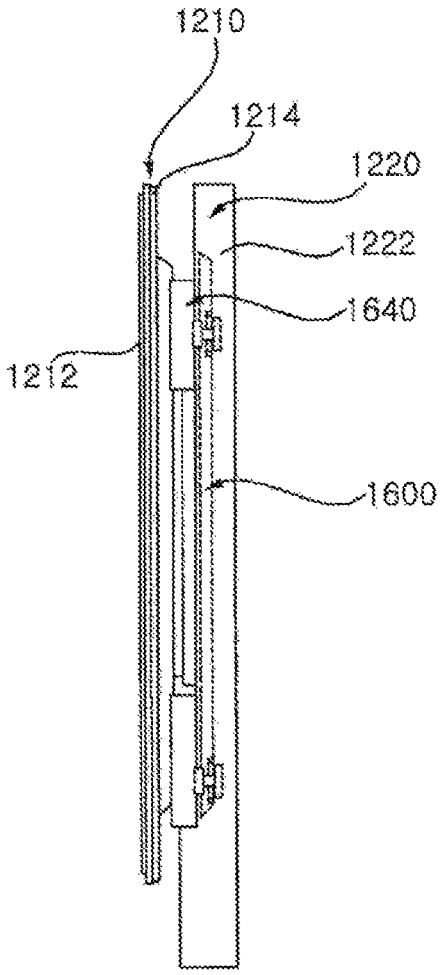
FIG. 23 is a right side view showing the door cover assembly in FIG. 22.
Figure 24:
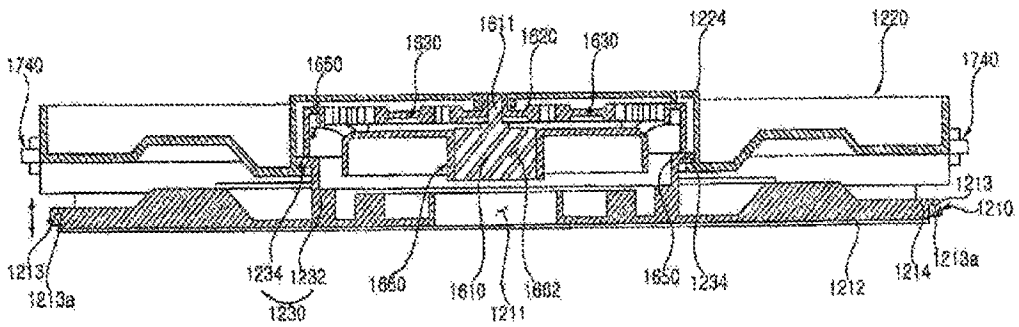
FIG. 24 is a plan cross-sectional view showing the door cover assembly in FIG. 22.
Figure 25:
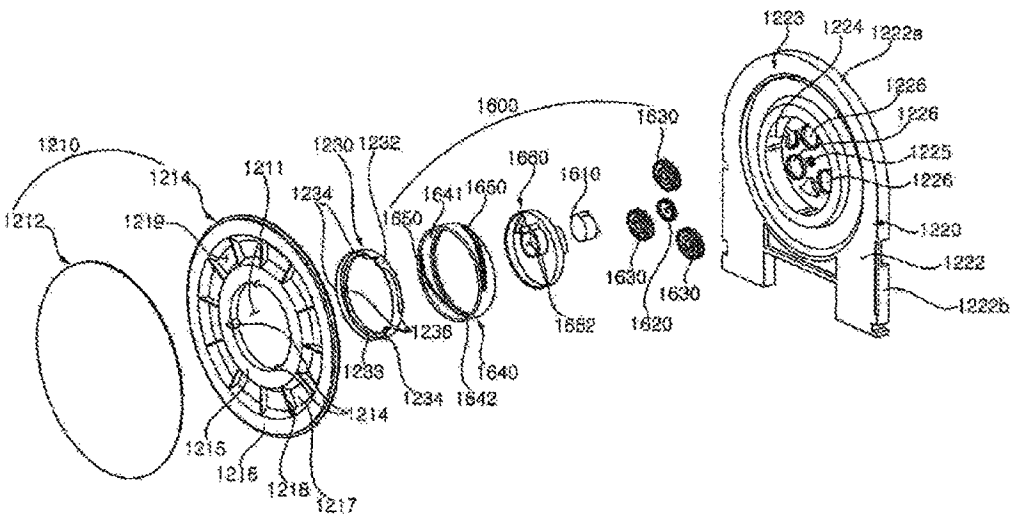
FIG. 25 is an exploded perspective view showing a door cover assembly according to an embodiment of the present disclosure.
Figure 26:
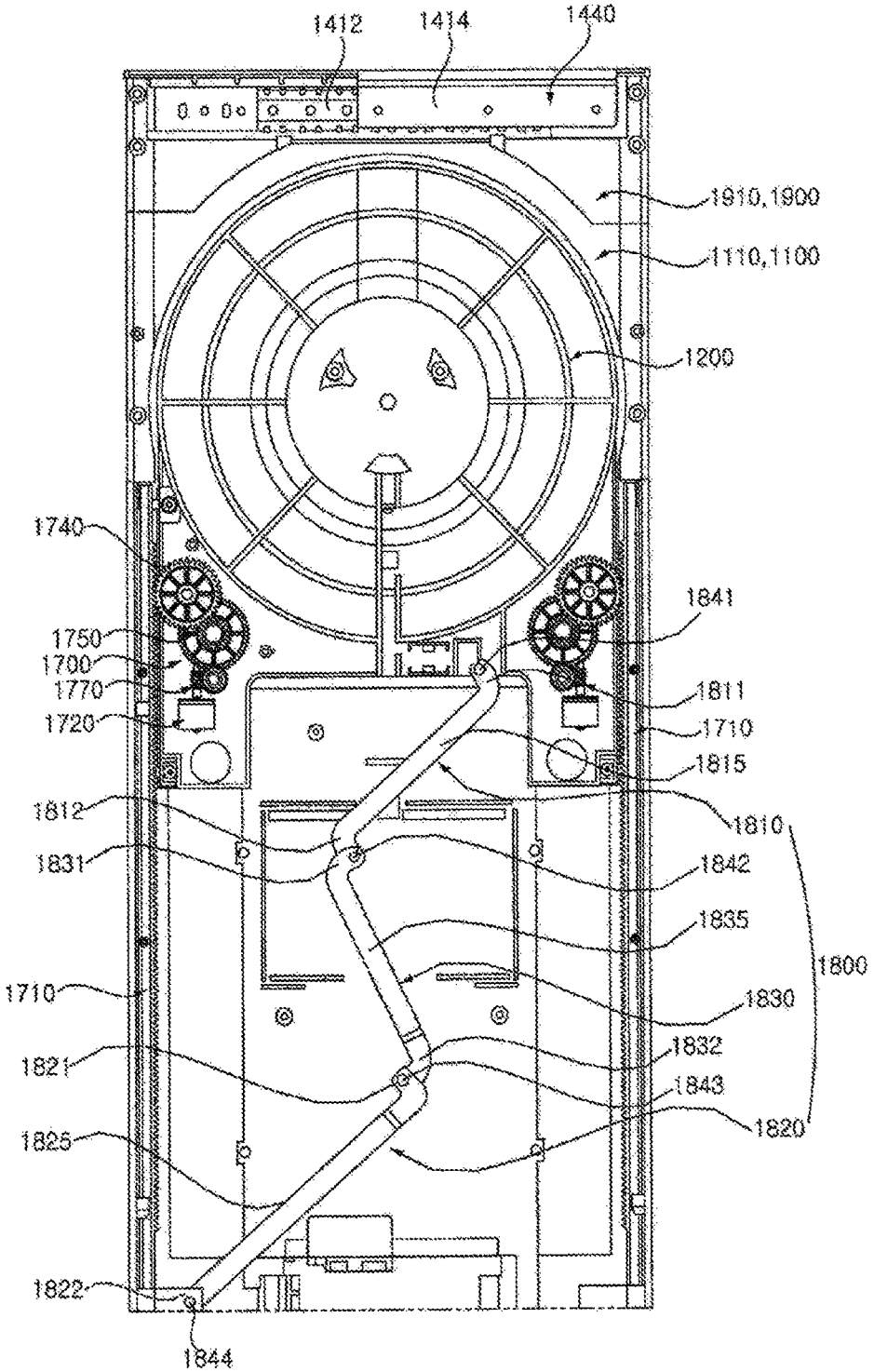
FIG. 26 is an enlarged view showing an upper portion of the door assembly in FIG. 20.
Figure 27:
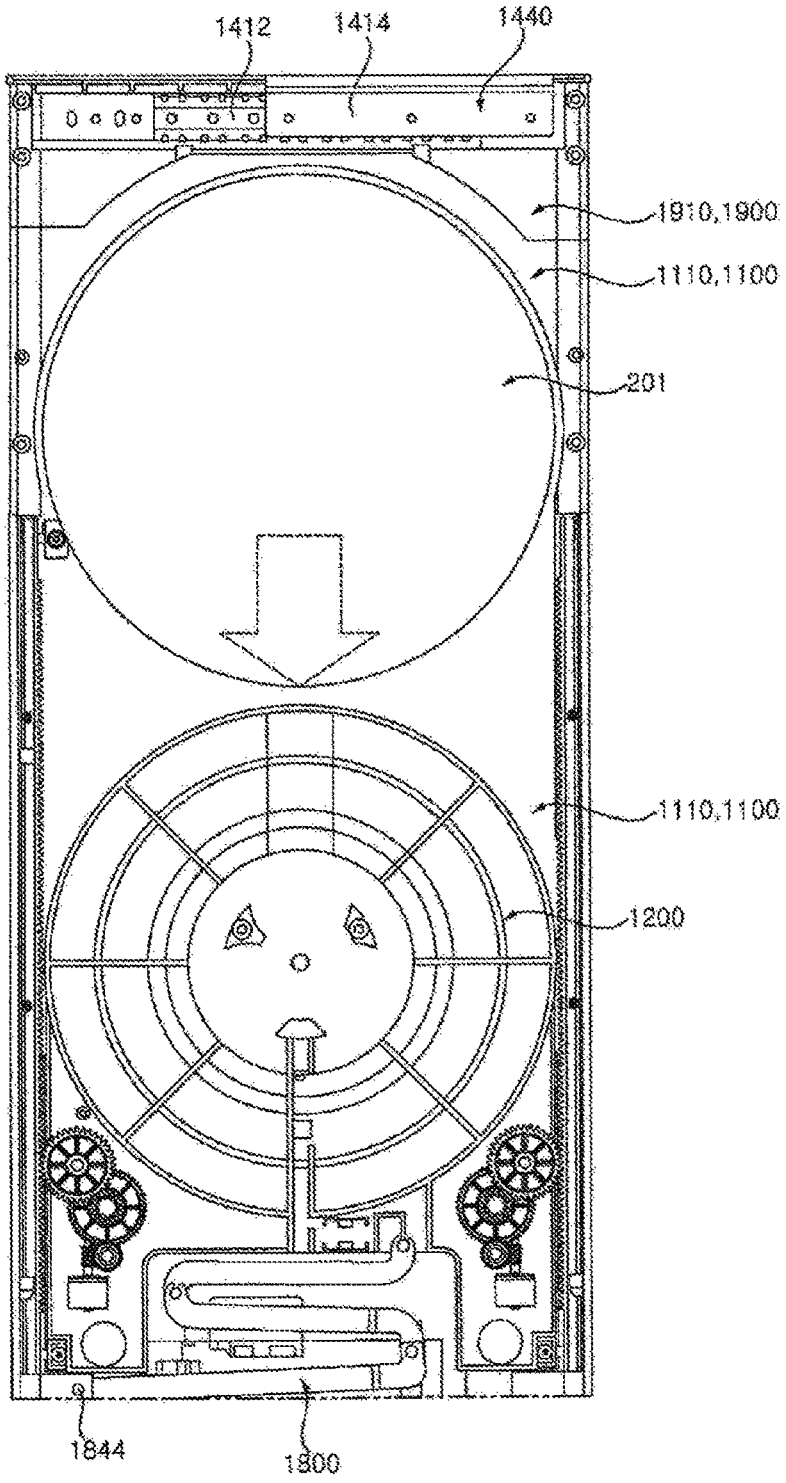
FIG. 27 is an exemplary view showing the door cover assembly in FIG. 26 moving down.
Figure 28:
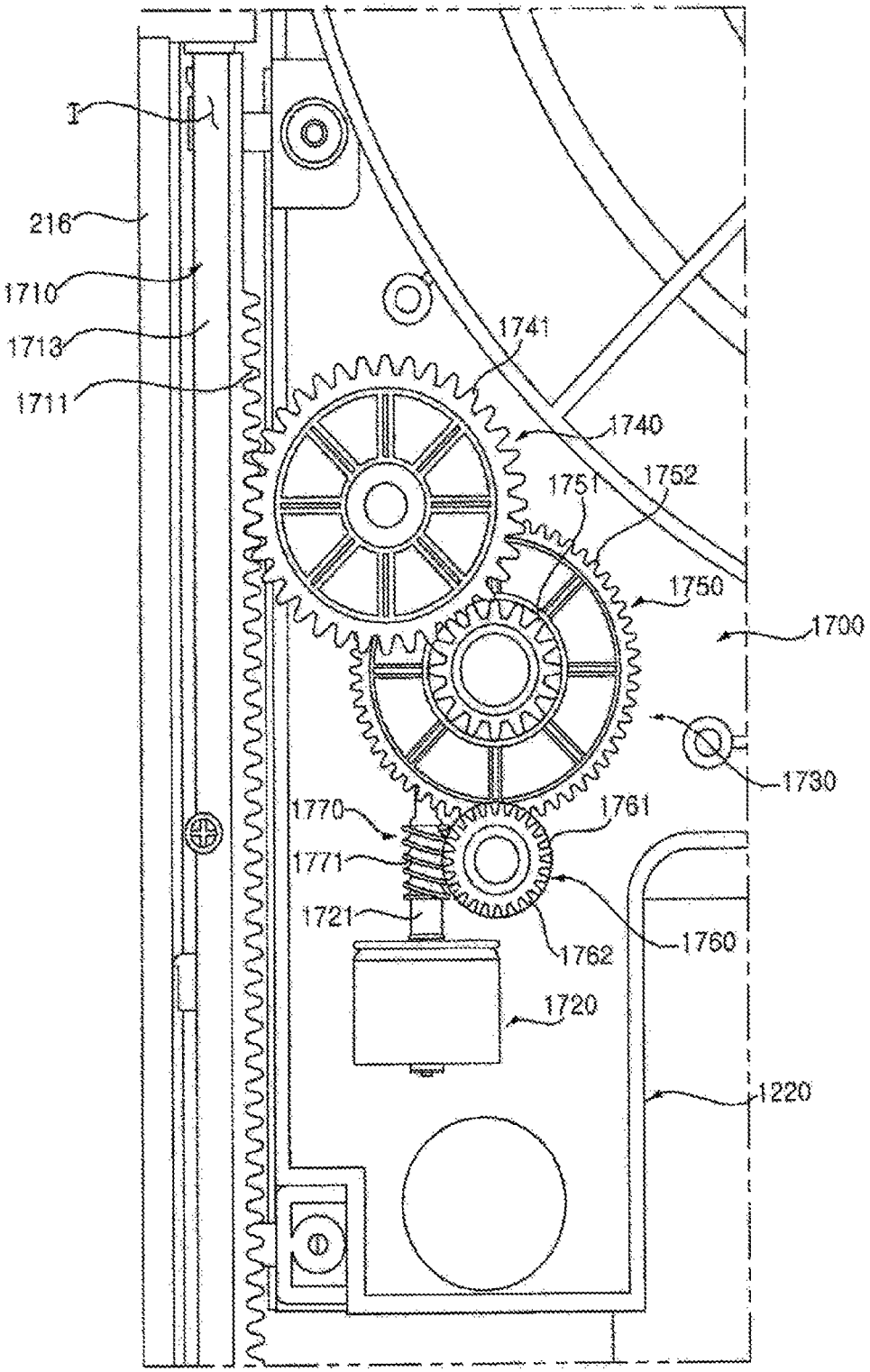
FIG. 28 is an enlarged view showing a door housing moving module in FIG. 26.
Figure 29:
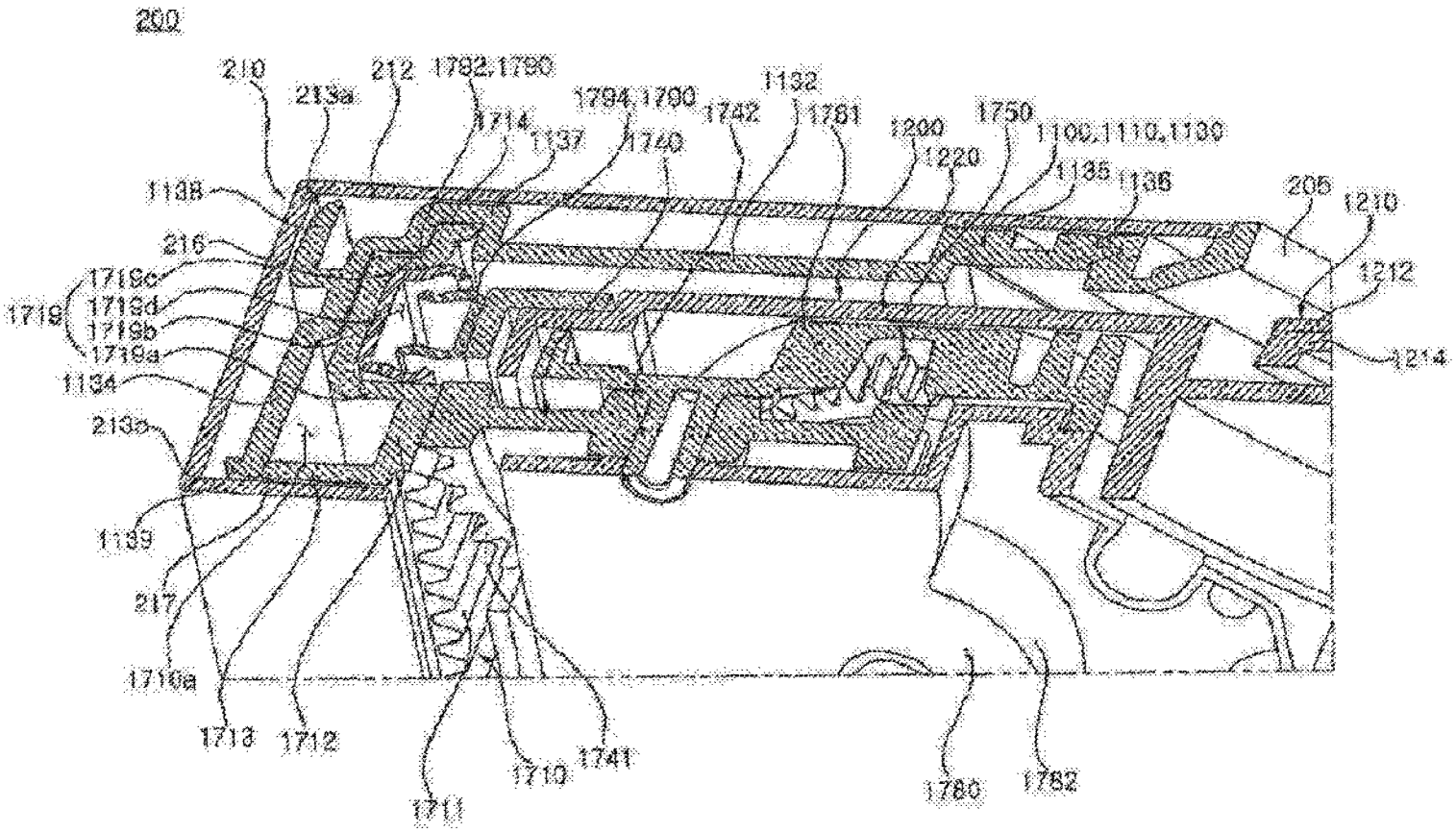
FIG. 29 is a cut-away perspective view showing a coupling structure of a door housing moving module in FIG. 23.
Figure 30:
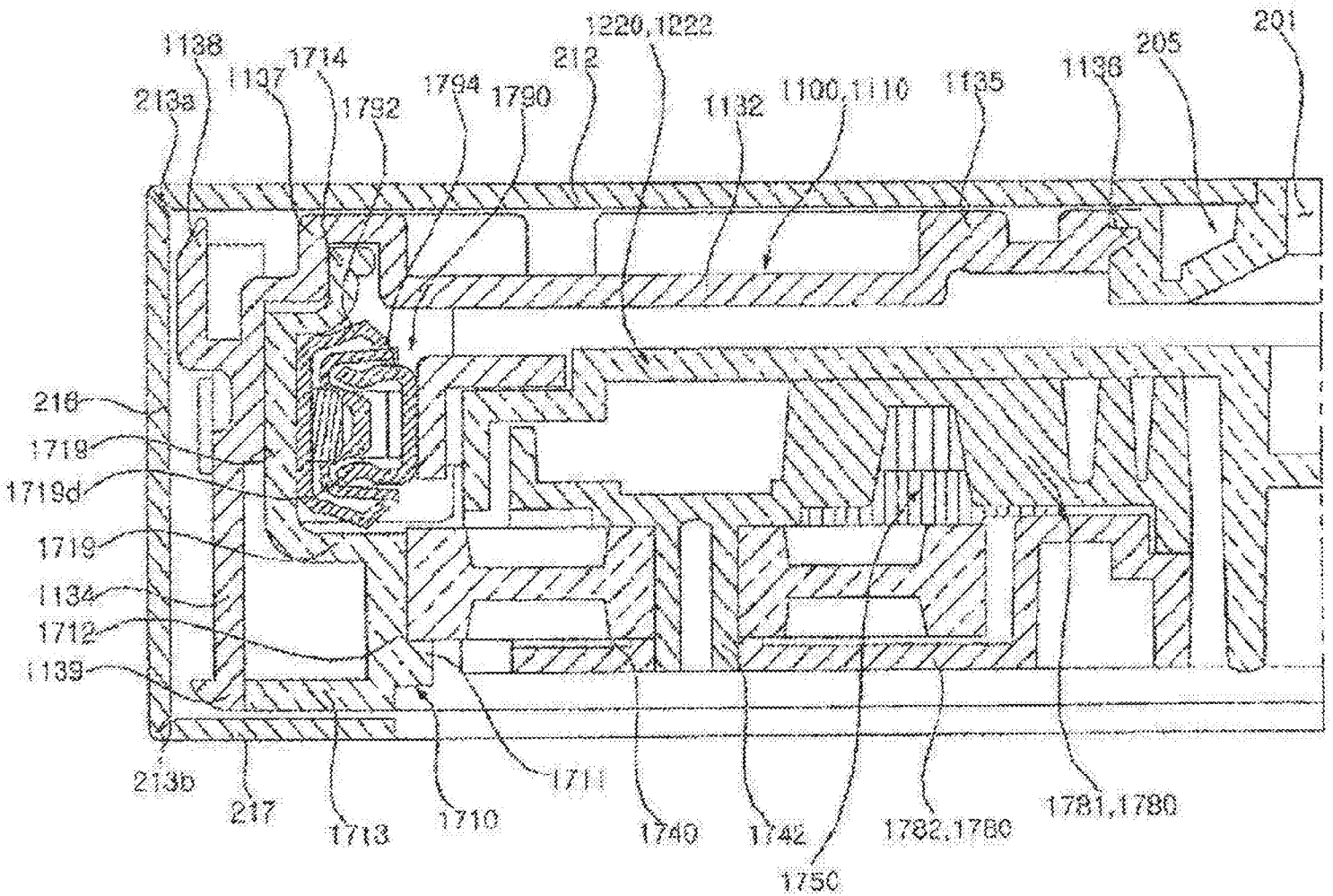
FIG. 30 is an enlarged view showing a coupling structure of a door housing moving module in FIG. 21.

FIG. 12 is a right cross-sectional view showing a door cover assembly and a fan housing assembly in FIG. 1. FIG. 13 is a right cross-sectional view showing a door cover assembly and a fan housing assembly in FIG. 2. FIG. 14 is a right cross-sectional view showing a door cover assembly and a fan housing assembly in FIG. 4. FIG. 15 is a right cross-sectional view showing a door cover assembly and a fan housing assembly in FIG. 5. FIG. 16 is an exemplary view showing sizes and an angle of each of components in FIG. 15. FIG. 17 is a right cross-sectional view showing a door cover assembly and the fan housing assembly in FIG. 8. FIG. 18 is a right cross-sectional view showing a door cover assembly and a fan housing assembly in FIG. 9. FIG. 19 is an exploded perspective view showing a door assembly in FIG. 1. FIG. 20 is a rear view showing a door assembly in FIG. 1. FIG. 21 is a plan cross-sectional view showing a door assembly in FIG. 2. FIG. 22 is a front view showing a door cover assembly in FIG. 19. FIG. 23 is a right side view showing the door cover assembly in FIG. 22. FIG. 24 is a plan cross-sectional view showing the door cover assembly in FIG. 22. FIG. 25 is an exploded perspective view showing a door cover assembly according to an embodiment of the present disclosure. FIG. 26 is an enlarged view showing an upper portion of the door assembly in FIG. 20. FIG. 27 is an exemplary view showing the door cover assembly in FIG. 26 moving down. FIG. 28 is an enlarged view showing a door housing moving module in FIG. 26. FIG. 29 is a cut-away perspective view showing a coupling structure of a door housing moving module in FIG. 23. FIG. 30 is an enlarged view showing a coupling structure of a door housing moving module in FIG. 21.

<<<Configuration of Door Assembly>>>

The door assembly 200 includes a front panel 210 that defines a front discharge outlet 201, a panel module 1100 coupled to a rear surface of the front panel 210 and to define a panel discharge outlet 1101 communicating with the front discharge outlet 201, a door cover assembly 1200 disposed on the panel module 1100 and to open and close the panel discharge outlet 1101 and the front discharge outlet 201, a door slide module 1300 disposed on the panel module 1100 and to horizontally move the panel module 1100 with respect to the cabinet assembly 100, a camera module 1900 disposed on the panel module 1100 and to shoot an indoor image, and a cable guide 1800 having an upper end assembled to be rotatable relative to the door cover assembly 1200 and a lower end assembled to be rotatable relative to the panel module assembly 1100, and to accommodate a cable connected to the door cover assembly 1200.

The front panel 210 defines the front discharge outlet 201 and the front discharge outlet 201 is opened in a forward and rearward direction. The panel discharge outlet 1101 is defined in the panel module 1100 and is opened in a forward and rearward direction.

The front discharge outlet 201 and the panel discharge outlet 1101 have the same area and shape. The front discharge outlet 201 is disposed in front of the panel discharge outlet 1101.

In addition, the door assembly 200 further includes a display module 1500 disposed in the panel module 100 and to visually provide indoor unit information to the front panel 210.

The display module 1500 is disposed on the rear surface of the front panel 1100 and may provide visual information to the user through the front panel 1100.

For example, the display module 1500 may pass through the front panel 1100 to expose a portion thereof and may provide visual information to the user through the exposed display.

In this embodiment, the display module 1500 transmits the information to the user through the display opening 202 defined in the front panel 210.

<<Configuration of Front Panel>>

The front panel 210 is disposed on a front surface of the indoor unit. The front panel 210 includes a front panel body 212, a front discharge outlet 201 opened in a forward and rearward direction of the front panel body 212, a display opening 202 opened in a forward and rearward direction of the front panel body 212, a first front panel side 214 disposed on the left side of the front panel body 212 and to cover the left surface of the panel module 1100, and a second front panel side 216 disposed at the right side of the front panel body 212 and to cover a right surface of the panel module 1100.

The front panel 210 has a long vertical length compared to a horizontal width. In this embodiment, the vertical length of the front panel 210 is three times or more than the horizontal width. In addition, the front panel 210 has a very thin thickness in the forward and rearward direction compared to the horizontal width. In this embodiment, the thickness in the forward and rearward direction of the front panel 210 is ¼ or less compared to the horizontal width.

In this embodiment, the display opening 202 is disposed below the front discharge outlet 201. In contrast to this embodiment, the display opening 202 may be disposed above the front discharge outlet 201.

The front discharge outlet 201 and the display opening 202 are disposed in the vertical direction. A virtual center line C connecting a center of the front discharge outlet 201 to a center of the display opening 202 is vertically disposed. The front panel 210 is bilaterally symmetrical with respect to the center line C.

A camera 1911 of the camera module 1900 is disposed on the center line C.

The front discharge outlet 201 has a circular shape. The shape of the front discharge outlet 201 corresponds to a front shape of a discharge grill 450. The discharge grill 450 concealed in the cabinet assembly 100 is exposed to the outside through the front discharge outlet 201.

In this embodiment, the front discharge outlet 201 is selectively opened to expose the discharge grill 450. In addition, the discharge grill 450 protrudes forward from the front panel 210 through the front discharge outlet 201.

When the discharge grill 450 protrudes forward from the front panel 210, interference between the air passing through the discharge grill 450 and the front panel 210 may be minimized to farther the flow the discharged air.

The first front panel side 214 protrudes rearward from a left edge of the front panel body 212 and covers the left surface of the panel module 1100 coupled to the rear surface of the front panel body 212.

The second front panel side 216 protrudes rearward from a right edge of the front panel body 212 and covers the right surface of the panel module 1100 coupled to the rear surface of the front panel body 212.

The first front panel side 214 and the second front panel side 216 each block side surfaces of the panel module 1100 from being exposed to the outside.

In addition, a first front panel end 215 protruding from the rear end of the first front panel side 214 towards the second front panel side 216 is further disposed. A second front panel end 217 protruding from the rear end of the second front panel side 216 towards the first front panel side 214 is further disposed.

The first front panel end 215 and the second front panel end 217 are each disposed on the rear surface of the panel module 1100. For example, the panel module 1100 is disposed between the front panel body 212 and the front panel ends 215 and 217.

In this embodiment, a distance between the front panel body 212 and each of the front panel ends 215 and 217 is referred to as "an inner distance (I)" of the front panel. The inner distance (I) is shorter than the thickness in the forward and rearward direction of the front panel 210.

In addition, the first front panel end 215 and the second front panel end 217 face each other and are spaced apart from each other. In this embodiment, a distance between the first front panel end 215 and the second front panel end 217 is referred to as "an opening distance (D)" of the front panel. The opening distance (D) of the front panel 210 is shorter than a horizontal width (W) of the front panel 210.

In this embodiment, the front panel body 212 is parallel to the front panel ends 215 and 217. The front panel body 212 and the front panel sides 214 and 216 cross with each other and are orthogonal in this embodiment. The front panel sides 214 and 216 are each disposed in the forward and rearward direction.

In this embodiment, the front panel body 212, the front panel sides 214 and 216, and the front panel ends 215 and 217 of the front panel 210 are integrated with one another.

In this embodiment, the front panel 210 is entirely made of metal. In particular, the front panel 210 is entirely made of aluminum.

The front panel sides 214 and 216 are bent from the front panel body 212 toward the rear side thereof and the front panel ends 215 and 217 are bent from the front panel sides 214 and 216 toward the opposite sides thereof.

A first bending groove (not shown) is defined at a bending portion between the front panel body 212 and the first front panel side 214 and a second bending groove 213*a* may be defined at a bending portion between the front panel body 212 and the second front panel side 216 to easily bend the front panel 210 entirely made of metal.

In addition, a third bending groove (not shown) is defined at a bending portion between the first front panel side 214 and the first front panel end 215 and a fourth bending groove 213*b* may be defined at a bending portion between the second front panel side 216 and the second front panel end 217.

Each of the bending grooves may extend long in the vertical direction of the front panel 210. Each of the bending grooves is preferably disposed inside the bending portion. When the first bending groove and the second bending groove 213*a* are not provided, an angle between the front panel body 212 and the front panel side may be difficult to form into a right angle. In addition, when the first bending groove and the second bending groove 213*a* are not provided, the bending portion between the front panel body 212 and the front panel side does not have a flat shape and may protrude in any direction, and a shape thereof may be changed during bending. The third bending groove and the fourth bending groove 213*b* perform the same function as the first bending groove and the second bending groove 213*a*.

A panel upper opening 203 is defined at the top of the front panel 210 manufactured as described and a panel lower opening 204 is defined at the bottom of the front panel 210. In this embodiment, as the front panel 210 is manufactured by bending a single metal plate, the panel upper opening 203 and the panel lower opening 204 have the same area and shape.

The thickness of the panel module 1100 is equal to or less than the distance between the front panel body 212 and each of the front panel ends 215 and 217. The panel module 1100 may be inserted through the panel upper opening 203 or the panel lower opening 204. The panel module 1100 may be coupled by a fastening member (not shown) passing through the front panel ends 215 and 217.

The camera module 1900 is inserted into the panel upper opening 203 and is disposed on the panel module 1100. The camera module 1900 may close the panel upper opening 203.

The camera module 1900 is disposed above the front discharge outlet 201 and is disposed on the rear surface of the front panel 210. The camera module 1900 is concealed by the front panel 210. The camera module 1900 is exposed above the front panel 210 only during operation and is hidden at the rear surface of the front panel 210 when not in operation.

The front panel ends 215 and 217 surround the side surface and the rear surface of the camera module 1900 and a fastening member (not shown) is coupled to the camera module 1900 through the front panel ends 215 and 217.

In this embodiment, the panel upper opening 203 and the camera module 1900 have the same horizontal width. In addition, in this embodiment, the panel upper opening 203 and the panel module 1100 have the same horizontal width.

In this embodiment, the panel upper opening 203 and the camera module 1900 have the same thickness in the forward and rearward direction. In addition, in this embodiment, the panel upper opening 203 and the panel module 1100 have the same thickness in the forward and rearward direction.

In this example, the camera module 1900 and the panel module 1100 may be disposed between the front panel body 212 and each of the front panel ends 215 and 217 and may be supported by the front panel body 212 and the front panel ends 215 and 217.

<<Structure of Panel Module>>

The panel module 1100 includes an upper panel module 1110 and a lower panel module 1120. In contrast to this embodiment, the upper panel module 1110 and the lower panel module 1120 may be integrated with each other. In this embodiment, as the front panel 210 has a greater vertical length than a horizontal width of the front panel 210, there is a restriction that the panel module 1100 is difficult to be inserted through a panel upper opening 203 or a panel lower opening 204 of the front panel 210 when the panel module 1100 including the integrated components is manufactured.

In this embodiment, the panel module 1100 includes two components, for example, the upper panel module 1110 and the lower panel module 1120, the upper panel module 1110 is inserted into the front panel 210 through the panel upper opening 203, and the lower panel module 1120 is inserted into the front panel 210 through the panel lower opening 204.

When the panel module 1100 is manufactured to include two components, there is an advantage that the upper panel module 1110 or the lower panel module 1120 may each be easily repaired and replaced. The integrated upper panel module 1110 and lower panel module 1120 suppress distortion of the front panel 210 and provides rigidity against external force to the front panel 210.

For example, when the door cover assembly 1200 needs to be replaced, only the upper panel module 1110 may be separated and when a door slide module 1300 needs to be replaced, only the lower panel module 1120 may be replaced.

The upper panel module 1110 and the lower panel module 1120 are each inserted into a space having the inner distance (I) of the front panel 210, support the front panel 210, and prevent deformation and warpage of the front panel 210.

In this embodiment, the upper panel module 1110 and the lower panel module 1120 are made of molded material. The upper panel module 1110 and the lower panel module 1120 made of the molded material each contacting the front panel body 212, the front panel sides 214 and 216, and the front panel ends 215 and 217.

The upper panel module 1110 and the lower panel module 1120 each support the front panel body 212, the front panel sides 214 and 216, and the front panel end 215 and 217 to suppress the warpage of the front panel 210 made of metal.

In this embodiment, the upper panel module 1110 and the lower panel module 1120 each support the entire surfaces of the first front panel side 214 and the second front panel side 216 to which external impact may be frequently applied.

In addition, the upper panel module 1110 and the lower panel module 1120 each support only a partial area and does not support the entire surface of the front panel body 212 to reduce overall load of the door assembly 200. For example, the upper panel module 1110 and the lower panel module 1120 each define a plurality of bending portions at a front side and a rear side thereof and support some areas on the rear surface of the front panel body 212.

<Configuration of Upper Panel Module>

The upper panel module 1110 includes an upper panel body 1130 disposed on a rear surface of a front panel 210 and a panel discharge outlet 1101 to pass through the upper panel body 1130 in a forward and rearward direction, disposed behind the front discharge outlet 201, and communicating with the front discharge outlet 201.

The panel discharge outlet 1101 corresponds to the front discharge outlet 201. In this embodiment, the panel discharge outlet 1101 and the front discharge outlet 201 each have a circular shape. A gasket 205 may be disposed between the panel discharge outlet 1101 and the front discharge outlet 201 to prevent the discharged air from leaking.

The gasket 205 is disposed along an inner surface of the front discharge outlet 201 and contacts the upper panel module 1110. The panel discharge outlet 1101 is defined on the rear surface of the gasket 205.

The panel discharge outlet 1101 has the area same as or greater than that of the front discharge outlet 201. In this embodiment, the panel discharge outlet 1101 has a slightly greater diameter than a diameter of the front discharge outlet 201 in consideration of the installation structure of the gasket 205. The gasket 205 contacts an inner surface of the front discharge outlet 201 and an inner surface of the panel discharge outlet 1101 and closes between the upper panel module 1110 and the front panel 210.

The discharge grill 450 of the long-distance fan assembly 400 sequentially passes through the panel discharge opening 1101 and the front discharge opening 201 and protrudes forward from the front surface of the front panel 210.

When the discharge grill 450 protrudes to the outside, a front end of the fan housing 430 of the long-distance fan assembly 400 may contact the gasket 205. The front end of the fan housing 430 contacts the gasket 205 to block air flowing inside the fan housing 430 from leaking into the door assembly 200.

When the air discharged from the long-distance fan assembly 400 leaks into the door assembly 200, dew formation may occur inside the door assembly 200.

In particular, as the front panel 210 is made of metal, the discharged air leaking into the door assembly 200 during cooling may cool the surroundings of the front discharge outlet 201 and form a large amount of dew around the front discharge outlet 201.

Meanwhile, in this embodiment, the door cover assembly 1200 and the display module 1500 are each disposed on the upper panel module 1110.

When the door cover assembly 1200 and the display module 1500 are assembled to the upper panel module 1110, the assembled component is disposed within the thickness of the front panel 210.

To this end, a display installation portion 1112 is disposed on the upper panel module 1110 and the display module 1500 is disposed in the display installation portion 1112. The display installation portion 1112 is disposed on the upper panel module 1110 to minimize a degree of protrusion of the display module 1500 forward from the upper panel body 1130.

The display installation portion 1112 may penetrate the upper panel module 1110 in the forward and rearward direction.

The display module 1500 is assembled to the upper panel module 1110. The display module 1500 assembled to the upper panel module 1110 is partially exposed to the outside through the display opening 202 of the front panel 210. When the display module 1500 is exposed to the outside through the display opening 202, a display 1510 of the display module 1500 forms a continuous surface with the front surface of the front panel 210.

For example, the front surface of the display 1510 of the display module 1500 does not protrude further forward than the front panel 210 and forms the continuous plane with the front surface of the front panel 210.

The display module 1500 transmits and receives power and electrical signals through a cable passing through the upper panel module 1110.

The door cover assembly 1200 may be disposed on the rear surface of the upper panel module 1110 and may be vertically moved along the rear surface of the upper panel module 1110.

When the door cover assembly 1200 is moved downward after opening the front discharge outlet 201, the door cover assembly 1200 may be disposed at a same height as the display module 1500.

The door cover assembly 1200 is not coupled to the panel module 1100. The door cover assembly 1200 is vertically movable with respect to the panel module 1100.

In this embodiment, the upper panel module 1110 and the lower panel module 1120 are stacked vertically. In particular, the upper panel module 1110 and the lower panel module 1120 are assembled to each other inside the front panel 210 to minimize vibration or operating noise when the door assembly 200 slides.

To this end, the upper panel module 1110 and the lower panel module 1120 may be assembled by stationary fitting. One of the upper panel module 1110 and the lower panel module 1120 defines a panel protrusion protruding to the other one thereof and the other one thereof defines a panel fitting portion to accommodate the protrusion fitting portion.

In this embodiment, the upper panel module 1110 defines a panel protrusion 1113. The panel protrusion 1113 protrudes downward from a lower surface of the upper panel body 1130.

The lower panel module 1120 defines a panel fitting portion 1123 to accommodate the panel protrusion 1113 and to be assembled to the panel protrusion 1113 by the stationary fitting.

The panel fitting portion 1123 is disposed on an upper surface of the lower panel module 1120.

<Configuration of Lower Panel Module>

The lower panel module 1120 is disposed on a rear surface of a front panel 210. The lower panel module 1120 is disposed within an inner distance (I) of the front panel 210. The lower panel module 1120 is disposed under the upper panel module 1110, supports the upper panel module 1110, and is assembled to the upper panel module 1110.

The lower panel module 1120 is disposed in the front panel 210 to prevent deformation of the front panel 210. The lower panel module 1120 is coupled to the upper panel module 1110 by stationary fitting and supports the upper panel module 1110 from under the upper panel module 1110.

The lower panel module 1120 includes a lower panel body 1122 assembled to the front panel 210. A panel fitting portion 1123 is disposed above the lower panel body 1122 to be fitted into the panel protrusion 1113 of the upper panel module 1110. The panel fitting portion 1123 is concaved downward.

A driver of the door slide module 1300 is disposed on the lower panel module 1120.

The lower panel module 1120 is coupled to the front panel 210 by fastening members (not shown) penetrating the first front panel end 215 and the second front end 217, respectively.

The fastening members are all disposed on the rear surfaces of the first front panel end 215 and the second front end 217 to couple the upper panel module 1110 and the lower panel module 1120, thereby preventing exposure of a fastening structure of the door assembly 200 to the outside, which is hidden.

In particular, a fastening member or a fastening hole is not exposed on the outer surface of the front panel 210 made of metal and is hidden.

<<Configuration of Door Cover Assembly>>

The door cover assembly 1200 opens and closes the front discharge outlet 201 defined in the door assembly 200.

The door cover assembly 1200 opens the front discharge outlet 201 to expand a movement path of a long-distance fan assembly 400. The long-distance fan assembly 400 may protrude outside of the door assembly 200 through the open front discharge outlet 201.

The door cover assembly 1200 is disposed on the movement path of the long-distance fan assembly 400, and when the front discharge outlet 201 is opened, the door cover assembly 1200 is moved out of the movement path of the long-distance fan assembly 400.

The door cover assembly 1200 includes a door cover 1210 disposed in the front discharge outlet 201, moved in a forward and rearward direction of the front discharge outlet 201, and to open and close the front discharge outlet 201, a door cover housing 1220 disposed at a rear side of the door cover 1210 and disposed in the door assembly 200, a door cover moving module 1600 disposed in the door cover housing 1220, disposed between the door cover housing 1220 and the door cover 1210, disposed on the rear surface of the door cover 1210, and to move the door cover 1210 in the forward and rearward direction, and a door housing moving module 1700 disposed in at least one of the door cover housing 1220 or the door assembly 200 and to vertically move the door cover housing 1220.

The door cover 1210 is inserted into the front discharge outlet 201 and provides a continuous surface with the front panel 210. The door cover 1210 may move rearward based on the operation of the door cover moving module 1600. After the door cover 1210 is separated from the front discharge outlet 201, the door cover assembly 1200 may be moved downward by operating the door housing moving module 1700.

When the door cover 1210 is moved downward by the door housing moving module 1700, the front discharge outlet 201 is opened in the forward and rearward direction.

For convenience of description, a state in which the door cover 1210 is moved rearward from the front discharge outlet 201 by the door cover moving module 1600 and the front panel 210 is spaced apart from the door cover 1210 in the forward and rearward direction is referred to as "first front opening".

In the first front opening, the long-distance fan assembly 400 is covered by the door cover 1210 and is not exposed to the user. In the first front opening, air inside a cabinet may be discharged into an indoor space through a gap between the door cover 1210 and the front panel 210.

In the first front opening, the long-distance fan assembly 400 is disposed behind the door cover 1210. In the first front opening, the door cover 1210 is disposed behind the front panel body 212.

A state in which the door cover 1210 is moved downward from the front discharge outlet 201 by the door housing moving module 1700 from behind the front discharge outlet 201 and the front discharge outlet 201 is not covered by the door cover 1210 is referred to as "second front opening".

In the second front opening, the door cover 1210 is disposed below the front discharge outlet 201 and the long-distance fan assembly 400. In the second front opening, the door cover 1210 is disposed behind the front panel body 212.

In the second front opening, the long-distance fan assembly 400 is exposed to the user through the front discharge outlet 201. In the second front opening, the long-distance fan assembly 400 is moved forward to protrude outward from the front discharge outlet 201 and the long-distance fan assembly 400 may discharge air towards an indoor space when the long-distance fan assembly 400 protrudes outward from the front panel 210.

In the second front opening, at least one of the door cover housing 1220 or the door cover 1210 is disposed at a rear side of the display 1500. In the second front opening, even if the door cover 1210 moves downward, the door cover 1210 does not interfere with the display 1500. In the second front opening, the door cover 1210 is spaced apart from the rear surface of the display 1500 by a predetermined distance.

For example, in the first front opening, the door cover 1210 needs to be moved rearward more than a thickness of the front panel 210 to prevent interference between the door cover 1210 and the display 1500 during the second front opening operation.

In this embodiment, in the first front opening, a depth in which the door cover 1210 moves rearward is 13 mm, and in the second front opening, a descending distance of the door cover 1210 is 330 mm.

The door cover 1210 includes an outer door cover 1212 to form a continuous surface with the front panel 210, an inner door cover 1214 coupled to the rear surface of the outer door cover 1212, assembled to the door cover moving module 1600, and moving forward and rearward based on a driving power of the door cover moving module 1600, and a mover 1230 disposed in the inner door cover 1214, protruding rearward from the inner door cover 1214, to receive the driving power from the door cover moving module 1600 through interference with the door cover moving module 1600, and to receive the driving power needed for forward movement or rearward movement of the inner door cover 1214 through the interference.

The mover 1230 is assembled to a cover guide 1640 of the door cover moving module 1600 described below. The mover 1230 interferes with the cover guide 1640 when the cover guide 1640 is rotated and moves the door cover 1210 coupled to the mover 1230 forward or rearward.

The outer door cover 1212 has the same area and shape as the front discharge outlet 201.

The inner door cover 1214 is not limited to the area or the shape of the front discharge outlet 201. In this embodiment, the inner door cover 1214 is wider than the outer door cover 1212.

When the outer door cover 1212 is inserted into the front discharge outlet 201, the inner door cover 1214 contacts an edge of the front discharge outlet 201.

In this embodiment, the front discharge outlet 201 and the outer door cover 1212 have a circular shape with the same diameter and the inner door cover 1214 has a circular shape with a greater diameter than that of the front discharge outlet 201. In particular, the outer edge of the inner door cover 1214 has a vertically flat shape and covers a boundary between the front discharge outlet 201 and the outer door cover 1212.

The outer door cover 1212 may be made of the same material as the front panel 210. The outer door cover 1212 may be made entirely of aluminum metal. The outer door cover 1212 may be coated only with a metal on the front surface. When only the front surface of the outer cover door 1212 is coated with metal, a load of the door cover 1210 may be reduced and operating load of the door cover moving module 1600 and the door housing moving module 1700 may be reduced.

The outer door cover 1212 has the same thickness as the front panel body 212 and the outer door cover 1212 may form a continuous surface with the front surface and the rear surface of the front panel body 212 when the outer door cover 1212 is inserted into the front discharge outlet 201.

The inner door cover 1214 contacts the rear surface of the outer door cover 1212, is coupled to the rear surface of the outer door cover 1212, and has a diameter greater than that of the outer door cover 1212.

A center of the inner door cover 1214 corresponds to a center of the outer door cover 1212.

In this embodiment, the inner door cover 1214 has a circular plate shape. In contrast to this embodiment, the inner door cover 1214 may have a ring shape with a central hole.

The inner door cover 1214 includes a core door cover 1215 disposed at a center thereof and to contact the rear surface of the outer door cover 1212, a border door cover 1216 disposed radially outside of the core door cover 1215 and to contact an outer edge of the outer door cover 1212, a connect door cover 1217 to connect the core door cover 1215 and the border door cover 1216 and spaced apart from the outer door cover 1212 to provide a space 1119, and a connecting rib 1218 to connect the core door cover 1215, the connect door cover 1217, and the border door cover 1216 and protruding from the connect door cover 1217 towards the outer door cover 1212.

The connecting rib 1218 is disposed radially outward from the center of the inner door cover 1214. A plurality of connecting ribs 1218 are disposed and are disposed with the same angle with respect to the center of the inner door cover 1214.

A front surface of the connecting rib 118 may contact the rear surface of the outer door 1212. The rear surface of the connecting rib 1218 is integrated with the connect door cover 1217. An inner surface of the connecting rib 1218 is connected to the core door cover 1215 and the outer surface thereof is connected to the border door cover 116.

The space 1119 is provided among the core door cover 1215, the border door cover 1216, and the plurality of connecting ribs 1218.

A plurality of spaces 1119 are provided radially with respect to the center of the inner door cover 1214 and the plurality of spaces 1119 are provided at an equal angle. Rigidity of the inner door cover 1214 is improved due to the structure of each of the connecting rib 1218 and the space 1119.

The core door cover 1215 has a circular shape when viewed from the front and the border door cover 1216 has a ring shape.

The core door cover 1215 defines a core opening 1211 into which some components of the door cover moving module 1600 are inserted. Some components of the door cover moving module 1600 are inserted into the core opening 1211 to minimize the thickness in the forward and rearward direction of the door cover assembly 1200.

The border door cover 1216 is parallel to the outer door cover 1212. The border door cover 1216 includes a border flange 1213 protruding further outward than an outer edge of the outer door cover 1212.

The outer door cover 1212 and the inner door cover 1214 may be integrated with each other. In this case, the border flange 1213 is disposed at the outer edge of the door cover 1210.

The border flange 1213 is disposed at the rear side than the inner door cover 1214. The border flange 1213 protrudes radially outward than the inner door cover 1214.

In this embodiment, the border flange 1213 is disposed along the outer edge of the outer door cover 1214 and has a circular shape.

When the door cover 1210 is inserted into the front discharge outlet 201 of the front panel 210, the border flange 1213 contacts the rear surface of the front panel 210 and contacts the boundary between the front discharge outlet 201 and the outer door cover 1212.

The border flange 1213 has a ring shape when viewed from the front. A gasket (not shown) may be disposed on the border flange 1213. The gasket may contact the boundary between the front discharge outlet 201 and the outer door cover 1212.

When the door cover 1210 contacts the front panel 210, the gasket may reduce connection noise and close the boundary between the front discharge outlet 201 and the outer door cover 1212.

When the long-distance fan assembly 400 is not operated and only the short-distance fan assembly is operated, if cold air leaks through the boundary, dew formation may occur at the boundary.

A groove 1213*a* may be concaved from a front surface to the rear of the border flange 1213. The groove 1213*a* has a ring shape when viewed from the front. The gasket may be inserted into the groove 1213*a*.

The thickness of the door cover assembly 1200 occupies most of the thickness of the door assembly 200. Therefore, minimizing the thickness in the forward and rearward direction of the door assembly 200 is an important factor to minimize the thickness of the door assembly 200. When the thickness of the door assembly 200 is minimized, the operating load of the door slide module 1300 may be minimized.

The core opening 1211 passes through the outer door cover 1214 in the forward and rearward direction. A motor of the door cover moving module 1600 described below is inserted into the core opening 1211.

The mover 1230 is disposed on the inner door cover 1214. The mover 1230 may be integrated with the inner door cover 1214.

In this embodiment, the mover 1230 is separately manufactured and then assembled to the inner door cover 1214. Therefore, the mover 1230 has an assembly structure to be assembled to the inner door cover 1214.

The mover 1230 includes the mover body 1232 protruding to the rear side from the inner door cover 1214 and a mover guide 1234 protruding inward or outward from the mover body 1232 and inserted into a guide way 1650 of the cover guide 1640 described below.

The mover body 1232 has a ring shape when viewed from the front.

A mover fastener 1236 fastened to the inner door cover 1214 is disposed on the mover body 1232. The mover fastener 1236 protrudes inward from the mover body 1232. A protruding direction of the mover fastener 1236 is opposite to a protruding direction of the mover guide 1234.

The inner door cover 1214 includes a fastener 1214*a* corresponding to the mover fastener 1236. The fastener 1214*a* protrudes through the core opening 1211. The fastener 1214*a* is inserted into the mover body 1232.

A mover body supporter 1233 is disposed on an inner circumferential surface of the mover body 1232 to support the rear end of the core door cover 1215.

The mover body 1232 and the mover guide 1234 are integrated with each other. The mover body 1232 protrudes rearward from the door cover 1210. The mover body 1232 extends to a length such that the mover body 1232 interferes with the cover guide 1640 described below.

In this embodiment, the mover guide 1234 is orthogonal to the mover body 1232. The mover guide 1234 may be disposed in a direction parallel to the front panel body 212.

The protruding direction of the mover guide 1234 may vary depending on the coupling with the cover guide 1640. In this embodiment, as the mover body 1232 is inserted into the cover guide 1640, the mover guide 1234 protrudes outward from the mover body 1232. In contrast to this embodiment, when the mover body 1232 is disposed outside the cover guide 1640, the guide protrusion protrudes inward from the mover body 1232.

The mover guide 1234 is assembled to the guide way 1650 of the cover guide 1640 described below and may be moved forward or rearward along the guide way 1650 when the cover guide 1640 is rotated.

Meanwhile, the door cover housing 1220 is vertically moved along the upper panel 1110.

The door cover housing 1220 includes a door cover housing body 1222 that vertically moves along the upper panel 1110, a door cover accommodator 1223 disposed in the door cover housing body 1222, to define an opening open forward and selectively accommodating the door housing cover 1222, and a moving module installation portion 1224 disposed in the door cover housing body 1222 and to define an opening open forward, communicate with the door cover accommodator 1223, disposed at a rear side thereof than the door cover accommodator 1223, and in which the door cover moving module 1600 is disposed.

The door cover housing 1220 is disposed within an inner distance (I) of the front panel 210. The left side and the right side of the door cover housing 1220 are disposed within the inner distance (I) and most of them are exposed through the opening having the open distance (D).

The left side and the right side of the door cover housing 1220 are disposed at the front sides of the front panel ends 215 and 217 and the front panel ends 215 and 217 are engaged with respect to the forward and rearward direction of the door cover housing 1220 and block the door cover housing 1220 from being separated rearward. The door cover housing 1220 may slide vertically and limit the forward movement and the rearward movement thereof.

The door cover housing body 1222 may be moved vertically within the inner distance (I) on each of the left side and the right side of the front panel 210. The door cover housing body 1222 is moved vertically by the door housing moving module 1700.

The thickness in the forward and rearward direction of the door cover housing body 1222 in less than the inner distance (I).

When the door cover moving module 1600 is operated, the door cover 1210 is moved rearward and may be accommodated in the door cover accommodator 1223. When the front discharge outlet 201 is closed, the door cover 1210 is disposed in front of the door cover housing 1220 and is flush with the front panel 210.

The door cover accommodator 1223 defines an opening at a front side thereof to accommodate the door cover 1210 and has a circular shape when viewed from the front. The door cover accommodator 1223 is concaved rearward from the door cover housing 1222.

The upper surface 1222*a* of the door cover housing body 1222 has a curved surface and surrounds the edge of the door cover 1210. The door cover 1210 may be disposed below the upper surface 1222*a*. The door cover accommodator 1223 is disposed under the upper surface 1222*a*.

A center of curvature of the upper surface 1222*a* may be identical to a center of curvature of the door cover 1210. The upper surface 1222*a* is disposed radially outside the door cover 1210.

In addition, a door cover top wall 1114 is disposed on the upper panel body 1130 to interfere with the door cover housing 1220 and restrict movement of the door cover assembly 1200.

The door cover top wall 1114 protrudes rearward from the upper panel body 1130.

The door cover top wall 1114 may have a shape corresponding to an upper surface of the door cover housing 1220. In this embodiment, as the upper surface of the door cover housing 1220 has an arc shape when viewed from the front, the door cover top wall 1114 has an arc shape having a greater diameter than that of the door cover housing 1220.

The door cover top wall 1114 surrounds the entire upper surface of the door cover housing 1220. The door cover housing 1220 may contact the lower surface of the door cover top wall 1114 to prevent leakage of air inside the cabinet.

The door cover top wall 1114 may have the same center of curvature as the panel discharge outlet 1101. The door cover top wall 1114 has a greater radius of curvature than that of the panel discharge outlet 1101.

The door cover top wall 1114 may block the inside air of the cabinet from flowing towards the camera module 1900. When cold air of the cabinet assembly 100 is directly supplied to the camera module 1900, dew formation may occur on the camera module 1900.

The door cover top wall 1114 is preferably disposed above the panel discharge outlet 1101 to limit the upward movement of the door cover assembly 1200.

When the door cover assembly 1200 is moved upward and the upper surface 1222*a* contacts the door cover top wall 1114, the door cover 1210, the panel discharge outlet 1101, and the front discharge outlet 201 are disposed in a row in the forward and rearward direction. When the door cover assembly 1200 is not moved upward to a right position, the door cover 1210 is engaged with the upper panel body 1130 and may not be moved to the front discharge outlet 201.

Each of the side surface and the side surface 1222*b* of the door cover housing body 1222 corresponds to each of the front panel ends 215 and 217 of the front panel 210. The side surface 1222*b* is disposed within the inner distance (I) of the front panel 210 and may be vertically moved within the inner distance (I).

The moving module installation portion 1224 is concaved to the rear side from the door cover housing body 1222. The moving module installation portion 1224 communicates with the door cover accommodator 1223 and is disposed at a rear side thereof than the door cover accommodator 1223.

The moving module installation portion 1224 defines an opening at a front side thereof and has a circular shape when viewed from the front. The moving module installation portion 1224 has an area less than the area of the door cover 1210 and is disposed at the rear side of the door cover 1210. The thickness in the forward and rearward direction of the moving module installation portion 1224 is less than the thickness of the door cover housing 1220.

In this embodiment, the moving module installation portion 1224 has a circular shape when viewed from the front. The moving module installation portion 1224 is concentric with the door cover 1210.

In addition, most of the components of the door cover moving module 1600 are disposed in the moving module installation portion 1224.

<<Configuration of Door Cover Moving Module>>

The door cover moving module 1600 moves the door cover 1210 in a forward and rearward direction. The door cover moving module 1600 implements first front opening.

The door cover 1210 may be moved in the forward and rearward direction through various methods. For example, the door cover 1210 is connected to an actuator such as a hydraulic cylinder, and may be moved in the forward and rearward direction through movement of a piston of the hydraulic cylinder. For example, the door cover 1210 may be moved in the forward and rearward direction through a motor and a multi-joint link structure.

As a link structure and the hydraulic cylinder structure may include a structure to be moved or rotated forward of the cabinet assembly 100, the thickness in the forward and rearward direction of the door assembly 200 may be increased.

In this embodiment, the door cover moving module 1600 changes the rotational force of the door cover motor through interference to move the door cover 1210 in the forward and rearward direction.

The thickness in the forward and rearward direction of the door assembly 200 may be minimized due to the structure of the door cover moving module 1600.

The door cover moving module 1600 includes a door cover motor 1610 disposed at the rear side of the door cover 1210, disposed on the door cover housing 1220, and in which a door cover motor shaft 1611 is disposed in the forward and rearward direction, a sun gear 1620 coupled to the door cover motor shaft and rotated based on the operation of the door cover motor, a plurality of planetary gears 1630 rotatably assembled to the door cover housing 1220, engaged with the sun gear 1620, and disposed radially outside the sun gear 1620, and a cover guide 1640 disposed between the door cover housing 1220 and the door cover 1210, in which the plurality of planetary gears 1630 are disposed, engaged with the plurality of planetary gears 1630, rotated clockwise or counterclockwise when the planetary gears 1630 rotate, and to move the door cover 1210 forward or rearward through the interference with the door cover 1210.

The sun gear 1620 is a pinion gear and includes teeth on an outer surface thereof along a circumferential direction thereof.

The planetary gear 1630 is a pinion gear and includes teeth on an outer surface thereof along a circumferential direction. In this embodiment, three planetary gears 1630 are disposed. The three planetary gears 1630 are engaged with the outer surface of the sun gear 1620 and are rotated simultaneously when the sun gear 1620 is rotated.

The plurality of planetary gears 1630 and the sun gear 1620 are inserted into the moving module installation portion 1224 of the door cover housing 1220. The moving module installation portion 1224 includes a sun gear installation portion 1225 in which the sun gear 1620 is disposed and planetary gear installation portions 1226 in which the planetary gears 1630 are disposed.

A rotary shaft of the sun gear 1620 may be inserted into the sun gear installation portion 1225 and the sun gear 1620 may rotate when the sun gear 1620 is assembled to the sun gear installation portion 1225.

The door cover motor 1610 is disposed in front of the sun gear 1620. The door cover motor 1610 is disposed inside the moving module installation portion 1224.

The door cover motor shaft 1611 of the door cover motor 1610 faces the rear side from the front side and is coupled to the sun gear 1620 disposed at the rear of the door cover motor 1610.

A motor housing 1660 is further disposed to couple the door cover motor 1610 to the door cover housing 1220. When the door cover motor 1610 is disposed on the rear surface of the door cover housing 1220, the door cover motor 1610 may be directly coupled to the door cover housing 1220.

As the structure increases the thickness in the forward and rearward direction of the door cover assembly 1200, in this embodiment, the door cover motor 1610 is disposed inside the door cover housing 1220 and the motor housing 1660 is disposed to couple the door cover motor 1610.

The motor housing 1660 may be assembled to the door cover housing 1220. In this embodiment, the motor housing 1660 is inserted into the moving module installation portion 1224 when the motor housing 1660 is assembled to the door cover motor 1610. In this the structure, the thickness in the forward and rearward direction of the door cover assembly 1200 may be minimized.

The motor housing 1660 is disposed inside the cover guide 1640 and the cover guide 1640 surrounds the outer portion of the motor housing 1660.

When viewed from the front, the motor housing 1660 is disposed between the door cover motor 1610 and the cover guide 1640. When viewed in the forward and rearward direction, the motor housing 1660 is disposed between the door cover housing 1220 and the door cover 1210.

When the door cover motor 1610 and the motor housing 1660 are assembled, the door cover motor 1610 penetrates the motor housing 1660 to minimize the length in the forward and rearward direction thereof.

To this end, the motor housing 1660 defines a motor penetrating portion 1662 through which the door cover motor 1610 passes. The motor penetrating portion 1662 is disposed in the forward and rearward direction. The motor penetrating portion 1662 is disposed at a rear side of the core opening 1211 of the inner door cover 1214. When the door cover motor 1610 is assembled to the motor housing 1660, the door cover motor 1610 is inserted into the corner opening 1211 through the motor penetrating portion 1662.

The door cover motor 1610 is inserted into the structure of the door cover 1210 moving in the forward and rearward direction in addition to the motor housing 1660 to which the door cove motor 1610 is assembled to minimize the thickness in the forward and rearward direction of the door assembly 200.

When viewed in the forward and rearward direction, the cover guide 1640 is disposed between the door cover housing 1220 and the door cover 1210. When viewed from the front, the cover guide 1640 has a ring shape and defines an opening opened in the forward and rearward direction.

The cover guide 1640 may receive a rotational force from the planetary gear 1630 and may rotate based on the rotational force. The cover guide 1640 may be rotated clockwise or counterclockwise when viewed from the front.

The cover guide 1640 and the door cover 1210 are assembled to be movable relative to each other and the cover guide 1640 moves the door cover 1210 forward or rearward through interference when the cover guide 1640 rotates.

The cover guide 1640 includes a cover guide body 1640 having a ring shape, a guide gear 1642 disposed along the inner circumferential surface of the cover guide body 1640 and engaged with the plurality of planetary gears 1630, and a guide way 1650 disposed along the circumferential direction of the cover guide body 1640, movably assembled to the cover interference portion 1230 (e.g., in this embodiment, the mover guider 1234) and to move the door cover 1210 forward or rearward through the interference with the mover guide 1230 when the cover guide 1640 is rotated clockwise or counterclockwise.

When the cover guide 1640 is rotated clockwise or counterclockwise by the operation of the planetary gear 1630, the mover 1230 of the door cover 1210 interferes with the cover guide 1640. When the mover 1230 interferes with the cover guide 1640, the mover guide 1234 does not rotate, but the cover guide 1640 rotates to move the mover 1230 (e.g., the mover guide 1234) along the guide way 1650.

The guide gear 1642 is a ring gear. The guide gear 1642 is disposed on the inner circumferential surface of the cover guide body 1640.

In this embodiment, the guide way 1650 penetrates the cover guide body 1642. In contrast to this embodiment, the guide way 1650 may have a groove shape. In this embodiment, the guide way 1650 penetrates an inner portion and an outer portion of the cover guide 1640 to minimize the thickness of the cover guide 1640. In this embodiment, the mover guide 1234 is inserted into the guide way 1650.

In this embodiment, a penetration direction of the guide way 1650 is parallel to the front surface of the front panel 210. The coupling direction of the guide way 1650 and the mover guide 1234 intersects with the forward and rearward direction.

The guide way 1650 is disposed in the forward and rearward direction. The mover guide 1234 interferes with the guide way 1650 and the mover guide 1234 is moved in the forward and rearward direction through the interference.

The guide way 1650 extends long in the circumferential direction of the cover guide body 1642 and forms a gentle curve from the rear side to the front side of the cover guide body 1642. The door cover 1210 may be moved forward or rearward by the length in the forward and rearward direction of the guide way 1650.

The plurality of guide ways 1650 are disposed and three guide ways are disposed in this embodiment. The three guide ways 1650 are preferably disposed at equal distances with respect to a center of the cover guide 1640.

When the cover guide 1640 is rotated clockwise or counterclockwise, the guide way 1650 interferes with the mover guide 1234.

As the guide way 1650 is disposed in the forward and rearward direction along the circumferential direction of the cover guide 1640, when the cover guide 1640 is rotated, the mover guide 1234 does not rotate, but the mover guide 1234 moves forward or rearward along the guide way 1650.

An axis center of the cover guide 1640 is identical to an axis center of the sun gear 1620. The cover guide 1640 is inserted into the moving module installation portion 1224 and is rotated inside the moving module installation portion 1224.

The guide gear 1642 is disposed along the inner circumferential surface of the cover guide body 1642 and has a circular shape. The guide gear 1642 includes teeth to face the axis center of the cover guide 1640.

The door cover motor 1610, the plurality of planetary gears 1630, and the sun gear 1620 are disposed inside the cover guide 1640 to minimize the thickness in the forward and rearward direction of the door cover moving module 1600 through the structure.

<<Configuration of Door Housing Moving Module>>

The door housing moving module 1700 vertically moves a door cover assembly 1200 and sets a front discharge outlet 201 defined in the front panel 210 to be a second front opening state.

In this embodiment, the door housing moving modules 1700 are disposed on the left side and the right side of the door cover housing 1220. In contrast to this embodiment, only one door housing moving module 1700 may be disposed.

In this embodiment, as the door housing moving module 1700 also functions to fix a vertical position of the door cover assembly 1200, two door housing moving modules 1700 are disposed to distribute supporting load of the door cover assembly 1200.

The door housing moving module 1700 may vertically move the door cover assembly 1200 along the front panel 210. In particular, the door housing moving module 1700 may vertically move the entire door cover housing 1220 to which the door cover 1210 is coupled.

The door cover assembly 1200 is moved along the side surface having the inner distance (I) of the front panel 210. As the door housing moving module 1700 is disposed inside the front panel 210, an installation space of the door housing moving module 1700 is preferably disposed within the inner distance (I).

In this embodiment, the door housing moving module 1700 provides a structure to be disposed within the thickness of the front panel 210. In this embodiment, the thickness in the forward and rearward direction of the door housing moving module 1700 is less than or equal to the thickness of the front panel 210.

The door cover housing 1220 may be moved below the front discharge outlet 201 by the door housing moving module 1700. Therefore, the front discharge outlet 201 may implement the second front opening.

The door cover 1210 disposed on a movement path of the long-distance fan assembly 400 facing the front discharge outlet 201 may be moved below the front discharge outlet 201 based on the operation of the door housing moving module 1700.

When the door cover 1210 is vertically moved downward, any portion of the door cover 1210 does not overlap with the front discharge outlet 201. The door housing moving module 1700 moves the door cover housing 1220 out of the movement path of the long-distance fan assembly 400.

In the second front opening, the discharge grill 450 may be exposed through the front discharge outlet 201.

The door housing moving module 1700 includes a left door housing moving module disposed on the left side of the door cover housing and a right door housing moving module disposed on the right side of the door cover housing.

The left door housing moving module and the right door housing moving module have the same configuration and are symmetrical to each other.

The door housing moving module 1700 includes a rack 1710 disposed in the front panel 210 or the panel module 1100 and longitudinally extends vertically, a gear assembly 1730 disposed in the door cover assembly 1700, engaged with the rack 1710, and moving along the rack 1710 during rotation, a gear drive motor 1720 disposed in the door cover assembly 1200 and to provide a driving power to the gear assembly 1730, and a vertical moving rail 1790 disposed in the door cover assembly 1200 and the rack 1710 and to guide movement of the door cover assembly 1200.

The door housing moving module 1700 may further include a gear housing 1780 in which the gear assembly 1730 and a gear drive motor 1720 are disposed. When the gear housing 1780 is not disposed, the gear assembly 1730 and the gear drive motor 1720 are each directly disposed in the door cover housing 1220.

In this embodiment, to facilitate assembly and repair, after assembling each of the gear assembly 1730 and the gear drive motor 1720 to the gear housing 1780, the gear housing 1780 is assembled to the door cover housing 1220.

The rack 1710 extends long in the vertical direction of the front panel 210. The rack 1710 is disposed in a space having the inner distance (I) of the front panel 210.

The rack 1710 may be disposed in at least one of the front panel 210 or the panel module 1100. In this embodiment, as the front panel 210 is made of metal, when the rack 1710 is directly disposed, a hole penetrating the front panel 210 made of metal needs to be provided. In this case, cold air may leak through the hole or external foreign matters may flow into the front panel 210.

In this embodiment, the rack 1710 is disposed in the panel module 1100 rather than the front panel 210 to prevent the above configuration. In this embodiment, the rack 1710 is assembled to the upper panel module 1110. The rack 1710 is disposed at a portion inserted into the inner distance (I) of the upper panel module 1110.

The rack 1710 faces the front panel sides 214 and 216.

In this embodiment, two racks 1710 are disposed, and a first rack 1710 is disposed within the inner distance (I) on the left side of the front panel 210 and a second rack 1710 is disposed within the inner distance (I) on the right side of the front panel 210. When a plurality of racks 1710 need to be distinguished, a rack disposed on the left side thereof is referred to as "a left rack" and a rack disposed on the right side thereof is referred to as "a right rack" when viewed from the front of the front panel 210. The left rack and the right rack are symmetrical with each other.

<Rack Configuration and Rack Installation Structure>

The rack 1710 includes a rack body 1712 longitudinally extending vertically and a rack teeth 1711 disposed in the rack body 1712, disposed within an inner distance (I) at a first side of the front panel 210 (e.g., in this embodiment, a second front panel side), facing a second side of the front panel (e.g., in this embodiment, a first front panel side), and provided in plurality and disposed in a longitudinal direction of the rack body 1712.

The rack teeth 1711 protrudes from the rack body 1712 toward the opposite front panel side. The rack teeth 1711 may be separately manufactured and assembled to the rack body 1712. In this embodiment, the rack teeth 1711 and the rack body 1712 are integrated with each other.

The rack teeth 1711 includes horizontal teeth. A plurality of rack teeth 1711 are vertically disposed. The gear assembly is engaged with the rack teeth 1711 and may be moved vertically along the rack teeth 1711.

The rack 1710 includes a rack contact portion 1713 disposed in the rack body 1712 and to contact the front panel end 217, a rack engaging portion 1714 disposed in the rack body 1712, assembled to the upper panel module 1110, and engaged with the upper panel module 1110, and a rail installation portion 1719 disposed in the rack body 1712 and in which a vertical moving rail 1790 is disposed.

In this embodiment, the rack teeth 1711, the rack body 1712, the rack contact portion 1713, the rack engaging portion 1714, and the rail installation portion 1719 are integrated with one another through injection molding. In contrast to this embodiment, some of the rack teeth 1711, the rack body 1712, the rack contact portion 1713, the rack engaging portion 1714, or the rail installation portion 1719 are separately manufactured and then assembled.

The rack contact portion 1713 is disposed in the space having the inner distance (I) of the front panel 210 and contacts the inner surface of the front panel end 217. A fastening member fastens through each of the front panel end 217 and the rack contact portion 1713 to couple to the rack 1710.

The rack contact portion 1713 intersects with the rack body 1712 and is orthogonal to the rack body 1712 in this embodiment. The rack contact portion 1713 faces the front surface of the front panel 210 and the rack body 1712 is disposed in a forward and rearward direction.

The rail installation portion 1719 is disposed in the rack body 1712 and has a concaved groove shape. The rail installation portion 1719 is concaved towards the front panel side 216 from the rack body 1712. The rail installation portion 1719 is opened towards the opposite front panel side 215.

The rail installation portion 1719 extends long along the longitudinal direction of the rack 1710. In this embodiment, the rail installation portion 1719 is vertically disposed.

The vertical moving rail 1790 is inserted into the rail installation portion 1719. The vertical moving rail 1790 may be disposed within a horizontal width of the rack contact portion 1713.

The vertical moving rail 1790 is disposed in the concave rail installation portion 1719 to minimize the installation space of the rack 1710 and the vertical moving rail 1790.

As the rail installation portion 1719 is concaved from the rack body 1712 towards the second front panel side 216, the vertical moving rail 1790 may be disposed within the inner distance (I).

In this embodiment, the rail mounting portion 1719 has a "□" shape and is opened towards the opposite front panel side. The vertical moving rail 1790 is inserted into the opening.

The rail installation portion 1719 includes a first rail installation wall 1719*a* connected to the rack body 1712, a second rail installation wall 1719*b* intersecting with the first rail installation wall 1719*a*, disposed in a forward and rearward direction, and to couple to the vertical moving module 1790, and a third rail installation wall 1719*c* intersecting with the second rail installation wall 1719*b* and to face the first rail installation wall 1719*a*.

The rail installation portion 1719 defines a rail installation space 1719*d* surrounded by the first rail installation wall 1719*a*, the second rail installation wall 1719*b*, and the third rail installation wall 1719*c*. The rail installation space 1719*d* is opened towards the opposite front panel side.

The first rail installation wall 1719*a* is horizontally disposed and faces the rack contact portion 1713. The second rail installation wall 1719*b* is disposed in the forward and rearward direction and faces the front panel sides 216 and 217. In this embodiment, the first rail installation wall 1719*a* and the second rail installation wall 1719*b* are orthogonal to each other.

A rack space 1710*a* may be provided between the rack contact portion 1713, the first rail installation wall 1719*a*, and the second rail installation wall 1719*b*. As the rack 1710 integrates the rack contact portion 1713, the first rail installation wall 1719*a*, the second rail installation wall 1719*b*, the third rail installation wall 1719*c*, and the rack engaging portion 1714 through injection molding, the components may preferably have similar thickness.

The rack space 1710*a* is opened towards the front panel sides 216 and 217.

An opening direction of the rack space 1710*a* is opposite to an opening direction of the rail installation space 1719*d*. The opening direction of the rail installation space 1719*d* is the same as the protruding direction of the rack teeth 1711.

The rack space 1710*a* is opened towards the disposed front panel side 216 and the rail installation space 1719*d* is opened towards the opposite front panel side 217, which is not disposed.

The rack engaging portion 1714 protrudes from the rail installation portion 1719 towards the upper panel module 1110. The rack engaging portion 1714 is inserted into the rear surface of the upper panel module 1110 and suppresses the horizontal movement of the rack 1710.

The rack engaging portion 1714 includes a first rack engaging portion 1714*a* protruding forward from the third rail mounting wall 1719*c* and a second rack engaging portion 1714*b* protruding in the horizontal direction from the first rack engaging portion 1714*b*.

The first rack engaging portion 1714*a* and the second rack engaging portion 1714*b* are crossed, and in this embodiment, the first rack engaging portion 1714*a* and the second rack engaging portion 1714*b* are bent and have a "⌈" shape.

The second rack engaging portion 1714*b* may be assembled to the upper panel module 1110 by stationary fitting.

The upper panel module 1110 provides a structure capable of accommodating the rack 1710.

The upper panel module 1110 includes an upper panel body 1130 disposed on the rear surface of the front panel 210 and a panel discharge outlet 1101 penetrating the upper panel body 1130 in the forward and rearward direction, disposed at a rear side of the front discharge outlet 201, and communicating with the front discharge outlet 201.

The upper panel body 1130 includes an upper panel front 1132 disposed on the rear surface of the front panel 210 and to define the panel discharge outlet 1101 and an upper panel side 1134 connecting to the upper panel front 1132 and disposed at an inner side of the front panel 210.

The upper panel front 1132 is disposed between the door cover housing 1220 and the front panel 210.

The upper panel side 1134 is disposed between the rack 1170 and the side surface of the front panel 210 (e.g., in this embodiment, the front panel side). The upper panel side 1134 supports the rack 1170 and may be assembled to the rack 1170.

The upper panel side 1134 may be disposed on at least one of the first front panel side 214 or the second front panel side 216 of the front panel 210.

The upper panel front 1132 and the upper panel side 1134 may be separately manufactured and assembled to each other. In this embodiment, the upper panel front 1132 and the upper panel side 1134 are integrated with each other through injection molding.

The upper panel body 1130 includes a panel front supporter 1135 disposed in the upper panel front 1132, contacting the rear surface of the front panel body 212, and to support the rear surface of the front panel body 212, a panel front coupler 1136 disposed on the upper panel front 1132 and coupled to a gasket 205 disposed in the panel discharge outlet 1101, and a panel front insert 1137 disposed on the upper panel front 1132 and assembled to the rack 1710 to be engaged with the rack 1710.

The upper panel body 1130 includes a first panel side supporter 1138 disposed in the upper panel side 1134, contacting the front panel sides 214 and 216 of the front panel 210 to support the front panel side of the front panel 210 and a second panel side supporter 1139 disposed in the upper panel side 1134 and to support the front panel ends 215 and 217 of the front panel 210.

The upper panel body 1130 has a flat plate shape and is curved in the forward and rearward direction.

The panel front coupler 1136 defines an edge of the panel discharge outlet 1101. The panel front coupler 1136 protrudes from the upper panel body 1130 and may protrude towards the panel discharge outlet 1101 in this embodiment.

The panel front supporter 1135 protrudes forward from the upper panel body 1130 and contacts the rear surface of the front panel 210.

The panel front insert 1137 protrudes forward from the upper panel body 1130 and may contact the rear surface of the front panel 210.

The panel front insert 1137 protrudes forward from the upper panel body 1130 to provide a space into which the rack engaging portion 1714 is inserted, at a rear side thereof.

The upper panel body 1130 supports at least two places in the horizontal direction of the front panel 210. In this embodiment, the upper panel body 1130 also provides a function for supporting the front panel 210 by the panel front insert 1137.

The panel front supporter 1135 is disposed closer to the panel discharge outlet 1101 than the panel front insert 1137. The panel front insert 1137 may be disposed within the inner distance (I) of the front panel 210.

The panel front supporter 1135 and the panel front insert 1137 each protrude forward from the upper panel front 1132 and a space is provided among the panel front supporter 1135, the panel front insert 1137, and the upper panel front 1132. The space is provided between the upper panel front 1132 and the rear surface of the front panel 210.

The upper panel side 1134 may face the inner surface of each of the front panel sides 214 and 126.

The first panel side supporter 1138 protrudes from the upper panel side 1134 towards the front panel side and supports an inner surface of the front panel side.

The second panel side supporter 1139 protrudes from the upper panel side 1134 towards the front panel end and supports an inner surface of the front panel end.

In this embodiment, the upper panel body 1130 supports the front panel 210 by using the panel front supporter 1135, the panel front insert 1137, the first panel side supporter 1138, and the second panel side supporter 1139 and minimizes a contact area between the upper panel body 1130 and the front panel 210.

<Configuration of Vertical Moving Rail>

The vertical moving rail 1790 is disposed in a rail installation space 1719*d* surrounded by a first rail installation wall 1719*a*, a second rail installation wall 1719*b*, and a third rail installation wall 1719*c*.

The vertical moving rail 1790 guides vertical movement of the door cover assembly 1200. In particular, the vertical moving rail 1790 is assembled to a door cover housing 1220 and guides the vertical movement of the door cover housing 1220.

The vertical moving rail 1790 is disposed between a rack 1710 and the door cover housing 1220. More specifically, the vertical moving rail 1790 is disposed between the rail installation portion 1719 and the door cover housing 1220.

The vertical moving rails 1790 are disposed on the left side and the right side of the door cover assembly 1200. The vertical moving rail 1790 is disposed outside the side surface of the door cover housing 1220. The vertical moving rail 1790 may be disposed on the side surfaces of the door cover assembly 1200 to minimize the thickness in the forward and rearward direction of the door assembly 200.

The vertical moving rail 1790 includes a first rail 1792 disposed in a rack 1710 and a second rail 1794 disposed in the door cover housing 1220.

The first rail 1792 is disposed in the rail installation portion 1719 and is accommodated in the rail installation space 1719*d*. As the first rail 1792 is accommodated in the rail installation space 1719*d*, the first rail 1792 does not protrude out of the rack 1710.

The second rail 1794 is assembled to the first rail 1792 and moves vertically along the first rail 1792. A plurality of bearings are disposed between the first rail 1792 and the second rail 1794 and the bearings reduce friction between the first rail 1792 and the second rail 1794.

A portion of the second rail 1794 may be inserted into the rail installation space 1719*d* to be assembled to the first rail 1792.

In this embodiment, the second rail 1794 does not protrude out of the rack teeth 1711 in the horizontal direction and is covered by the rack teeth 1711 when viewed from the rear.

The second rail 1794 is assembled to a side surface of the door cover housing 1220. The first rail 1792 and the second rail 1794 are relatively movable in the vertical direction.

When the door cover assembly 1200 is vertically moved, the first rail 1792 and the second rail 1794 each guide the vertical movement of the door cover assembly 1200 and reduce friction.

<Configuration of Gear Assembly and Gear Drive Motor>

A height of the door cover assembly 1200 is adjusted by the engagement of the gear assembly 1730 with a rack 1710. A vertical height of the door cover assembly 1200 is maintained by the engagement of the gear assembly 1730 with the rack 1710.

In this embodiment, an additional component to maintain the height of the door cover assembly 1200 is not included.

The gear assembly 1730 transmits a driving force of the gear drive motor 1720 to the rack 1710 and supports load of the door cover assembly 1200. In this embodiment, the gear assembly 1720 provides a structure to effectively support the load of the door cover assembly 1200.

The gear assembly 1730 includes a first gear 1740 disposed in the door cover assembly 1200, including a first teeth 1741 on an outer circumferential surface thereof, engaged with the rack 1710 through the first teeth 1741, and vertically movable when the first gear 1740 is engaged with the rack 1710, a second gear 1750 disposed in the door cover assembly 1200, including a 2-1 teeth 1751 and a 2-2 teeth 1752 having different radii of curvature, and engaged with the first teeth 1741 of the first gear 1740 through the 2-1 teeth 1175, a third gear 1760 disposed in the door cover assembly 1220, including a 3-1 teeth 1761 and a 3-2 teeth 1762 that are different from each other, and engaged with the 2-2 teeth 1752 of the second gear 1750 through the 3-1 teeth 1761, and a worm gear 1770 disposed in the door cover assembly 1200, engaged with the 3-2 teeth 1762, connected to the gear drive motor 1720 and rotated, and vertically disposed.

A motor shaft 1721 of the gear drive motor 1720 is vertically disposed.

In this embodiment, the motor shaft 1721 of the gear drive motor 1720 penetrates the worm gear 1770. An axis center of the worm gear 1770 is disposed on the same line as the motor shaft 1721.

The first gear 1740 is engaged with each of the rack 1710 and the second gear 1750.

The second gear 1750 is engaged with each of the first gear 1740 and the third gear 1760.

The third gear 1760 is engaged with each of the second gear 1750 and the worm gear 1770.

The first gear 1740, the second gear 1750, and the third gear 1760 each include a pinion gear teeth. The rotary axis of each of the first gear 1740, the second gear 1750, and the third gear 1760 is disposed in the forward and rearward direction.

The first teeth 1741 have a circular shape when viewed from the front or the rear.

A position at which the first teeth 1741 and the rack teeth 1711 are engaged with each other is different from a position at which the first teeth 1741 and the 2-1 teeth 1751 are engaged with each other.

The first teeth 1741, the rack teeth 1711 of the rack 1710, and the 2-1 teeth 1751 have the same size and shape.

The first teeth 1741, the rack teeth 1711 of the rack 1710, and the 2-1 teeth 1751 include the same pinion gear teeth.

The second gear 1750 and the third gear 1760 each include a rotational axis in the forward and rearward direction and include the pinion gear teeth.

The second gear 1750 and the third gear 1760 each include two different teeth, while the first gear 1740 includes one teeth.

Specifically, the second gear 1750 includes a 2-1 teeth 1751 and a 2-2 teeth 1752 and the 2-1 teeth 1751 and the 2-2 teeth 1752 are each disposed in a rotational axis direction (e.g., in this embodiment, the forward and rearward direction) of the second gear 1750. The 2-1 teeth 1751 and the 2-2 teeth 1752 are each disposed in the forward and rearward direction.

In the second gear 1750, the 2-1 teeth 1751 and the 2-2 teeth 1752 are include different teeth. The 2-1 teeth 1751 and the 2-2 teeth 1752 each include the pinion gear teeth.

When viewed from the front, the 2-1 teeth 1751 and the 2-2 teeth 1752 each have a circular shape having different diameters.

One of the 2-1 teeth 1751 and the 2-2 teeth 1752 may be disposed at a front side thereof and the other one thereof may be disposed at a rear side thereof. In this embodiment, the 2-1 teeth 1751 is disposed on the rear side thereof than the 2-2 teeth 1752. The 2-1 teeth 1751 is flush with the first teeth 1741 and the 3-2 teeth 1762.

In addition, as the second gear 1750 maintains an engaged state with the first gear 1740 and the third gear 1760, the teeth same as the second gear 1750 is also disposed in the first gear 1740 and the third gear 1760. The 2-2 teeth 1352, the first teeth 1341, and the 3-1 teeth 1361 have the same standard.

In this embodiment, in the second gear 1750, the 2-2 teeth 1752 has a greater diameter than that of the 2-1 teeth 1751. The 2-1 teeth 1751 has the different diameter from that of the 2-2 teeth 1752 to provide an engagement structure to simultaneously engage with the first gear 1740 and the third gear 1760.

When the first gear 1740 and the second gear 1750 are engaged, the first gear 1740 is disposed at the rear side thereof than the 2-2 teeth 1752 because the 2-1 teeth 1751 is disposed at the rear side thereof than the 2-2 teeth 1572.

In contrast to this embodiment, the arrangement in the forward and rearward direction of the 2-1 teeth 1751 and the 2-2 teeth 1752 may be reversed.

In the second gear 1750, the 2-1 teeth 1751 and the 2-2 teeth 1752 have different teeth. The 2-1 teeth 1751 and the 2-2 teeth 1752 are pinion gear teeth.

The third gear 1760 includes the 3-1 teeth 1761 and the 3-2 teeth 1762. At least one of the 3-1 teeth 1761 or the 3-2 teeth 1762 is engaged with the worm gear 1770.

In this embodiment, the 3-1 teeth 1761 and the 3-2 teeth 1762 have different diameters. The 3-2 teeth 1762 engaged with the worm gear 1770 may have the diameter greater than that of the 3-1 teeth 1761.

As the 3-2 teeth 1762 is engaged with the worm gear teeth 1771, when the 3-2 teeth 1762 has the diameter less than that of the 3-1 teeth 1761, the worm gear teeth 1771 may interfere with the 3-1 teeth 1761. The 3-2 teeth 1762 is engaged with the worm gear teeth 1771 in a worm gear manner and operation noise may be minimized through the worm gear engagement.

In this embodiment, the 3-2 teeth 1762 has the diameter greater than that of the 3-1 teeth 1761.

The 3-2 teeth 1762 is disposed at a rear side thereof than the 3-1 teeth 1761 to minimize interference with the worm gear 1770.

The rotary shaft of the third gear 1760 is disposed in the forward and rearward direction.

The 3-1 teeth 1761 and the 3-2 teeth 1762 are each disposed in the forward and rearward direction. The 3-1 teeth 1761 is disposed at the front side thereof than the 3-2 teeth 1762.

The 3-1 teeth 1761 is flush with the 2-2 teeth 1752 and the 3-2 teeth 1762 is flush with the 2-1 teeth 1751.

In this embodiment, as the 3-2 teeth 1762 is engaged with the worm gear 1770, the 3-2 teeth 1762 is a worm gear teeth.

As the 3-1 teeth 1761 is engaged with the 2-2 teeth 1752, the 3-1 teeth 1761 is a pinion gear teeth.

The worm gear 1770 has a cylindrical shape and includes a vertical rotational axis. The worm gear 1770 includes a worm gear teeth 1771 on an outer circumferential surface thereof and has a vertical spiral shape.

As the rotary shaft of the worm gear 1770 is vertically disposed, the worm gear teeth 1771 may support a vertical external force.

The worm gear 1770 may rotate based on applied vertical external force when the rotary shaft of the worm gear 1770 is inclined or horizontally disposed.

In this embodiment, the rotary shaft of the worm gear 1770 is vertically disposed to support the vertical external force applied to the third gear 1760. The door cover assembly 1200 may be prevented from being moved downward by its own weight through the arrangement of the worm gear 1770 without an additional stopper.

In this embodiment, the weight of the door cover assembly 1200 may be supported through the engagement between the rack 1710 and the first gear 1740 and the engagement between the worm gear 1770 and the third gear 1760.

The worm gear 1770 is directly connected to the motor shaft 1721 of the gear drive motor 1720. The motor shaft 1721 of the gear drive motor 1720 vertically penetrates the rotation center of the worm gear 1770.

In this embodiment, the gear drive motor 1720 uses a step motor to suppress the rotation of the worm gear 1770 based on the external force applied to the third gear 1760.

The first gear 1740, the second gear 1750, the third gear 1760, the worm gear 1770, and the gear drive motor 1720 are assembled to the gear housing 1780.

The gear housing 1780 provides the rotary shafts of the first gear 1740, the second gear 1750, and the third gear 1760. The first gear 1740, the second gear 1750, and the third gear 1760 are assembled to bosses 1742 defined in the gear housing 1780.

In this embodiment, the gear housing 1780 includes a first gear housing 1781 and a second gear housing 1782.

The first gear 1740, the second gear 1750, the third gear 1760, the worm gear 1770, and the gear drive motor 1720 are each disposed between the first gear housing 1781 and the second gear housing 1782.

Each of the bosses 1742 protrudes from at least one of the first gear housing 1781 or the second gear housing 1782 to provide the rotary shaft of each of the first gear 1740, the second gear 1750, and the third gear 1760. The boss 1742 protrudes rearward from the first gear housing 1781.

In this embodiment, the first gear housing 1781 is disposed at the front side thereof than the second gear housing 1782. The first gear housing 1781 is assembled to the rear surface of the door cover housing 1220.

Among the gears of the gear assembly 1730, only the first gear 1740 protrudes outward from the gear housing 1780. The first gear 1740 penetrates a side surface of the gear housing 1780 and defines a protrusion protruding outward. A portion of the side surface of the gear housing 1780 is opened to protrude the first gear 1740 outward.

The first teeth 1741 of the first gear 1740 protruding outward from the gear housing 1780 is engaged with the rack teeth 1711 of the rack 1710. As the first teeth 1741 and the rack teeth 1711 are each disposed in the forward and rearward direction, the first teeth 1741 and the rack teeth 1711 maintain the vertically engaged state.

The vertical moving rail 1790 is disposed in front of the first teeth 1741 and the rack teeth 1711. The vertical moving rail 1790 is disposed on a plane on which the second gear 1750 is disposed in the forward and rearward direction.

<Configuration of Cable Guide>

As the door housing moving module 1700 is moved vertically, a cable connected to the door housing moving module 1700 is also moved vertically.

As the door assembly 200 has less thickness in the forward and rearward direction than a width, cable twist may occur when the door housing moving module 1700 is moved vertically.

In addition, the cable is sandwiched between the vertically moving door housing moving module 1700 and the panel module 1100 to limit operation of the door housing moving module 1700. A cable guide 1800 may minimize the above problem.

An upper end of the cable guide 1800 is assembled to the door cover assembly 1200 and a lower end thereof is assembled to the panel module 1100.

The cable guide 1800 includes a first cable guide 1810 assembled to be rotatable relative to the door cover assembly 1200, a second cable guide 1820 assembled to be rotatable relative to the panel module 1100, and a connecting cable guide 1830 assembled to be rotatable relative to the first cable guide 1810 and the second cable guide 1820.

The first cable guide 1810 includes a cable guide body 1815, a cable insertion space 1813 provided inside the cable guide body 1815 and into which the cable is inserted, a 1-1 rotator 1811 disposed at a first side of the cable guide body 1815 and assembled to be rotatable relative to the door cover assembly 1200 (e.g., in this embodiment, the door cover housing), and a 1-2 rotator 1812 disposed at a second side of the cable guide body 1815 and assembled to be rotatable relative to the connecting cable guide 1830.

The cable guide body 1815 has a length greater than the width. A cross-section orthogonal to the longitudinal direction of the cable guide body 1815 has a "∪" shape and the first cable guide 1810 provides the cable insertion space 1813. The cable insertion space 1813 of the first cable guide 1810 is opened upward.

The 1-1 rotator 1811 protrudes upward from the upper end of the cable guide body 1815. The 1-1 rotator 1811 may be coupled to the door cover housing 1220 by a hinge and may rotate relative to the door cover housing 1220.

When the door cover housing 1220 is moved upward or downward, the first cable guide 1810 is pivoted relative to the 1-1 rotator 1811.

The 1-2 rotator 1812 has the same structure as the 1-1 rotator 1811. The 1-2 rotator 1812 protrudes downward from the lower end of the cable guide body 1815. The 1-2 rotator 1812 may be coupled to the upper portion of the connecting cable guide 1830 by the hinge and may be rotated relative to the connecting cable guide 1830.

The second cable guide 1820 includes a cable guide body 1825, a cable insertion space 1823 provided in the cable guide body 1825 and into which a cable is inserted, a 2-1 rotator 1821 disposed at a first side of the cable guide body 1825 and assembled to be rotatable relative to the connecting cable guide 1830, and a 2-2 rotator 1822 disposed at a second side of the cable guide body 1825 and assembled to be rotatable relative to the panel module 1100 (e.g., in this embodiment, the upper panel module).

As the second cable guide 1820 is similar to the first cable guide 1810 in configuration, details thereof are replaced with drawings.

The connecting cable guide 1830 includes a cable guide body 1835, a cable insertion space 1833 disposed in the cable guide body 1835 and into which a cable is inserted, a 3-1 rotator 1831 disposed at a first side of the cable guide body 1835 and assembled to be rotatable relative to the first cable guide 1810, and a 2-2 rotator 1832 disposed at a second side of the second cable guide body 1835 and assembled to be rotatable relative to the second cable guide 1820.

As the connecting cable guide 1830 is similar in configuration to the first cable guide 1810, details thereof are replaced with drawings. A first pin 1841 assembles the 1-1 rotator 1811 to the door cover housing 1220 to be rotatable relative to each other. A second pin 1842 assembles the 1-2 rotator 1812 and the 2-1 rotators 1821 to be rotatable relative to each other. A third pin 1843 assembles the 2-2 rotator 1822 to the 3-1 rotator 1831 to be rotatable relative to each other. A fourth pin 1844 assembles the 3-2 rotator 1832 to the upper panel module 1110 to be rotatable relative to each other.

The first cable guide 1810 and the connecting cable guide 1830 form an angle within 180 degrees, and when the door cover assembly 1200 is moved down, the angle of the first cable guide 1810 and the connecting cable guide 1830 becomes less.

The second cable guide 1820 and the connecting cable guide 1830 form an angle within 180 degrees, and when the door cover assembly 1200 is moved down, the angle of the second cable guide 1820 and the connecting cable guide 1830 becomes less.

As the 2-2 rotator 1822 is disposed in the upper panel module 1110, the 2-2 rotator 1822 is not moved and a position thereof is fixed.

When the door cover assembly 1200 is moved down, the 1-1 rotator 1811, the 1-2 rotator 1812, the 3-1 rotator 1831, the 3-2 rotator 1832, and the 2-1 rotator 1821 may each be vertically moved.

The cable is connected to the door cover motor 1610 of the door cover assembly 1200 and the gear drive motor 1720 of the door housing moving module 1700. The cable may provide a power and a control signal to the door cover motor 1610 or the gear drive motor 1720, respectively.

<<Configuration of Door Slide Module>>

The door slide module 1300 moves a door assembly 200 in a horizontal direction with respect to a cabinet assembly 100. The door slide module 1300 may reciprocate the door assembly 200 in the horizontal direction.

The door slide module 1300 is disposed in one of the door assembly 200 or the cabinet assembly 100 and implements slide movement through interference with the other one thereof.

The door slide module 1300 includes a rack 1310 disposed in the door assembly 200 and extending longitudually in the horizontal direction, a gear assembly 1330 disposed in a structure of the cabinet assembly 100, engaged with the rack 1310, and moving along the rack 1310 when rotating, a gear drive motor 1320 disposed in a structure of the cabinet assembly 100 and to provide a driving force to the gear assembly 1330, and a gear housing 1380 disposed in a structure of the cabinet assembly 100 and in which the gear assembly 1330 and the gear drive motor 1320 are disposed.

<<Side Moving Assembly>>

In addition, according to this embodiment, an indoor unit may further include a side moving assembly 1400 to guide horizontal sliding of the door assembly 200 and support load of the door assembly 200.

The side moving assembly 1400 is disposed in the door assembly 200 and the cabinet assembly 100 and guides the horizontal movement of the door assembly 200.

When the door slide module 1300 is operated, the side moving assembly 1400 guides the slide movement of the door assembly 200. The slide movement of the door assembly 200 may be performed only by the operation of each of the rack 1310 and the gear assembly 1330 of the door slide module 1300, but there are limitations in implementing smooth slide movement.

In this embodiment, the side moving assembly 1400 is disposed at an upper side, a middle side, and a lower side of the door assembly 200.

The side moving assembly 1400 includes a top rail 1410 disposed at an upper portion of the door assembly 200, a middle rail 1420 disposed in the middle of the door assembly 200, a bottom rail 1430 disposed at a lower portion of the door assembly 200, a top supporter 1440 assembled to the door assembly 200, disposed at the upper portion of the door assembly 200, and hung at the upper portion of the cabinet assembly 100, and a bottom supporter 1450 assembled to the cabinet assembly 100, disposed at the lower portion of the cabinet assembly 100, and hung at the lower end of the door assembly 200.

The top rail 1410, the middle rail 1420, and the bottom rail 1430 are each horizontally disposed. The top rail 1410, the middle rail 1420, and the bottom rail 1430 are each disposed between the door assembly 200 and the cabinet assembly 100.

The top rail 1410 includes a first top rail 1412 and a second top rail 1414.

The first top rail 1412 is disposed on the rear surface of the door assembly 200. The first top rail 1412 is horizontally disposed. The first top rail 1412 may be disposed on the rear surface of the upper panel module 1110 of the door assembly 200.

The second top rail 1414 is assembled on the front surface of the cabinet assembly 100 and may be moved horizontally relative to the first top rail 1412.

In this embodiment, the second top rail 1414 is coupled to the top supporter 1440 and the top supporter 1440 is coupled to the cabinet assembly 100.

The first top rail 1412 and the second top rail 1414 are assembled to be movable relative to each other. A bearing 1415 may be disposed between the first top rail 1412 and the second top rail 1414 and may reduce a frictional force when the first top rail 1412 and the second top rail 1414 are moved relative to each other.

The middle rail 1420 includes a first middle rail 1422 and a second middle rail 1424.

The first middle rail 1422 is disposed on the rear surface of the door assembly 200. The first middle rail 1422 is horizontally disposed. The first middle rail 1422 may be disposed on a rear surface of the lower panel module 1120 of the door assembly 200.

The second middle rail 1424 is assembled to the front surface of the cabinet assembly 100 and may be moved horizontally relative to the first middle rail 1422.

The first middle rail 1422 and the second middle rail 1424 are assembled to be movable relative to each other. A bearing (not shown) may be disposed between the first middle rail 1422 and the second middle rail 1424 and may reduce the frictional force when the first middle rail 1422 and the second middle rail 1424 move relative to each other.

The bottom rail 1430 includes a first bottom rail 1432 and a second bottom rail 1434.

The first bottom rail 1432 is disposed on the rear surface of the door assembly 200. The first bottom rail 1432 is horizontally disposed. The first bottom rail 1432 may be disposed on the rear surface of the lower panel module 1120 of the door assembly 200.

The second bottom rail 1434 is assembled to a structure (e.g., in this embodiment, the bottom supporter) disposed on the front surface of the cabinet assembly 100 and may be moved horizontally relative to the first bottom rail 1432.

The first bottom rail 1432 and the second bottom rail 1434 are assembled to be movable relative to each other. A bearing (not shown) may be disposed between the first bottom rail 1432 and the second bottom rail 1434 and may reduce the frictional force when the first bottom rail 1432 and the second bottom rail 1434 move relative to each other.

When the door assembly 200 is moved horizontally by the door slide module 1300, the top supporter 1440 and the bottom supporter 1450 are disposed in place while supporting the load of the door assembly 200.

The top supporter 1440 distributes the load of the door assembly 200 to the upper portion of the cabinet. The bottom supporter 1450 supports the lower portion of the door assembly 200 and reduces friction when the door assembly 200 horizontally slides.

The top supporter 1440 includes a top fixer 1442 assembled to the structure of the door assembly 200 (e.g., in this embodiment, the second top rail 1414), a top ray 1444 protruding from the top fixer 1442 toward the cabinet assembly 100 and hung on the cabinet assembly 100, and a top engaging portion 1446 disposed on the top ray 1444 and to provide engagement with the cabinet assembly 100 in a forward and rearward direction.

The top fixer 1442 extends long in the horizontal direction of the door assembly 200. The top fixer 1442 may contact and may be assembled to the door assembly 200. In this embodiment, the top fixer 1442 is assembled to the structure of the door assembly 200, and in this embodiment, the top fixer 1442 is coupled to the top rail 1414.

The top fixer 1442 is disposed at a rear side of the second top rail 1414.

The top ray 1444 and the top fixer 1442 are integrated with each other. The top fixer 1442 and the top ray 1444 may be manufactured by bending one plate.

The top ray 1444 protrudes rearward from the top fixer 1442.

In this embodiment, the top ray 1444 protrudes rearward from an upper edge of the top fixer 1442.

The top ray 1444 may be coupled to the upper portion of the cabinet assembly 100.

When the door assembly 200 is moved horizontally, the top ray 1444 and the second top rail 1414 are each disposed in place and only the first top rail 1412 and the door assembly 200 are moved horizontally relative to each other.

The top engaging portion 1446 is horizontally disposed and is engaged in the forward and rearward direction of the cabinet assembly 100.

The top engaging portion 1446 protrudes downward from the top ray 1444.

In this embodiment, the top engaging portion 1446 defines a downward-concave groove and extends long along a longitudinal direction of the top ray 1444. The top engaging portion 1446 defines an engaging groove **1446*a* opened upward and the engaging groove 1446*a*** extends long in the horizontal direction.

The top ray 1444 includes a first top ray **1444*a* disposed at a front side of the top engaging portion 1446 and a second top ray 1444*b* disposed at a rear side of the top engaging portion 1446**.

The top engaging portion 1446 is disposed between the first top ray **1444*a* and the second top ray 1444*b***.

The top engaging portion 1446 is disposed at the upper portion of the cabinet assembly 100 and a top supporter installation portion (not shown) is engaged with the top engaging portion 1446.

Figure 31:
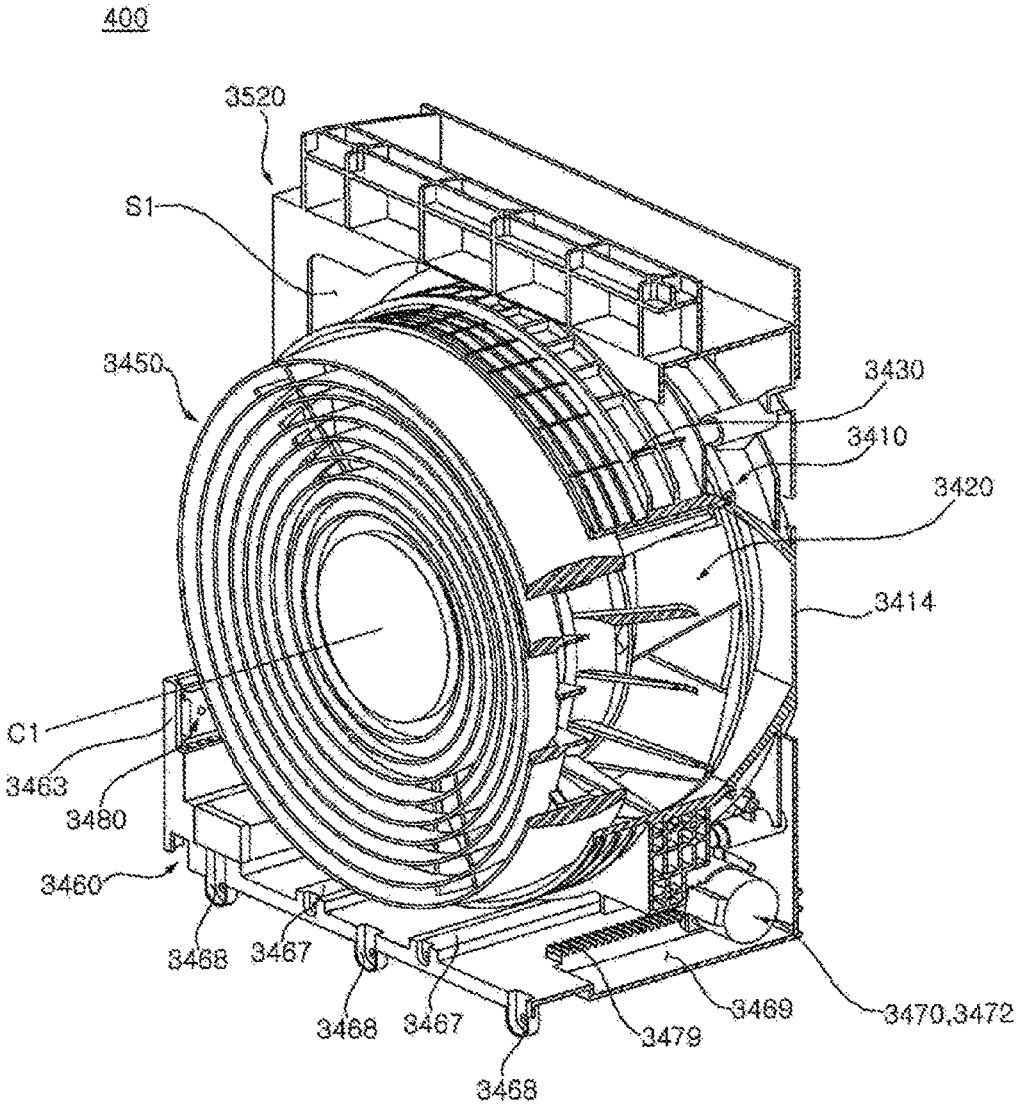
FIG. 31 is a partially cut-away perspective view showing a long-distance fan assembly in FIG. 12.
Figure 32:
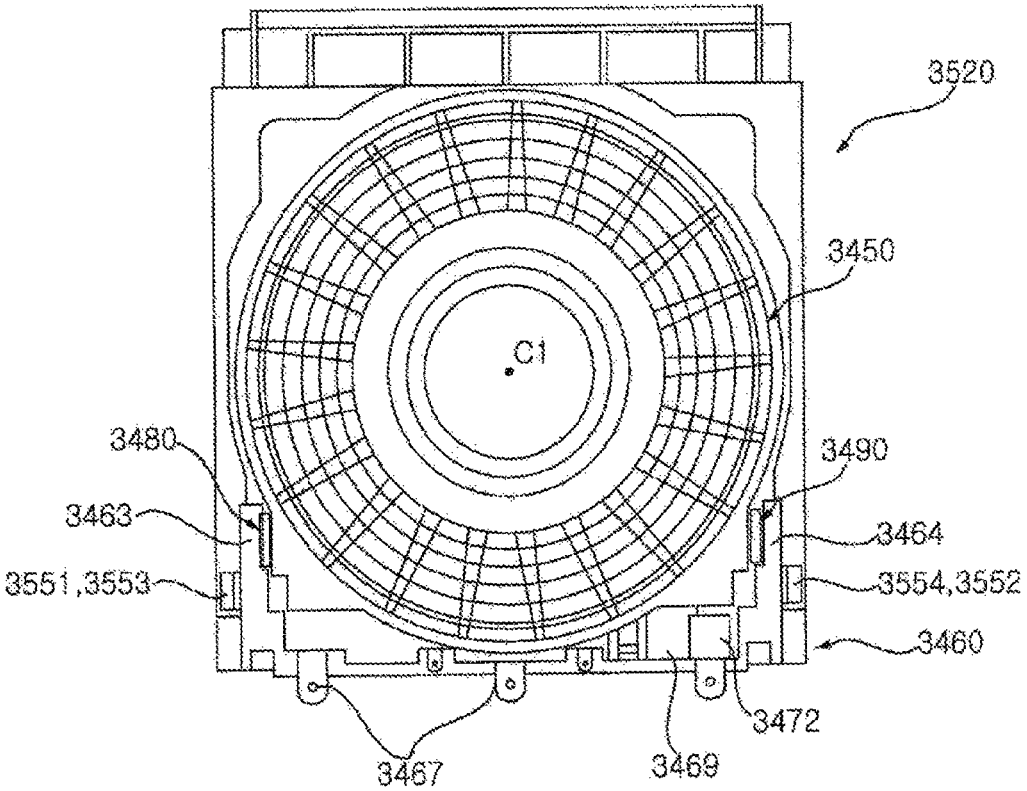
FIG. 32 is a front view showing the long-distance fan assembly in FIG. 31.
Figure 33:
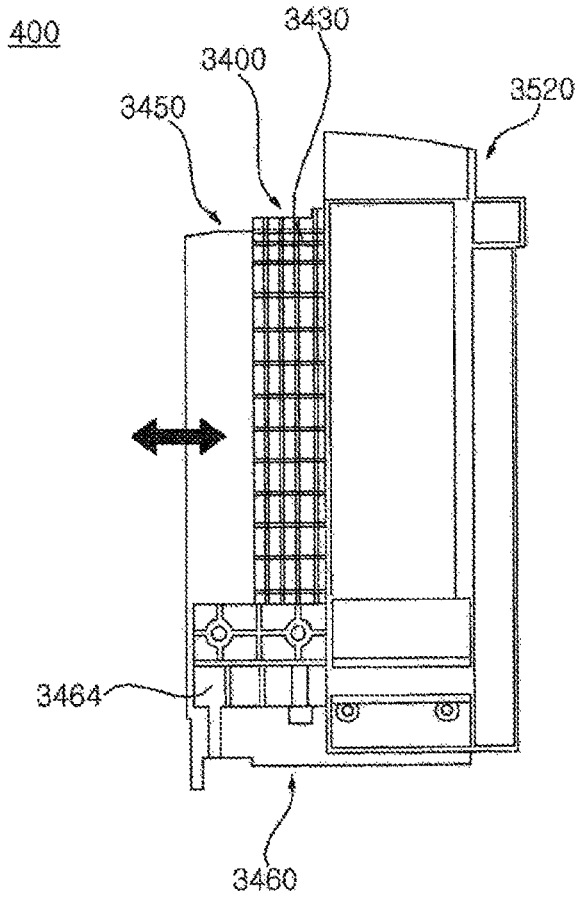
FIG. 33 is a right side view showing the long-distance fan assembly in FIG. 32.
Figure 34:
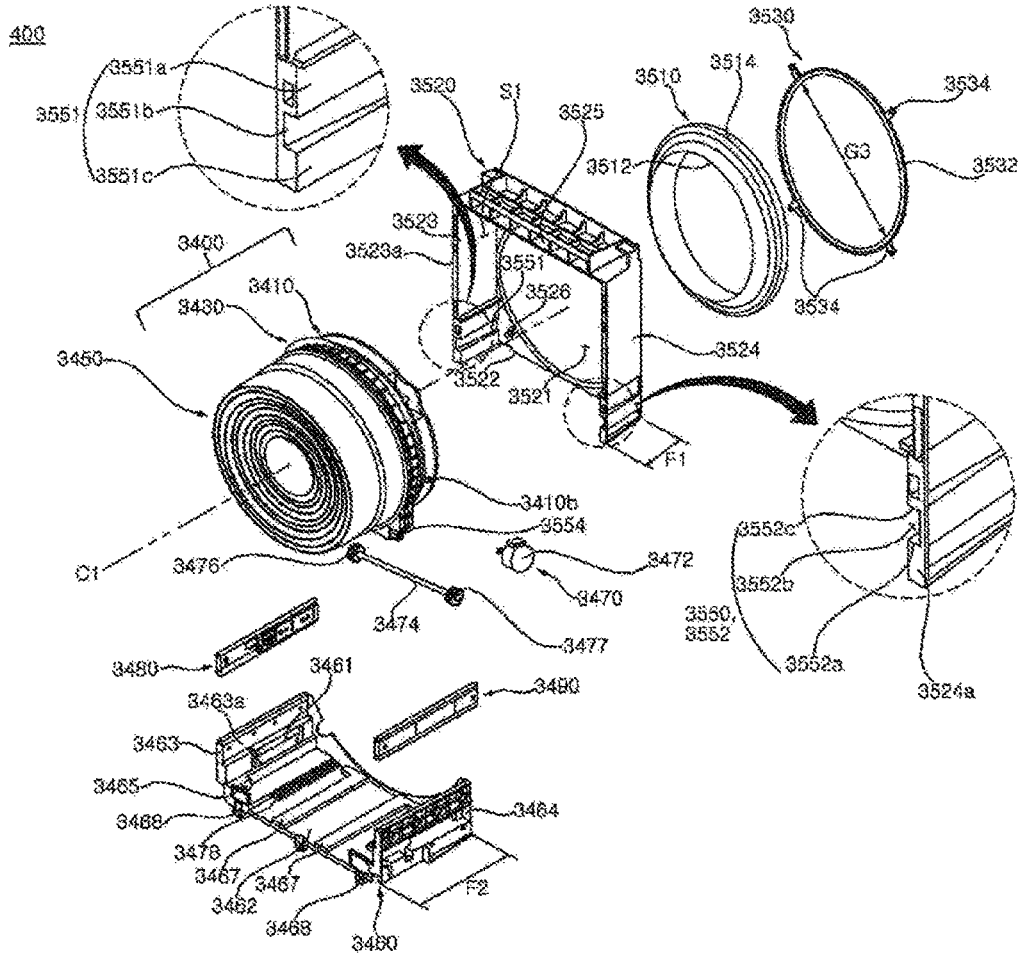
FIG. 34 is an exploded perspective view showing the long-distance fan assembly in FIG. 31.
Figure 35:
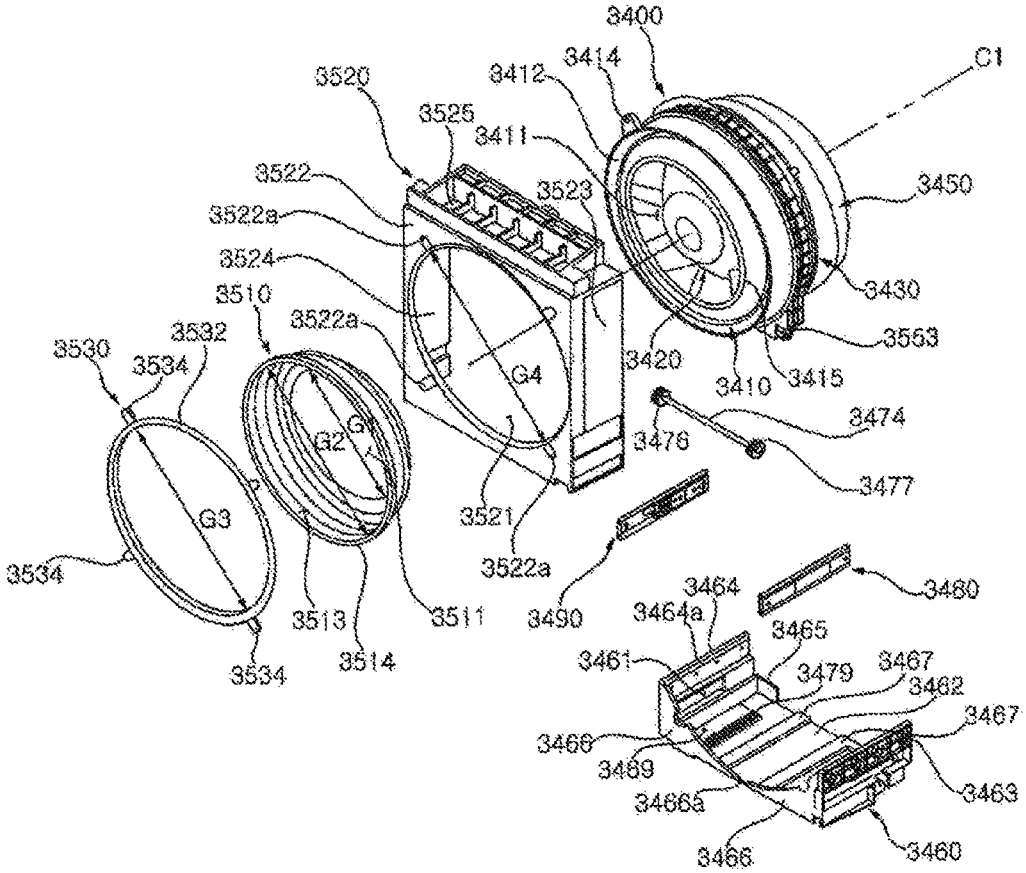
FIG. 35 is an exploded perspective view showing the long-distance fan assembly in FIG. 34 viewed from the rear.
Figure 36:
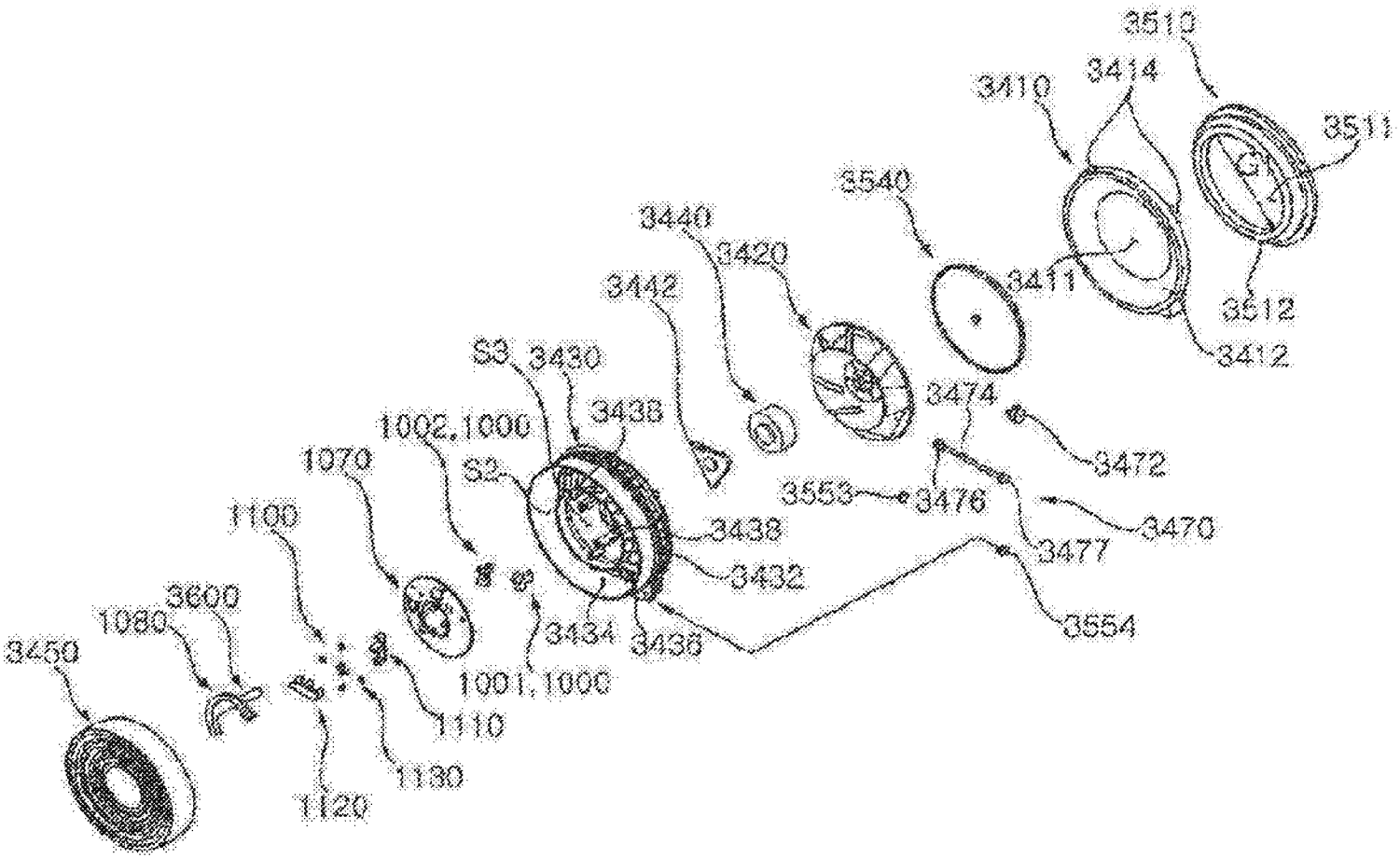
FIG. 36 is an exploded perspective view showing the fan housing assembly in FIG. 34.
Figure 37:
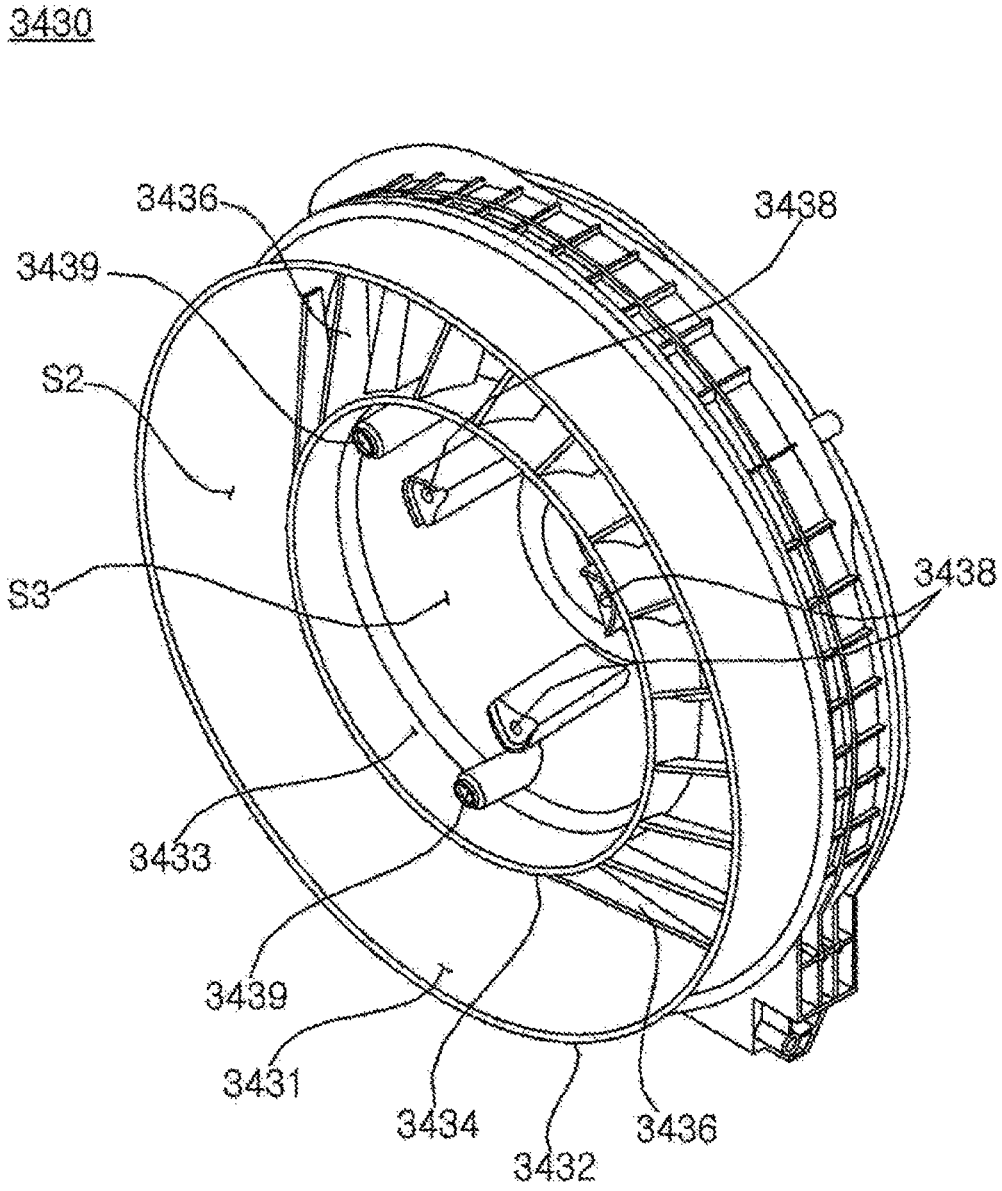
FIG. 37 is a perspective view showing the front fan housing in FIG. 36.
Figure 38:
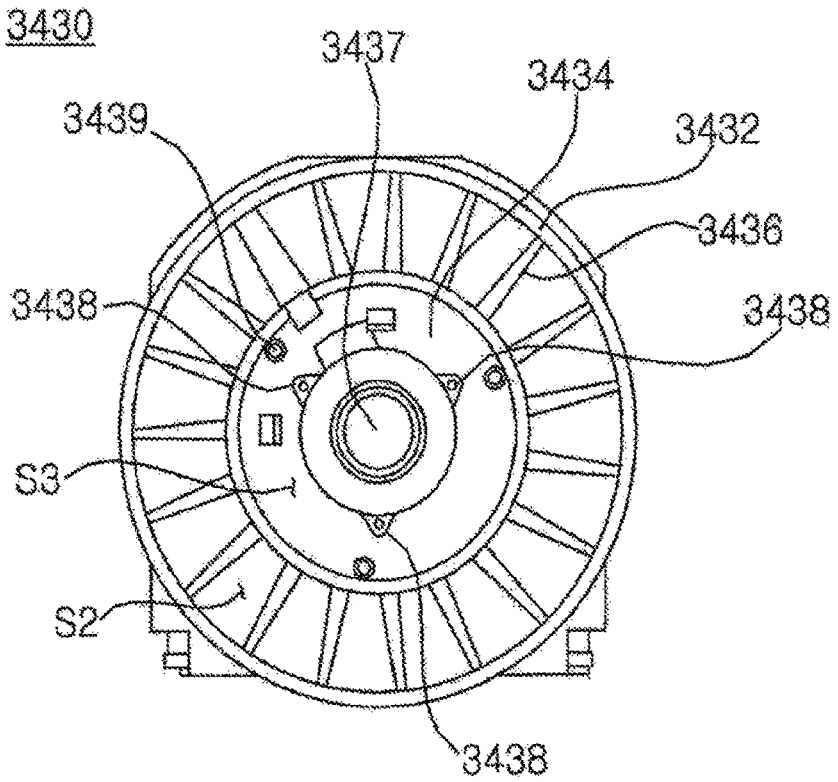
FIG. 38 is a front view showing the front fan housing in FIG. 37.
Figure 39:
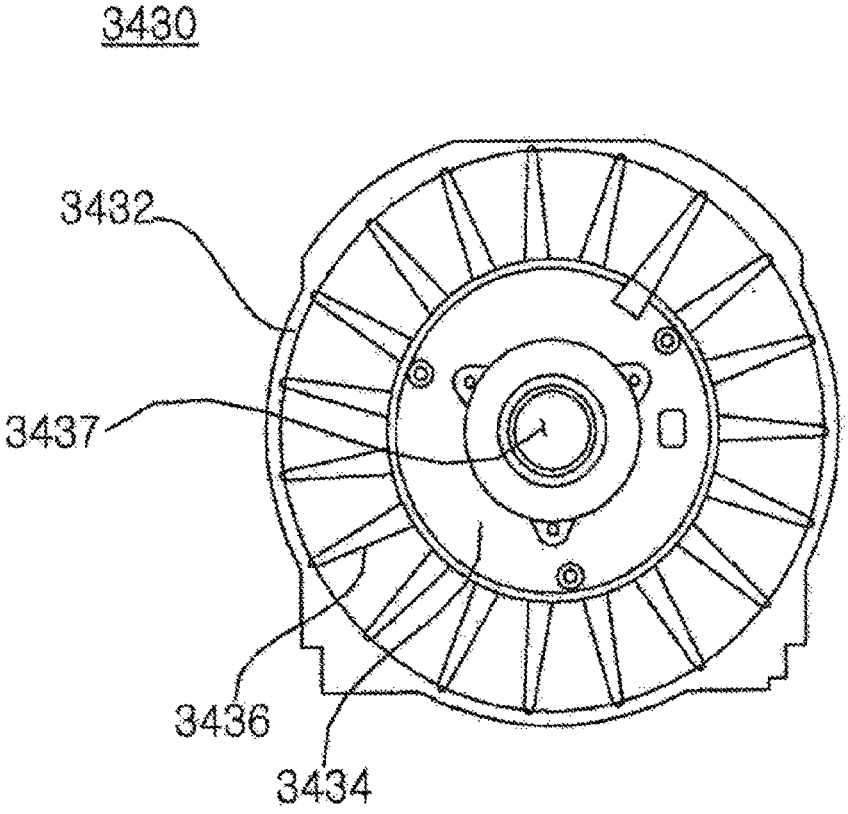
FIG. 39 is a rear view showing the front fan housing in FIG. 38.
Figure 40:
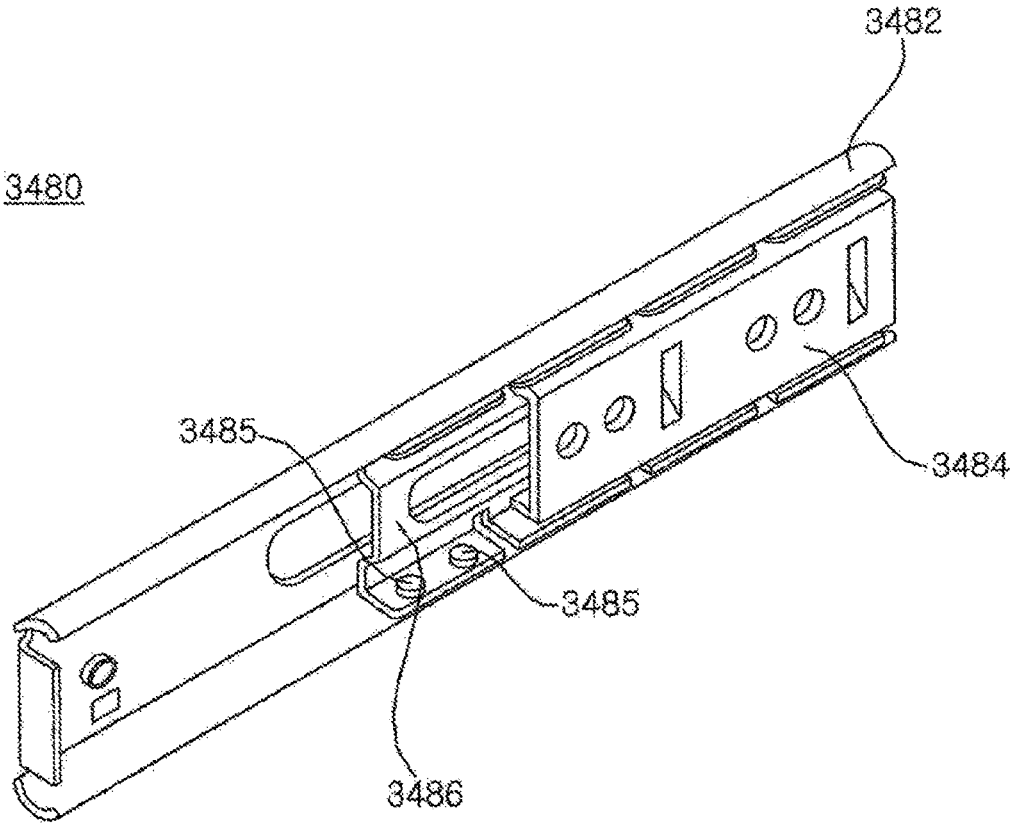
FIG. 40 is a perspective view showing a guide rail in FIG. 34.
Figure 41:
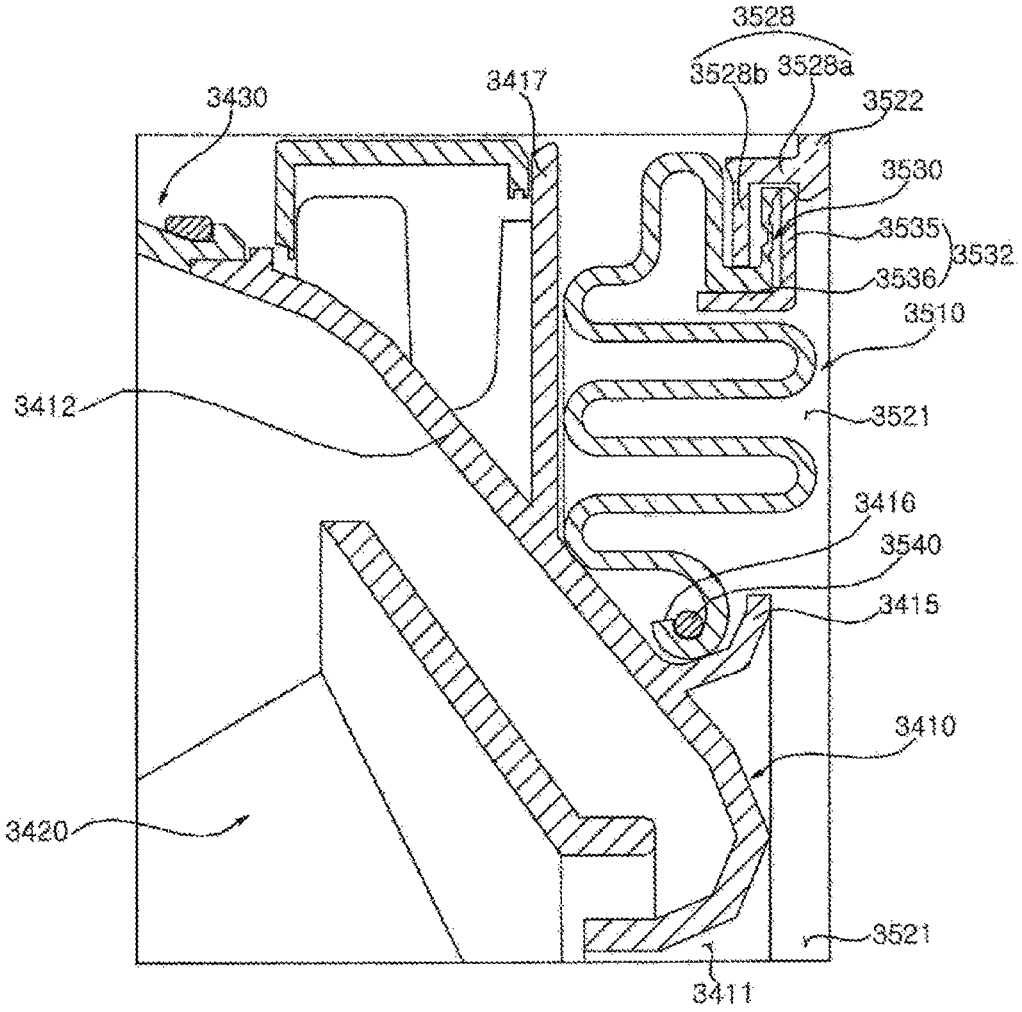
FIG. 41 is a cross-sectional view showing an air guide in FIG. 34 before operation.

FIG. 31 is a partially cut-away perspective view showing a long-distance fan assembly in FIG. 12. FIG. 32 is a front view showing the long-distance fan assembly in FIG. 31. FIG. 33 is a right side view showing the long-distance fan assembly in FIG. 32. FIG. 34 is an exploded perspective view showing the long-distance fan assembly in FIG. 31. FIG. 35 is an exploded perspective view showing the long-distance fan assembly in FIG. 34 viewed from the rear. FIG. 36 is an exploded perspective view showing the fan housing assembly in FIG. 34. FIG. 37 is a perspective view showing the front fan housing in FIG. 36. FIG. 38 is a front view showing the front fan housing in FIG. 37. FIG. 39 is a rear view showing the front fan housing in FIG. 38. FIG. 40 is a perspective view showing a guide rail in FIG. 34. FIG. 41 is a cross-sectional view showing an air guide in FIG. 34 before operation.

<<Configuration of Long-Distance Fan Assembly>>

The long-distance fan assembly 400 is movable relative to the cabinet assembly 100 in a forward and rearward direction. The long-distance fan assembly 400 discharges air to a front of the door assembly 200 and provides direct air to an indoor space.

The long-distance fan assembly 400 passes through a front discharge outlet 201 of the door assembly 200 during operation and protrudes forward from a front surface **200*a* of the door assembly 200. Therefore, the long-distance fan assembly 400** is in a projection state.

The long-distance fan assembly 400 is disposed inside the cabinet assembly 100 and is moved in the forward and rearward direction inside the cabinet assembly 100 during operation.

The long-distance fan assembly 400 is disposed in front of the heat exchange assembly 500 and is disposed behind the door assembly 200. The long-distance fan assembly 400 is disposed above the short-distance fan assembly 300 and is disposed below an upper wall of the cabinet assembly 100.

The long-distance fan assembly 400 discharges air through the front discharge outlet 201 defined in the door assembly 200 and the steering grill 3450 of the long-distance fan assembly 400 is disposed in front of the front discharge outlet 201.

The steering grill 3450 is disposed outside the front discharge outlet 201 to minimize air resistance due to structures such as the cabinet assembly 100 or the door assembly 200.

The long-distance fan assembly 400 provides a structure tiltable in an upward direction, a downward direction, a leftward direction, a rightward direction, or a diagonal direction. The long-distance fan assembly 400 may discharge the air to a remote place of the indoor space and may improve indoor air circulation.

The long-distance fan assembly 400 includes a guide housing (e.g., in this embodiment, an upper guide housing and a lower guide housing described below) disposed inside the cabinet assembly, a fan housing assembly 3400 assembled to be movable relative to the guide housing and to discharge air in the inner space (S) to the front discharge outlet, and an actuator 3470 disposed in at least one of the cabinet assembly 100 or the guide housing and to move the fan housing assembly along the guide housing.

The guide housing includes an upper guide housing 3520 disposed in front of the heat exchange assembly 500 and defining a guide housing suction inlet 3521 to introduce air passing through the heat exchange assembly 500 and a lower guide housing 3460 assembled to the upper guide housing 3520 and to place the front fan housing 3430, and to guide forward and rearward movement of the front fan housing 3430.

The fan housing assembly 3400 includes a rear fan housing 3410 defining a fan suction inlet 3411 communicating with the guide housing suction inlet 3521 and disposed in the upper guide housing 3520, a fan 3420 disposed in front of the rear fan housing 3410 and to discharge air suctioned by the fan suction inlet 3411 in a diagonal direction, a front fan housing 3430 disposed in front of the rear fan housing 3410, coupled to the rear fan housing 3410, disposed in front of the fan 3420, assembled to the fan 3420, and to guide air pressurized by the fan 3420 in the diagonal direction, a fan motor 3440 disposed in front of the front fan housing 3430, including a motor shaft 3441 assembled to the fan 3420 through the front fan housing 3430, and to rotate the fan 3420, a steering grill 3450 disposed in front of each of the front fan housing 3430 and the fan motor 3440, tiltable in any direction with respect to the front fan housing 3430, and to control a discharge direction of air guided by the front fan housing 3430, and a steering assembly 1000 disposed between the front fan housing 3430 and the steering grill 3450 and to push or pull the steering grill 3450 to tilt the steering grill 3450 with respect to a central axis (C1) of the steering grill 3450.

The rear fan housing 3410 and the front fan housing 3430 are referred to as "a fan housing".

The actuator 3470 is disposed in at least one of the front fan housing 3430 or the lower guide housing 3460 and provides a driving force when the front fan housing 3430 moves in the forward and rearward direction.

The long-distance fan assembly 400 further includes an air guide 3510 opened in the forward and rearward direction, connecting the rear fan housing 3410 to the upper guide housing 3520, to guide the air suctioned by the guide housing suction inlet 3521 into the fan suction inlet 3411, made of an elastic material, and to expand or contract when the front fan housing 3430 moves in the forward and rearward direction.

For convenience of description, the assembly moved in the forward and rearward direction by an actuator 3470 of the long-distance fan assembly 400 is referred to as "a fan housing assembly 3400". The fan housing assembly 3400 includes a rear fan housing 3410, a front fan housing 3430, a fan 3420, a steering grill 3450, a fan motor 3440, and a steering assembly 1000.

The fan housing assembly 3400 may be moved in the forward and rearward direction by the actuator 3470. A first guide rail 3480 and a second guide rail 3490 may be further disposed between the front fan housing 3430 and the lower guide housing 3460 to easily slide the front fan housing 3430.

The lower guide housing 3460 and the upper guide housing 3520 are coupled structures and may each be coupled to at least one of the cabinet assembly 100 or the short-distance fan assembly 300.

The air that has passed through the heat exchange assembly 500 passes through the guide housing suction inlet 3521, the fan suction inlet 3411, the fan 3420, and the front fan housing 3430, and is discharged from the steering grill 3450.

The upper guide housing 3520 and the lower guide housing 3460 may be integrated with each other. The integrated upper guide housing 3520 and lower guide housing 3460 may be referred to as "a guide housing".

The guide housing defines an opening at a front surface of the fan housing assembly 3400 to move in the forward and rearward direction and defines a guide housing suction inlet 3521 at a rear surface thereof to suction the air.

In this embodiment, the upper guide housing 3520 and the lower guide housing 3460 are respectively fabricated and assembled to move the fan housing assembly 3400 in the forward and rearward direction.

<Fan Configuration>

A fan 3420 includes a hub 312 to which a motor shaft 3441 is coupled to a center thereof, a shroud 314 spaced apart from the hub 312 and defining a suction inlet 311 at a center thereof to introduce the air, and a plurality of blades 316 disposed between the hub 312 and the shroud 314.

The plurality of blades 316 are disposed between the hub 312 and the shroud 314. A front end of the blade 316 is coupled to a rear surface of the hub 312 and a rear end thereof is coupled to a front surface of the shroud 314. The plurality of blades 316 are spaced apart from one another in a circumferential direction. The blade 316 preferably has an airfoil cross-section.

A side end of the blade 316 to which the air is introduced is referred to as "a leading edge 316*a*" and a side end of the blade 316 to which the air is discharged is referred to as "a trailing edge 316*b*".

The trailing edge 316*b* of the blade 316 is inclined in the forward and rearward direction such that the discharged air is radially inclined to a front side thereof. In the blade 316, the leading edge 316*a* may be shorter than the trailing edge 316*b* to radially incline the discharged air towards a front side thereof.

The hub 312 has a conical shape protruding downward towards a center. A rear portion of the inner fan housing 3434 is inserted into a front portion of the hub 312 and at least a portion of the fan motor 3440 is disposed inside the hub 312. In this structure, a thickness in the forward and rearward direction occupied by the fan motor 3440 and the fan 3420 may be minimized.

The motor shaft 3441 of the fan motor 3440 disposed at the upper portion of the hub 312 is coupled to the center of the hub 312. The hub 312 is disposed in front of the shroud 314 and the hub 312 is spaced apart from the shroud 314. The plurality of blades 316 are coupled to the rear surface of the hub 312.

When viewed from the top, the motor shaft 3441 is preferably disposed in the horizontal middle of the cabinet assembly 100. When viewed from the top, the motor shaft 3441 may be disposed on a line of central axis (C1) passing the center of the front discharge outlet in the forward and rearward direction.

An outer circumferential end of the hub 312 is inclined in a direction opposite to the direction of the suction inlet 311. The outer circumferential end of the hub 312 refers to a circumference of the front end of the hub 312. A direction (X) of the outer circumferential end of the hub 312 is preferably about 45 degrees with respect to the horizontal direction. The outer circumferential end of the hub 312 is inclined towards the front to discharge the air towards the front side thereof in the inclined direction.

The hub 312 has a flat cross-section with a straight line (Ah) inclined in a direction opposite to a direction of the suction inlet 311 from the center to the outer circumferential end of the hub 312. Preferably, the hub 312 has a longitudinal cross-section with the straight line (Ah) inclined from a portion connected to the leading edge 316*a* of each of the plurality of blades 316 to the outer circumferential end. The hub 312 has a constantly increasing diameter from the center to the outer circumferential end thereof. Preferably, the hub 312 has a constantly increasing diameter from the portion connected to the leading edge 316*a* of each of the plurality of blades 316 to the outer circumferential end thereof.

The shroud 314 defines a circular suction inlet 311 to suction the air at a central region thereof and has a bowl shape. The suction inlet 311 of the shroud 314 faces the suction inlet 101 of the cabinet assembly 100.

For example, the fan inlet 3411 of the fan housing assembly 3400 corresponds to the suction inlet 311 of the shroud 314. A diameter of the suction inlet 311 is preferably greater than the diameter of the fan suction inlet 3411 of the fan housing assembly 3400. The shroud 314 defines a suction guide 314*a* vertically protruding rearward, at a circumferential portion of the suction inlet 311.

The shroud 314 is spaced apart from the rear side of the hub 312. The plurality of blades 316 are coupled to the front surface of the shroud 314.

The outer circumferential end of the shroud 314 is inclined in a direction opposite to the direction of the suction inlet 311. The outer circumferential end of the shroud 314 refers to the circumference of the front end of the shroud 314. A direction of the outer circumferential end of the shroud 314 is preferably about 45 degrees with respect to the horizontal direction. The outer circumferential end of the shroud 314 is inclined towards the front to discharge the air forward in the inclined direction. Preferably, the direction of the outer circumferential end of the shroud 314 is substantially parallel to the direction of the outer circumferential end of the hub 312.

The shroud 314 has a longitudinal cross-section with a straight line (Ch) inclined in a direction opposite to the direction of the suction inlet 311 from the upper end of the suction guide 314*a* to the outer circumferential end of the shroud 314. Preferably, the shroud 314 has the longitudinal cross-section with the straight line (Ch) inclined from a portion connected to a leading edge 24*b*-1 of each of the plurality of blades 316 to an outer circumferential end thereof. The shroud 314 has a constantly increasing diameter from the upper end of the suction guide 314*a* to the outer circumferential end. Preferably, the shroud 314 has a constantly increasing diameter from the portion connected to the leading edge 24*b*-1 of each of the plurality of blades 316 to the outer circumferential surface thereof.

The direction (Sh) of the outer circumferential end of the shroud 314 is preferably substantially parallel to a direction (X) of the outer circumferential end of the hub 312. The inclined straight line (Ch) of the longitudinal cross-section of the shroud 314 is preferably substantially parallel to the inclined straight line (Ah) of the longitudinal cross-section of the hub 312.

In this embodiment, a distance between the shroud 314 and the hub 312 is gradually greater towards the outer circumferential end thereof.

<Configuration of Upper Guide Housing>

The upper guide housing 3520 constitutes an upper portion of a guide housing. The upper guide housing 3520 surrounds the fan housing assembly 3400. The upper guide housing 3520 guides air that has passed through the heat exchange assembly 500 to the fan housing assembly 3400.

The upper guide housing 3520 prevents air passing through the heat exchange assembly 500 from flowing into the steering grill 3450 through other flow paths except for the guide housing suction inlet 3521.

The guide housing suction inlet 3521 provides a unified flow path for guiding the cooled air to the steering grill 3450 to minimize contact of the cooled air with the door assembly 200.

The upper guide housing 3520 preferably has an area capable of covering the front surface of the heat exchange assembly 500. In this embodiment, as the short-distance fan assembly 300 is disposed, the upper guide housing 3520 has a shape and an area to cover the upper remaining area not covered by the short-distance fan assembly 300.

The upper guide housing 3520 is assembled to the lower guide housing 3460 and is disposed on the lower guide housing 3460. The upper guide housing 3520 and the lower guide housing 3460 are integrated with each other through fastening.

The fan housing assembly is disposed inside each of the upper guide housing 3520 and the lower guide housing 3460 and is movable relative to each of the upper guide housing 3520 and the lower guide housing 3460 in the forward and rearward direction.

The upper guide housing 3520 has a rectangular parallelepiped shape and defines openings at the front surface and the rear surface thereof.

The upper guide housing 3520 includes a rear wall 3522 defining a guide housing suction inlet 3521, a left wall 3523 and a right wall 3524 protruding forward from a side edge of the rear wall 3522, and a top wall 3525 protruding forward from an upper edge of the rear wall 3522.

The guide housing suction inlet 3521 penetrates the rear wall 3522 in the forward and rearward direction. The guide housing suction inlet 3521 has a circular shape when viewed from the front. The guide housing suction inlet 3521 is greater than the fan suction inlet 3411. The fan suction inlet 3411 also has a circular shape when viewed from the front. The diameter of the guide housing suction inlet 3521 is greater than the diameter of the fan suction inlet 3411.

The left wall 3523 is disposed on the left when viewed from the front and the right wall 3524 is disposed on the right. The left wall 3523 and the right wall 3524 face each other.

The top wall 3525 connects the rear wall 2522, the left wall 3523, and the right wall 3524. The fan housing assembly 3400 is disposed under the top wall 3525.

When not in operation, the fan housing assembly 3400 is disposed between the left wall 3523, the right wall 3524, and the top wall 3525. In operation, the fan housing assembly 3400 moves forward.

Even when the fan housing assembly 3400 moves forward with a maximum level, the rear fan housing 3410 is disposed inside the upper guide housing 3520. In this embodiment, when the fan housing assembly 3400 moves forward to its a maximum protrusion, a rear end 3410*b* of the rear fan housing 3410 is disposed at a rear side than each of a front end 3523*a* of the left wall 3523 and a front end 3524*a* of the right wall 3524.

When the fan housing assembly 3400 moves out of the upper guide housing 3520 during operation to return to an initial position thereof, if an external shock is applied, the fan housing assembly may engage with the upper guide housing 3520 and may not return to the initial position thereof.

Further, when the fan housing assembly 3400 moves out of the upper guide housing 3520, a flow distance of air flowing from the guide housing suction inlet 3521 to the fan suction inlet 3411 may be increased.

A fixer 3526 is disposed in the rear wall 3522 to fix the air guide 3510. The fixer 3526 protrudes forward from the front surface of the rear wall 3522. A plurality of fixers 3526 are disposed and each fixer 3526 is disposed outside the guide housing suction inlet 3521. In this embodiment, the fixers 3526 are disposed in four places.

In this embodiment, a lower surface 3527 of the upper guide housing 3520 is opened. In contrast to this embodiment, the lower surface 3527 may be closed.

In this embodiment, as the lower guide housing 3460 is disposed under the upper guide housing 3520 and the lower guide housing 3460 closes the lower surface 3527, the lower surface 3527 may be manufactured to have an open shape.

A horizontal width of the rear wall 3522 is greater than a horizontal width of the heat exchange assembly 500 and air passing through the heat exchange assembly 500 preferably flows into only the guide housing suction inlet 3521.

When the width of the rear wall 3522 is narrower than the width of the heat exchange assembly 500, the air passing through the heat exchange assembly 500 may flow to the door assembly 200 through the outside portion of the long-distance fan assembly 400. Through this structure, cold air may cool the door assembly 200 when cooling to cause dew formation to occur.

The front surface of the rear wall 3522 preferably faces the front surface of the heat exchange assembly 500 and the rear wall 3522 preferably contacts the front surface of the heat exchange assembly 500. The rear wall 3522 may contact the front surface of the heat exchange assembly 500 to effectively flow the heat-exchanged air to the guide housing suction inlet 3521.

A length in a forward and rearward direction of each of the left wall 3523, the right wall 3524, and the top wall 3525 is referred to as "F1".

At least one of the left wall 3523 or the right wall 3524 defines a guide groove 3550. The guide groove 3550 is disposed in the forward and rearward direction.

The guide groove 3550 supports the fan housing assembly 3400 and guides the forward and rearward movement of the fan housing assembly 3400.

A guide groove 3550 defined in the left wall 3523 is referred to as "a first guide groove 3551" and a guide groove 3550 defined in the right wall 3524 is referred to as "a second guide groove 3552".

The first guide groove 3551 is provided in the storage space (S1) and is concaved towards the left wall 3523. The second guide groove 3552 is concaved towards the right wall 3524 in the storage space (S1).

The first guide groove 3551 is defined on an inner surface of the left wall 3523, extends longitudinally in the forward and rearward direction, and opens towards the inner space (S1). The second guide groove 3552 is defined on an inner surface of the right wall 3524, extends longitudinally in the forward and rearward direction, and opens towards the inner space (S1).

The first guide groove 3551 includes a lower surface 3551*a*, a side surface 3551*b*, and an upper surface 3551*c* and the second guide groove 3522 includes a lower surface 3552*a*, a side surface 3552*b*, and an upper surface 3552*c*.

The lower surface 3551*a* of the first guide groove 3551 and the lower surface 3552*a* of the second guide groove 3552 each supports the load of the fan housing assembly 3400.

The first guide roller 3553 and the second guide roller 3554 of the fan housing assembly 3400 described below move in the forward and rearward direction along the first guide groove 3551 and the second guide groove 3552.

The first guide groove 3551 and the second guide groove 3552 each provide moving spaces of the first guide roller 3553 and the second guide roller 3554 and each support the first guide roller 3553 and the second guide roller 3554.

<Configuration of Lower Guide Housing>

The lower guide housing 3460 constitutes a lower portion of a guide housing. The lower guide housing 3460 movably supports the fan housing assembly 3400 and guides the fan housing assembly 3400 in a forward and rearward direction.

There is no particular restriction on a shape of the lower guide housing 3460 and the lower guide housing 3460 may have a shape capable of supporting the fan housing assembly 3400 and guiding the frontward and rearward movement.

The lower guide housing 3460 is assembled to the upper guide housing 3520 and provides a storage space (S1) to accommodate the fan housing assembly 3400. In this embodiment, only the rear side of the fan housing assembly 3400 is accommodated and a front side thereof may be exposed outside the storage space S1. In contrast to this embodiment, the storage space S1 may accommodate the entire fan housing assembly 3400.

In this embodiment, the lower guide housing 3460 is disposed on the fan casing 320.

The lower guide housing 3460 has a longer length in the forward and rearward direction than that of the upper guide housing 3520 because the lower guide housing 3460 supports the fan housing assembly 3400 and guides the forward and rearward movement of the fan housing assembly 3400. The length in the forward and rearward direction of the lower guide housing 3460 is referred to as "F2". The length (F2) in the forward and rearward direction of the lower guide housing 3460 is longer than the length (F1) in the forward and rearward direction of the upper guide housing 3520.

The lower guide housing 3460 closes the lower surface of the upper guide housing 3520 and movably supports the fan housing assembly 3400. The fan housing assembly 3400 may be moved in the forward and rearward direction by an actuator 3470 when the fan housing assembly 3400 is supported on the lower guide housing 3460.

The lower guide housing 3460 includes a housing base 3462 disposed under the fan housing assembly 3400, a left side wall 3463 and a right side wall 3464 extending upward from both edges of the housing base 3462, a stopper 3465 disposed on at least one of the housing base 3462, the left side wall 3463, or the right side wall 3464 to limit a forward movement of the fan housing assembly 3400, a base guide 3467 disposed on the housing base 3462, interfering with the fan housing assembly 3400 (e.g., in this embodiment, the front fan housing), to guide the forward and rearward direction of the fan housing 3400, and a cable penetration portion 3461 disposed on at least one of the left side wall 3463 or the right side wall 3464, extending longitudinally in a forward and rearward direction, having a long shape, and through which a cable (not shown) coupled to the actuator 3470 passes.

In this embodiment, the lower guide housing 3460 includes a housing rear wall 3466 connecting the housing base 3462, the left side wall 3463, and the right side wall 3464 and disposed at a rear side of the housing base 3462, the left side wall 3463, and the right side wall 3464. The housing rear wall 3466 functions as a stopper to limit the rearward movement of the fan housing assembly 3400.

The housing rear wall 3466 faces the rear wall 3522 of the upper guide housing 3520 and is disposed in front of the rear wall 3522.

An upper end 3466*a* of the housing rear wall 3466 has the same line as the guide housing suction inlet 3521. For example, the upper end 3466*a* of the housing rear wall 3466 has the same radius of curvature as the radius of curvature of the guide housing suction inlet 3521. The upper end 3466*a* of the housing rear wall 3466 may not cover the guide housing suction inlet 3521 in the forward and rearward direction.

The housing rear wall 3466 connects the housing base 3462, the left side wall 3463, and the right side wall 3464 to improve rigidity of the lower guide housing 3460 and prevent excessive rearward movement of the fan housing assembly 3400.

The stopper 3465 is disposed in front of the housing rear wall 3466. In this embodiment, the stoppers 3465 are disposed on the left side and the right side of the housing base 3562. One of the stoppers 3465 connects the housing base 3462 and the left side wall 3463 and the other one thereof connects the housing base 3462 and the right side wall 3464.

When the fan housing assembly 3400 is excessively moved forward, the fan housing assembly 3400 is supported by the stopper 3465 and the movement of the fan housing assembly 3400 is stopped.

The cable penetration portion 3461 communicates the outer space of the guide housing with the inner storage space (S1) of the guide housing.

The cable penetration portions 3461 are disposed on the left side wall 3463 and the right side wall 3464. The cable penetration portions 3461 penetrate the left side wall 3463 and the right side wall 3464 in the horizontal direction. The cable penetration portion 3461 extends longitudinally in the forward and rearward direction. The cable penetration portion 3461 provides a space where the cable may move in the forward and rearward direction along with the fan housing assembly 3400. In this embodiment, the cable penetration portion 3461 has a length corresponding to the forward and rearward moving distance of the fan housing assembly 3400.

When the cable penetration portion 3461 has a short length that does not correspond to the moving distance of the fan housing assembly 3400, the connection with the actuator 3470 may be separated.

The cable penetration portion 3461 extends longitudinally in the forward and rearward direction and communicates an inner side of the lower guide housing 3460 and an outer side of the lower guide housing 3460. The cable penetration portion 3461 provides a space where a wire connected to the guide motor may also move in the forward and rearward direction when the fan housing assembly 3400 moves. The wire may move along the cable penetration portion 3461 to provide reliability of connection with the guide motor 3472.

The lower guide housing 3460 includes a fastener 3468 to couple with the fan casing 320 of the short-distance fan assembly 300. The fastener 3468 is disposed on the housing base 3462.

The base guide 3467 is disposed in a forward and rearward direction that is a moving direction of the fan housing assembly 3400. Two base guides 3467 are disposed, a first one thereof is disposed near the left side wall 3463 and a second one thereof is disposed near the right side wall 3464.

The base guide 3467 protrudes upward from an upper surface of the housing base 3462. The base guide 3467 is inserted into a groove defined in the lower surface of the front fan housing 3430. The base guide 3467 limits the horizontal movement of the fan housing assembly 3400.

<Configuration of Rear Fan Housing>

The rear fan housing 3410 forms a rear surface of the fan housing assembly 3400. The rear fan housing 3410 is disposed in front of the heat exchange assembly 500.

In this embodiment, the rear fan housing 3410 is disposed at a front side of the upper guide housing 3520, and more specifically, at a front side of the rear wall 3522. The rear fan housing 3410 is disposed inside the upper guide housing 3520.

The rear fan housing 3410 includes a rear fan housing body 3412 to cover a rear surface of the front fan housing 3430, a fan suction inlet 3411 disposed in the rear fan housing body 3412 and penetrating in a forward and rearward direction, and a fastener 3414 disposed in the rear fan housing body 3412 and coupled to the front fan housing 3430.

A plurality of fasteners 3414 are disposed to be assembled with the front fan housing 3430. The fastener 3414 protrudes radially outward from the rear fan housing body 3412.

The rear fan housing 3410 has a donut shape and defines a fan suction inlet 3411 when viewed from the front. In particular, the rear fan housing body 3412 has a donut shape when viewed from the front.

The rear fan housing 3410 surrounds the fan 3420 together with the front fan housing 3430. The fan 3420 is disposed between the rear fan housing 3410 and the front fan housing 3430.

The rear fan housing 3410 covers the rear surface of the front fan housing 3430 and is assembled to a rear end of the front fan housing 3430.

The rear fan housing 3410 is vertically disposed with respect to the floor. The rear fan housing 3410 faces the front surface of the heat exchange assembly 500.

The fan suction inlet 3411 is parallel to the guide housing suction inlet 3521 and faces each other. A diameter of the fan suction inlet 3411 is less than a diameter of the guide housing suction inlet 3521. The air guide 3510 connects the fan suction inlet 3411 to the guide housing suction inlet 3521. The fan suction inlet 3411 faces the front surface of the heat exchange assembly 500.

The rear fan housing body 3412 is concaved from the front side to the rear side thereof.

The air guide 3510 is disposed at the rear side of the rear fan housing 3410 and is coupled to the rear surface of the rear fan housing 3410. In particular, the air guide 3510 is assembled to the rear fan housing body 3412 and surrounds the fan suction inlet 3411.

<Configuration of Front Fan Housing>

The front fan housing 3430 has a cylindrical shape, is opened in a forward and rearward direction, and provides a flow path structure to guide air blown by the fan 3420 to a steering grill 3450. In addition, in this embodiment, the fan motor 3440 is assembled to the front fan housing 3430 and the front fan housing 3430 provides an installation structure for installing the fan motor 3440.

The fan motor 3440 is disposed at a front side of the front fan housing 3430, the fan 3420 is disposed at a rear side thereof, and a lower guide housing 3460 is disposed at a lower side thereof.

The front fan housing 3430 is assembled to the lower guide housing 3460 and is movable in the forward and rearward direction with respect to the lower guide housing 3460.

The front fan housing 3430 includes an outer fan housing 3432 opened in a forward and rearward direction and having a cylindrical shape, an inner fan housing 3434 defining an opening opened to a front, disposed in the outer fan housing 3432 and to accommodate the fan motor 3440, a vane 3436 connecting the outer fan housing 3432 to the inner fan housing 3434, and a motor installation portion 3448 disposed in the inner fan housing 3434 and assembled with the fan motor 3440.

The outer fan housing 3432 has a cylindrical shape and defines openings at a front surface and a rear surface thereof and the inner fan housing 3434 is disposed therein. The outer fan housing 3432 may receive a driving force from the actuator 3470 and may be moved in the forward and rearward direction.

An open front surface of the outer fan housing 3432 is referred to as "a first fan opening surface 3431". In this embodiment, the first fan opening surface 3431 has a circular shape when viewed from the front. The rear end of the steering grill 3450 may be inserted into the first fan opening surface 3431.

An inner space of the outer fan housing 3432 opened in the forward and rearward direction is referred to as "a space (S2)". The first fan opening surface 3431 forms a front surface of the space (S2).

The inner fan housing 3434 defines an opening at a front side thereof and has a bowl shape and concaved from a front side to a rear side thereof. A concave inner space of the inner fan housing 3434 is referred to as "a space (S3)". The fan motor 3440 is disposed in the space (S3) and is coupled to the inner fan housing 3434.

The open front surface of the inner fan housing 3434 is referred to as "a second fan opening surface 3433". The second fan opening surface 3433 may have various shapes. In this embodiment, the second fan opening surface 3433 has a circular shape in consideration of air flow.

The second fan opening surface 3433 forms a front surface of the space (S3). The first fan opening surface 3431 is disposed in front of the second fan opening surface 3433. The second fan opening surface 3433 is disposed inside the first fan opening surface 3431.

The first fan opening surface 3431 and the second fan opening surface 3433 are spaced apart from each other in the forward and rearward direction to provide a space to tilt the steering grill 3450. The rear end of the steering grill 3450 may be disposed between the first fan opening surface 3431 and the second fan opening surface 3433.

A motor installation portion 3438 is disposed in the inner fan housing 3434 to couple the fan motor 3440.

The motor installation portion 3438 is disposed in the space (S3) and protrudes forward from the inner fan housing 3434. The fan motor 3440 further includes a motor mount 3442 and the motor mount 3442 is coupled to the motor installation portion 3438.

The motor installation portion 3438 is disposed in the inner fan housing 3434. The motor installation portions 3438 are disposed at equal distances with respect to a central axis (C1).

A motor shaft of the fan motor 3440 passes through the inner fan housing 3434 and is disposed toward the rear, and is coupled to a fan 3420 disposed at the rear side of the inner fan housing 3434. The inner fan housing 3434 defines a shaft hole 3437 through which the motor shaft of the fan motor 3440 passes.

As the fan motor 3440 is disposed at the front side of the inner fan housing 3434 and is inserted into the space (S3), interference with the discharged air may be minimized.

In particular, a steering base 1070 described below is coupled to the inner fan housing 3434 and closes the space (S3). The fan motor 3440 is disposed outside a flow path of the discharged air to minimize resistance to the discharged air. In particular, the fan motor 3440 is disposed at the front side of the inner fan housing 3434 to block resistance to air suctioned from the rear portion thereof.

The inner fan housing 3434 defines a fastening boss 3439 to fix to the steering base 1070 and support the steering base 1070. The fastening bosses 3439 are disposed in three places and are spaced apart from one another with the same distance with respect to the central axis (C1).

The fastening boss 3439 and the motor installation portion 3438 are disposed inside the space (S3). When the steering base 1070 is assembled to the fastening boss 3439, the motor installation portion 3438 is concealed by the steering base 1070.

The inner fan housing 3434 is spaced apart from the outer fan housing 3432 by a predetermined distance and the vane 3436 integrates the outer fan housing 3432 with the inner fan housing 3434.

The outer fan housing 3432, the inner fan housing 3434, and the vane 3436 provide straight movement to the air discharged by the fan 3420.

Meanwhile, the first guide roller 3553 and the second guide roller 3554 are disposed outside the front fan housing 3430.

The first guide roller 3553 and the second guide roller 3554 moves in the forward and rearward direction of the first guide groove 3551 and the second guide groove 3552 disposed in the upper guide housing 3520.

The first guide roller 3553 is inserted into the first guide groove 3551, moves along the first guide groove 3551 in the forward and rearward direction, and is supported by the first guide groove 3551.

The second guide roller 3554 is inserted into the second guide groove 3552, moves along the second guide groove 3552 in the forward and rearward direction, and is supported by the second guide groove 3552.

The first guide roller 3553 includes a roller shaft coupled to the front fan housing 3430 and a roller rotatably coupled to the roller shaft. The roller shaft is horizontally disposed.

The second guide roller 3554 includes a roller shaft coupled to the front fan housing 3430 and a roller rotatably coupled to the roller shaft. The roller shaft is horizontally disposed.

The roller shaft of the first guide roller 3553 and the roller shaft of the second guide roller 3554 are disposed in a line.

The first guide roller 3553 is disposed on the left side of the front fan housing 3430 and the second guide roller 3554 is disposed on the right side of the front fan housing 3430.

The fan housing assembly 3400 is supported by the first guide roller 3553 and the second guide roller 3554 and a lower end of the fan housing assembly 3400 is spaced apart from a housing base 3462 of the lower guide housing 3460.

When the first guide roller 3553 and the second guide roller 3554 are not provided, load of the fan housing assembly 3400 is applied to the actuator 3470, and the actuator 3470 may move the fan housing assembly 3400 forward or rearward when the actuator 3470 supports the load of the fan housing assembly 3400.

The lower end of the fan housing assembly 3400 is spaced apart by the support of the first guide roller 3553 and the second guide roller 3554 to reduce the operating load of the actuator 3470.

When the fan housing assembly 3400 moves forward, a front end 3430*a* of the front fan housing 3430 may be inserted into the door assembly 200. More specifically, the front fan housing 3430 is inserted into the front discharge outlet 201 and the front end 3430*a* is disposed inside the door assembly 200. The front end 3430*a* is disposed behind the front surface 200*a* of the door assembly 200.

<Fan Configuration>

The fan 3420 is disposed between a rear fan housing 3410 and a front fan housing 3430. The fan 3420 is disposed inside the assembled rear fan housing 3410 and front fan housing 3430 and rotates therein.

The fan 3420 discharges air suctioned through a fan suction inlet 3411 in a diagonal direction. The fan 3420 suctions the air through the fan suction inlet 3411 disposed at a rear side thereof and discharges the air in a circumferential direction.

The discharge direction of the air discharged by the fan housing assembly is a diagonal direction. In this embodiment, the diagonal direction refers to a direction between a forward direction and the circumferential direction.

<Configuration of Air Guide and Air Guide Bracket>

The air guide 3510 couples the fan housing assembly 3400 to the guide housing (e.g., in this embodiment, an upper guide housing) and connects the guide housing suction inlet 3521 to the fan suction inlet 3411.

The air guide 3510 defines an opening opened in a forward and rearward direction and introduces air. Specifically, the air guide 3510 connects the rear fan housing 3410 to the upper guide housing 3520 and guides the air suctioned by the guide housing suction inlet 3521 to the fan suction inlet 3411.

The air guide 3510 is made of elastic material and may be expanded or contracted when the front fan housing 3430 moves in the forward and rearward direction.

As the air guide 3510 is made of elastic material, an additional component is needed to couple to the guide housing and the fan housing assembly 3400.

The long-distance fan assembly 400 further includes a first air guide bracket 3530 to couple the air guide 3510 to the guide housing (e.g., in this embodiment, an upper guide housing) and a second air guide bracket 3540 to couple the air guide 3510 to the fan housing assembly 3400 (e.g., in this embodiment, a rear fan housing).

The air guide 3510 is made of elastic material and may have a cylindrical shape. The air guide 3510 defines an air guide outlet 3511 at a front side thereof (e.g., in this embodiment, towards the fan housing assembly) and defines an air guide inlet 3513 at a rear side thereof (e.g., in this embodiment, towards the guide housing).

The air guide outlet 3511 may have a diameter of G1 and the air guide inlet 3513 may have a diameter of G2. G1 and the G2 may be the same, but in this embodiment, G2 is greater than the G1.

A size of G1 corresponds to a size of the fan suction inlet 3411 and a size of G2 corresponds to a size of the guide housing suction inlet 3521.

In this embodiment, G1 is preferably greater than the diameter of the fan suction inlet 3411 and the fan suction inlet 3411 is disposed inside the air guide outlet 3511.

Similarly, G2 is preferably greater than a diameter (G4) of the guide housing suction inlet 3521.

The first air guide bracket 3530 couples the rear end 3514 of the air guide 3510 to the guide housing (e.g., in this embodiment, the upper guide housing). The second air guide bracket 3540 couples the front end 3512 of the air guide 3510 to the fan housing assembly 3400.

The first air guide bracket 3530 includes a bracket body 3532 having a ring shape and a bracket fastener 3534 disposed on the bracket body 3532 and protruding outward from the bracket body 3532.

The bracket body 3532 has a circular shape and a diameter of the bracket body 3532 is referred to as "G3". The diameter (G3) of the bracket body 3532 is less than the diameter (G2) of the air guide inlet 3513 and is greater than the diameter (G4) of the guide housing suction inlet 3521.

The rear end 3513 of the air guide passes through the guide housing suction inlet 3521 and is disposed on the rear surface of the rear wall 3522 and the bracket body 3532 contacts the rear end 3513 of the air guide to the rear wall 3522.

In this embodiment, a bracket insert 3528 is disposed on the rear wall 3522 of the upper guide housing 3520.

As the bracket insert 3528 is additionally disposed, the guide housing suction inlet 3521 is referred to as a space inward an inner edge of the bracket insert 3528.

The bracket insert 3528 includes a first insertion wall 3528*a* protruding forward from the rear wall 3522 and a second insertion wall 3528*b* protruding from the first insertion wall 3528*a* toward the central axis (C1) of the fan housing assembly 3400.

The bracket insert 3528 has a forward-concave end due to the structures of the first insertion wall 3528*a* and the second insertion wall 3528*b*.

The bracket body 3532 includes a first bracket body 3535 to face the second insertion wall 3528*b* and a second bracket body 3536 protruding forward from the inner edge of the first bracket body 3535. The first bracket body 3535 and the second bracket body 3536 have a bent shape.

An air guide rear end 3513 is disposed between the first bracket body 3535 and the second insertion wall 3528*b* and the first bracket body 3535 contacts the rear end 3513 with the second insert wall 3528*b*.

The second bracket body 3536 is disposed inside the inner edge of the first insertion wall 3528*a*. An air guide 3510 is disposed between the second bracket body 3536 and the first insertion wall 3528*a*.

A fastening member (e.g., in this embodiment, a screw) is fastened to the rear wall 3522 through the bracket fastener 3534.

A first bracket installation portion 3522*a* in which the bracket fastener 3534 is disposed is disposed on a rear surface of the rear wall 3522. The first bracket installation portion 3522*a* has a concave shape, and the bracket fastener 3534 is partially inserted, and an operator may align an assembly position of the bracket fastener 3534 using the first bracket installation portion 3522*a*.

A plurality of bracket fasteners 3534 are disposed, and in this embodiment, four bracket fasteners are disposed. The bracket fastener 3534 protrudes radially outward with respect to the central axis (C1) of the fan housing assembly 3400 and is disposed at equal distance with respect to the central axis (C1).

The first air guide bracket 3530 is coupled to the rear surface of the rear wall 3522 to prevent the rear end 3513 of the air guide 3510 from being separated when the fan housing assembly 3400 moves in the forward and rearward direction.

In addition, there is an advantage that, as the first air guide bracket 3530 is assembled to the rear surface of the rear wall 3522, the air guide 3510 may be easily replaced.

In addition, as the first air guide bracket 3530 pressurizes the entire rear end 3513 of the air guide 3510 to contact with the rear wall 3522, the entire rear end 3513 of the air guide 3510 is uniformly supported and may be prevented from tearing at a specific position. In particular, the fastening member to fix the first air guide bracket 3530 may not penetrate the air guide 3510 to prevent damage to the air guide 3510.

In this embodiment, the second air guide bracket 3540 uses a snap ring.

The second bracket installation portion 3415 is disposed on the rear surface of the rear fan housing 3410 to dispose the second air guide bracket 3540 using the snap ring.

The second bracket installation portion 3415 has a ring shape when viewed from the rear and is disposed outside of the fan suction inlet 3411. The second bracket installation portion 3415 is a rib extending rearward and outward from the rear surface of the rear fan housing 3410 and defines, at an outer side thereof, a groove 3416 into which the second air guide bracket 3540 is inserted. The groove 3416 opens radially outward with respect to the central axis (C1) of the fan housing assembly 3400 and is concaved towards the central axis (C1).

In addition, a guide wall 3417 is disposed on a rear surface of the rear fan housing 3410 to receive the air guide 3510 in a right position. The guide wall 3417 faces the second insertion wall 3528*b* and is disposed in front of the second insertion wall 3528*b*.

When viewed from the rear of the rear fan housing 3410, the guide wall 3417 has a donut shape.

<Actuator Configuration>

The actuator 3470 provides a driving force to move the fan housing assembly 3400 in a forward and rearward direction. The actuator 3470 may move the fan housing assembly 3400 in the forward and rearward direction based on a control signal of a controller.

When an indoor unit is operated, the actuator 3470 moves the fan housing assembly 3400 forward, and when the operation of the indoor unit is stopped, the actuator 3470 moves the fan housing assembly 3400 rearward.

The actuator 3470 may move the fan housing assembly 3400 in the forward and rearward direction. For example, the actuator 3470 may include a hydraulic cylinder or a linear motor to move the fan housing assembly 3400 in the forward and rearward direction.

In this embodiment, the actuator 3470 transmits a motor driving force to the fan housing assembly 3400 to move the fan housing assembly 3400 forward or rearward.

In this embodiment, as the first guide roller 3553 and the second guide roller 3554 disposed in the fan housing assembly 3400 each support the load of the fan housing assembly 3400, they may minimize the operating load of the actuator 3470 occurring based on the forward movement or the rearward movement of the assembly 3400.

In this embodiment, the central axis (C1) of the fan housing assembly and a center of the front discharge outlet 201 is identical to each other. The actuator 3470 moves the fan housing assembly 3400 forward or rearward along the central axis (C1).

The guide housing (e.g., in this embodiment, the upper guide housing or the lower guide housing) guides the forward and rearward movement of the fan housing assembly 3400.

The actuator 3470 includes a guide motor 3472 disposed on the fan housing assembly 3400 and to provide a driving force to move the fan housing assembly 3400 in the forward and rearward direction, a guide shaft 3474 disposed in the fan housing assembly 3400 and to receive a rotational force of the guide motor 3472 and rotate, a first guide gear 3476 coupled at a left side of the guide shaft 3474 and rotating with the guide shaft 3474, a second guide gear 3477 coupled to a right side of the guide shaft 3474 and rotating together with the guide shaft 3474, a first rack 3478 disposed in the lower guide housing 3460 and engaged with the first guide gear 3476, and a second rack 3479 disposed in the lower guide housing 3460 and engaged with the second guide gear 3477.

In this embodiment, the guide motor 3472, the first guide gear 3476, the second guide gear 3477, and the guide shaft 3474 are each disposed in the front fan housing 3430 and are moved together when the fan housing assembly 3400 moves forward or rearward.

The first rack 3478 engaged with the first guide gear 3476 and the second rack 3479 engaged with the second guide gear 3477 are each disposed in the lower guide housing 3460.

In contrast to this embodiment, the guide motor 3472, the first guide gear 3476, the second guide gear 3477, and the guide shaft 3474 are each disposed on the lower guide housing 3460 and the first rack 3478 and a second rack 3479 may be disposed under the front fan housing 3430.

The fan housing assembly 3400 moves forward or rearward by the engagement of the racks 3478 and 3479 with the guide gears 3476 and 3477.

In this embodiment, one guide motor 3472 is used and a guide shaft 3474 is disposed to uniformly move the front fan housing 3430. The first guide gear 3476 and the second guide gear 3477 are disposed at both ends of the guide shaft 3474. The guide shaft 3474 is horizontally disposed.

In this embodiment, the first guide gear 3476 is disposed on the left side of the guide shaft 3474 and the second guide gear 3477 is disposed on the right side of the guide shaft 3474.

Racks 3478 and 3479 engaged with the guide gears 3476 and 3477 are disposed on the left side and the right side of the lower guide housing 3460, respectively.

In this embodiment, the first guide gear 3476 and the second guide gear 3477 are disposed on the first rack 3478 and the second rack 3479, respectively. The first guide gear 3476 and the second guide gear 3477 moves in the forward and rearward direction along the first rack 3478 and the second rack 3479, respectively.

The first rack 3478 and the second rack 3479 are each disposed on the upper surface of the housing base 3462 of the lower guide housing 3460 and each protrudes upward from the housing base 3462.

The first rack 3478 and the second rack 3479 are disposed under the guide gears 3476 and 3477, respectively, and interfere with the guide gears 3476 and 3477 through the engagement, respectively.

The first guide gear 3476 is moved in the forward and rearward direction along the first rack 3478 and the second guide gear 3477 is also moved in the forward and rearward direction along the second rack 3479.

The guide motor 3472 may be disposed at the lower left or lower right of the front fan housing 3430. The motor shaft of the guide motor 3472 may be directly coupled to each of the first guide gear 3476 or the second guide gear 3477.

When the guide motor 3472 is rotated, the first guide gear 3476 and the second guide gear 3477 are simultaneously rotated based on the rotational force of the guide motor 3472 and the left side and the right side of the fan housing assembly 3400 may be moved forward or rearward based on the same force.

The guide motor 3472 is moved together with the fan housing assembly 3400 and the lower guide housing 3460 defines a motor guide groove 3469 to move the guide motor 3472. The motor guide groove 3469 is disposed in the forward and rearward direction, which is a moving direction of the guide motor 3472.

The housing base 3462 of the lower guide housing 3460 defines the motor guide groove 3469 and the motor guide groove 3469 is concaved downward from the housing base 3462.

The motor guide groove 3469 is disposed outside the first rack 3478 or the second rack 3479. The motor guide groove 3469 is concaved downward from the first rack 3478 or the second rack 3479.

The installation and movement space of the guide motor 3472 may be provided due to the motor guide groove 3469 and an overall height of the long-distance fan assembly 400 may be minimized. In particular, the motor guide groove 3469 is concaved downward to directly couple the guide motor 3472 to the first guide gear 3476 or the second guide gear 3477 and to minimize a number of power transmission components.

A first guide rail 3480 and the second guide rail 3490 are further disposed between the fan housing assembly 3400 (e.g., in this embodiment, the front fan housing 3430 and the lower guide housing 3460 to easily slide the fan housing assembly 3400.

The first guide rail 3480 couples the left side of the lower guide housing 3460 to the left side of the fan housing assembly. The first guide rail 3480 supports the load of the fan housing assembly and guides the moving direction of the fan housing assembly.

In this embodiment, the first guide rail 3480 is coupled to each of the left side wall 3463 of the lower guide housing 3460 and the front fan housing 3430 to generate the sliding.

The second guide rail 3490 connects the right side of the lower guide housing 3460 to the right side of the fan housing assembly. The second guide rail 3490 supports the load of the fan housing assembly and guides the moving direction of the fan housing assembly.

In this embodiment, the second guide rail 3490 is coupled to each of the right side wall 3464 of the lower guide housing 3460 and the front fan housing 3430 to generate the sliding.

The first guide rail 3480 and the second guide rail 3490 are bilaterally symmetrical to each other with respect to the central axis (C1) of the fan housing assembly.

The first guide rail 3480 and the second guide rail 3490 support a portion of the load of the fan housing assembly to easily implement the forward and rearward movement of the fan housing assembly.

The first guide rail 3480 and the second guide rail 3490 are disposed above the first rack 3478 and the second rack 3479, respectively. The first guide rail 3480 and the second guide rail 3490 support the left side and the right side of the fan housing assembly 3400, respectively, and guide the moving directions of the left side and the right side of the fan housing assembly 3400, respectively.

The first guide rail 3480 and the second guide rail 3490 are bilaterally symmetrical to each other relative to the central axis (C1) to move the left side and the right side of the fan housing assembly at the same speed and distance.

When the moving speed and distance of the left side or right side of the fan housing assembly are non-uniform, the long-distance assembly 400 may be moved from one side to the other side. In addition, when the moving speed and moving distance of the left side or the right side of the fan housing assembly are each non-uniform, the steering grill 3450 may not be accurately inserted into the front discharge outlet 201.

The first guide rail 3480 and the second guide rail 3490 minimize friction when the front fan housing 3430 is moved through rolling friction.

As the first guide rail 3480 and the second guide rail 3490 have the same configuration and are bilaterally symmetrical to each other, an example configuration of the first guide rail 3480 is described which is applicable to the second guide rail 3490.

The guide rail 3480 includes a long rail housing 3482 extending longitudinally in a forward and rearward direction and disposed in the guide housing (e.g., in this embodiment, the lower guide housing), a short rail housing 3484 extending in a forward and rearward direction and having a smaller length than that of the long rail housing 3482 and disposed in the fan housing assembly (e.g., in this embodiment, the front fan housing), and a bearing housing 3486 disposed between the long rail housing 3482 and the short rail housing 3484, assembled to be movable relative to each of the long rail housing 3482 and the short rail housing 3484, and to reduce friction with each of the long rail housing 3482 and the short rail housing 3484 through the rolling friction with the bearing 3485 when the short rail housing 3484 moves.

The bearing housing 3486 is assembled to the long rail housing 3482 and may be moved along a longitudinal direction of the long rail housing 3482. The short rail housing 3484 is assembled to the bearing housing 3486 and may be moved along the longitudinal direction of the bearing housing 3486.

For example, the short rail housing 3484 is assembled to be movable relative to the bearing housing 3486 and the bearing housing 3486 is assembled to be movable relative to the long rail housing 3482.

The bearing housing 3486 is shorter than the long rail housing 3482 and is longer than the short rail housing 3484. The bearing housing 3486 and the short rail housing 3484 may each slide within the length of the long rail housing 3482.

The length of the long rail housing 3482 corresponds to a length (F2) in the forward and rearward direction of the lower guide housing 3460. In this embodiment, the left side wall 3463 and the right side wall 3464 includes the rail installation portions 3463*a* and 3464*a* on inner surfaces thereof, to which the long rail housing 3482 is coupled. In this embodiment, the rail installation portions 3463*a* and 3464*a* are each disposed above the cable penetration portion 3465.

Figure 42:
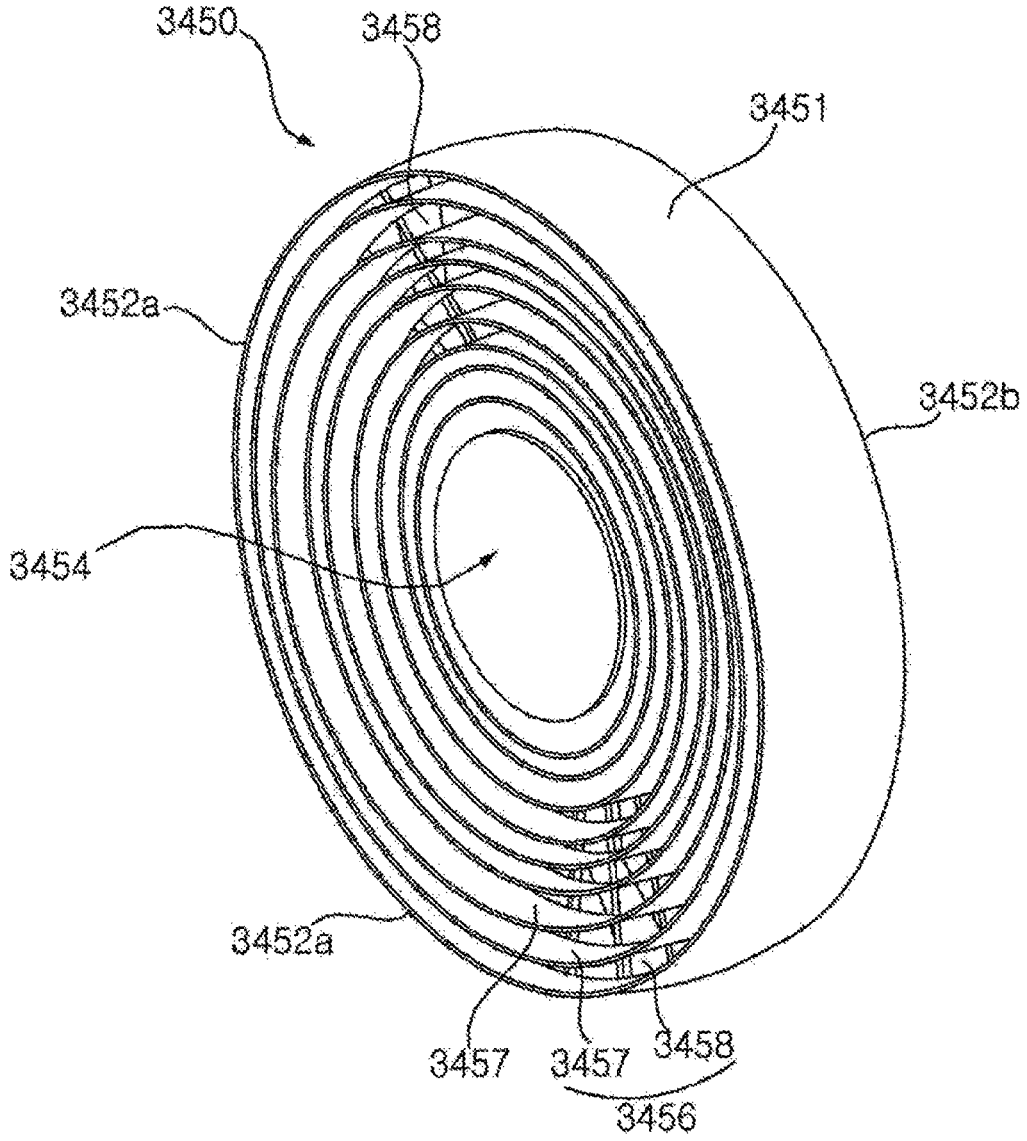
FIG. 42 is a perspective view showing a steering grill in FIG. 31.
Figure 43:
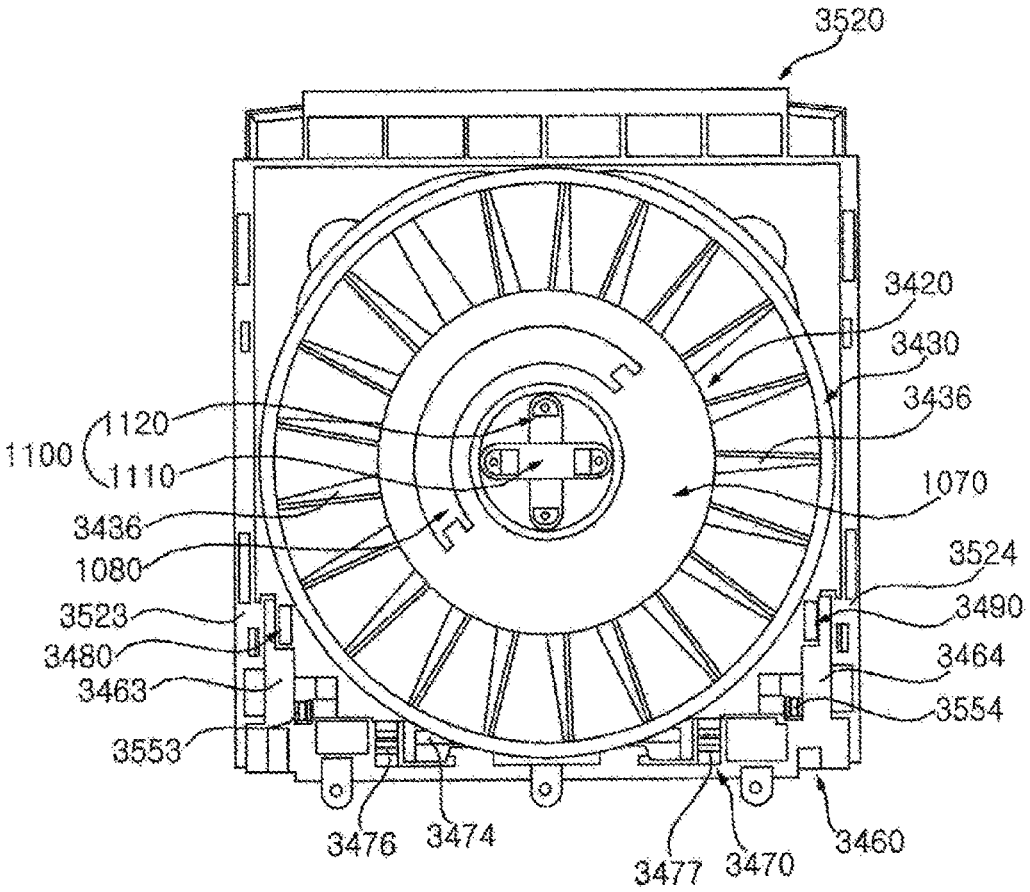
FIG. 43 is a front view showing a steering grill separated from a fan housing assembly in FIG. 31.
Figure 44:
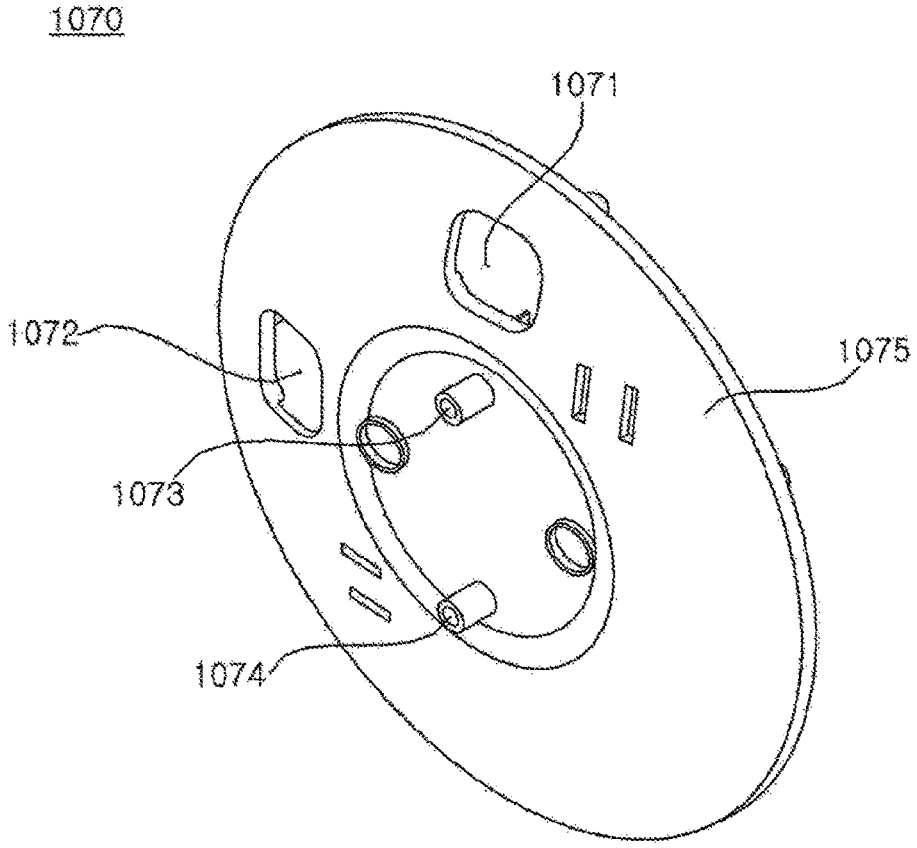
FIG. 44 is a perspective view showing a steering base in FIG. 36.
Figure 45:
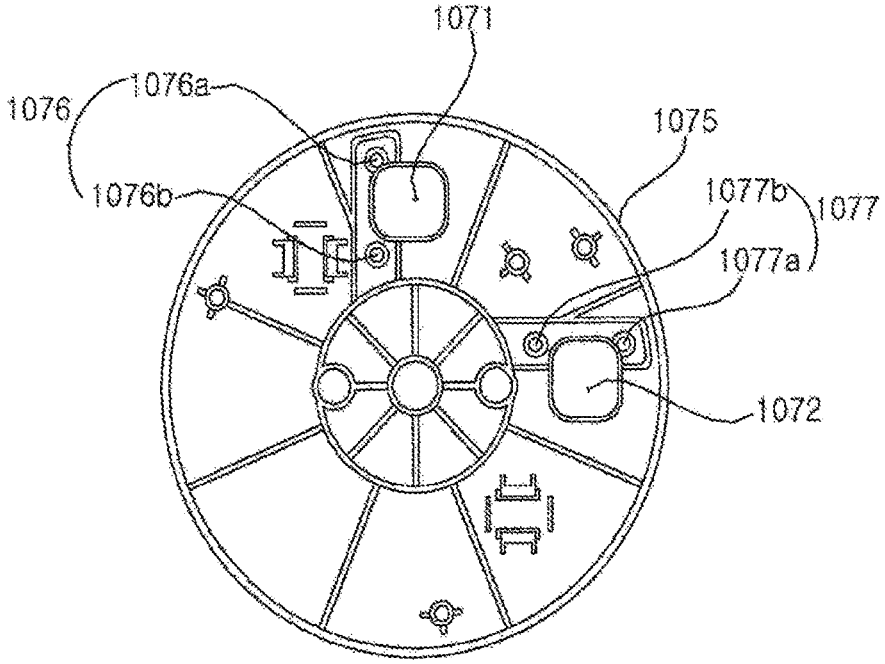
FIG. 45 is a rear view showing the steering base in FIG. 44.
Figure 46:
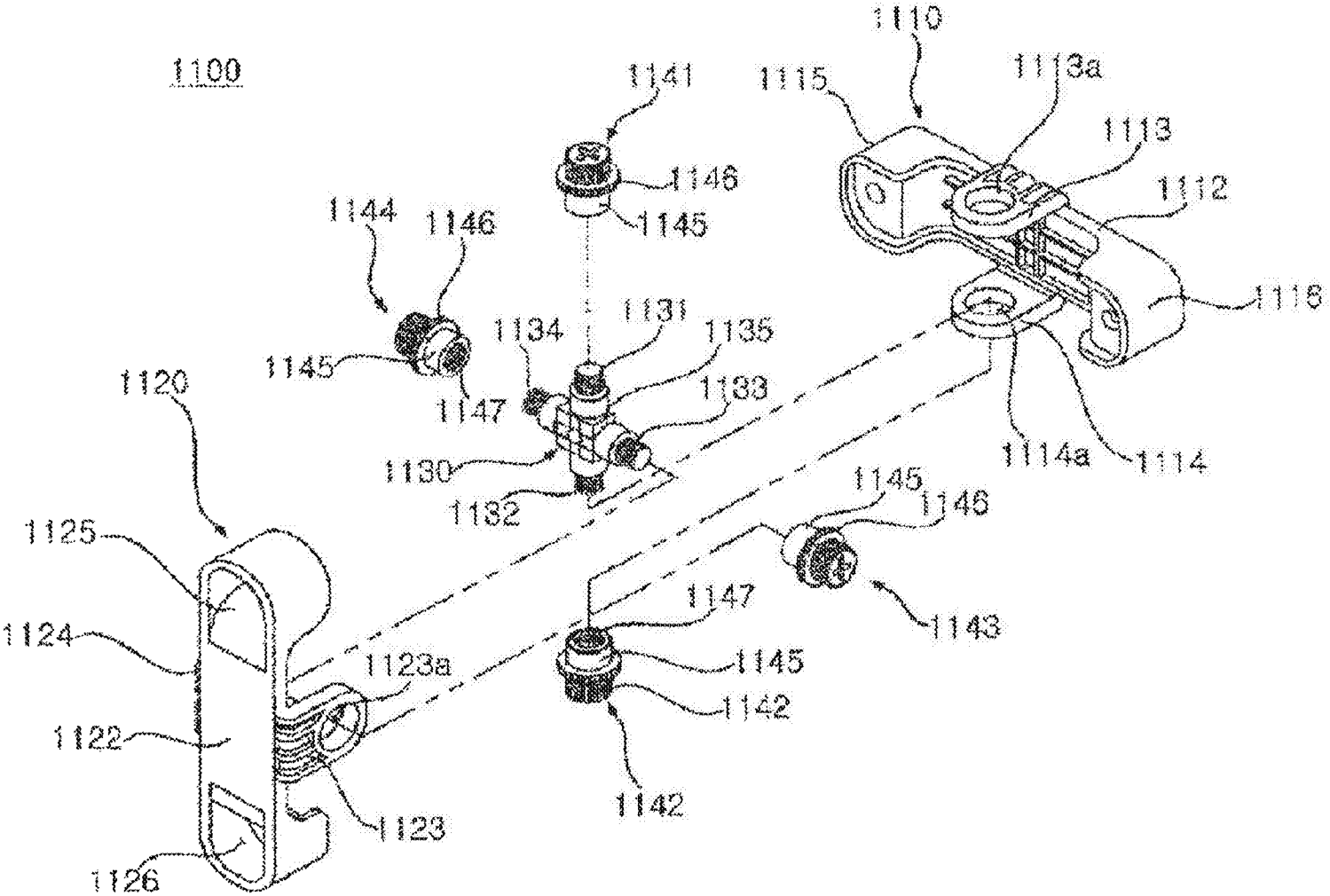
FIG. 46 is an exploded perspective view showing a joint assembly in FIG. 36.
Figure 47:
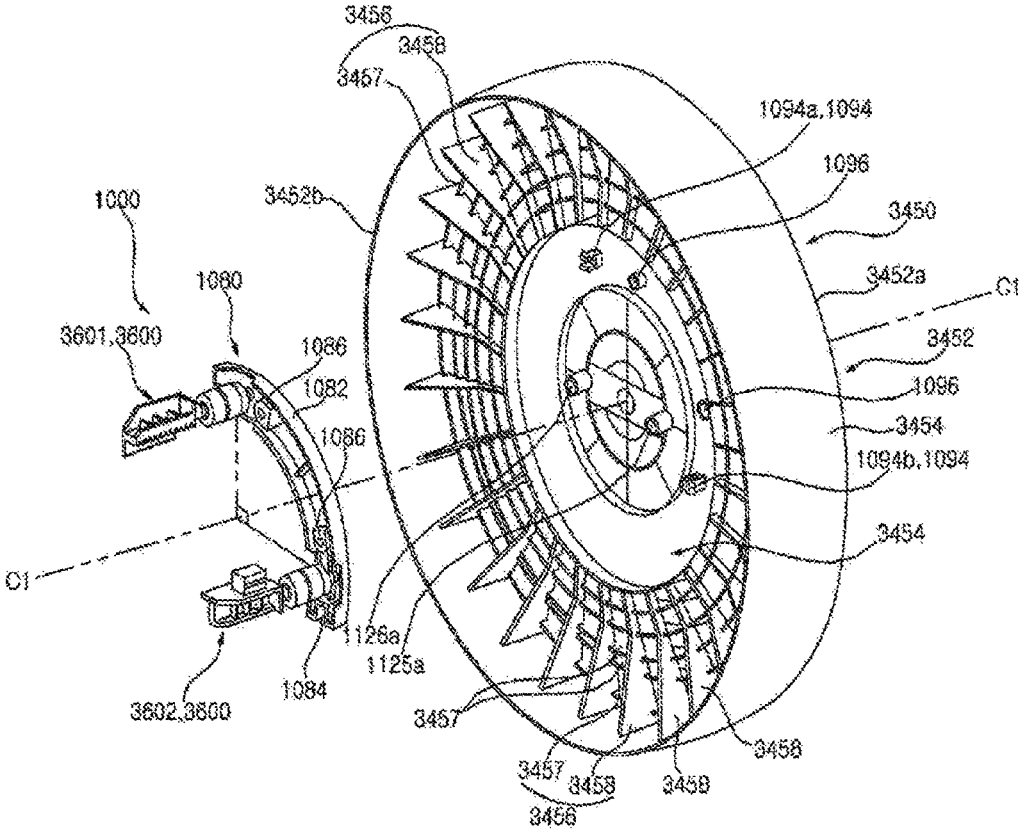
FIG. 47 is an exploded perspective view showing a rear side of a steering grill and a steering assembly in FIG. 36.
Figure 48:
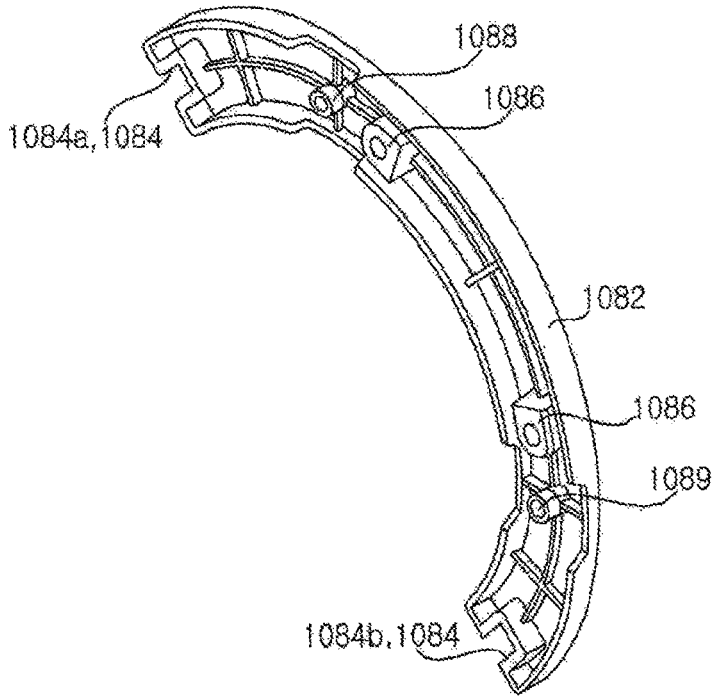
FIG. 48 is a rear perspective view showing a hub in FIG. 47.
Figure 49:
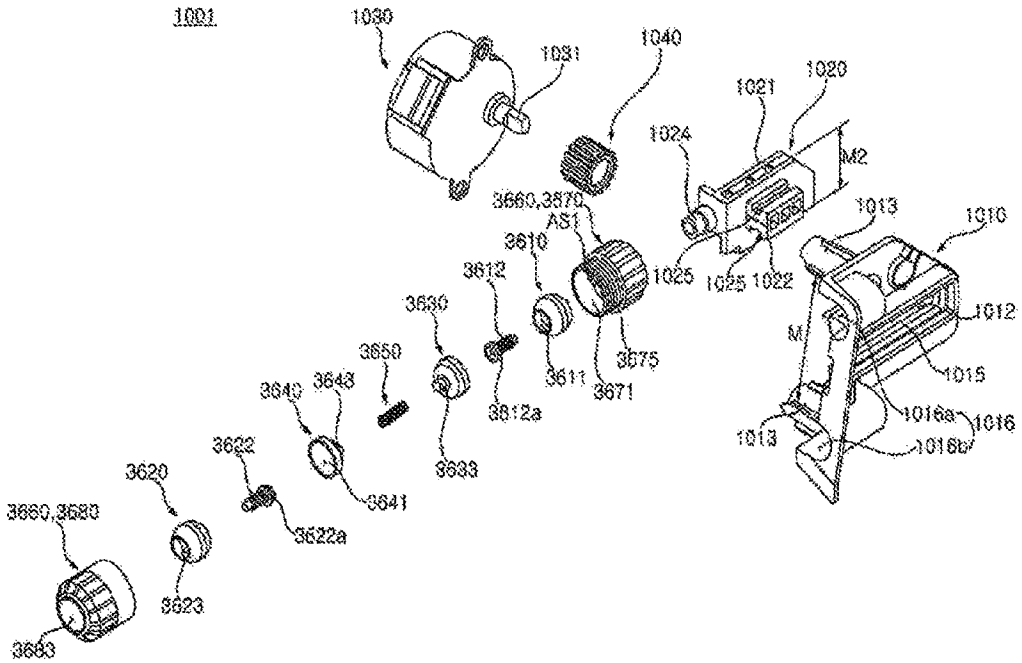
FIG. 49 is an exploded perspective view showing a steering assembly in FIG. 36.
Figure 50:
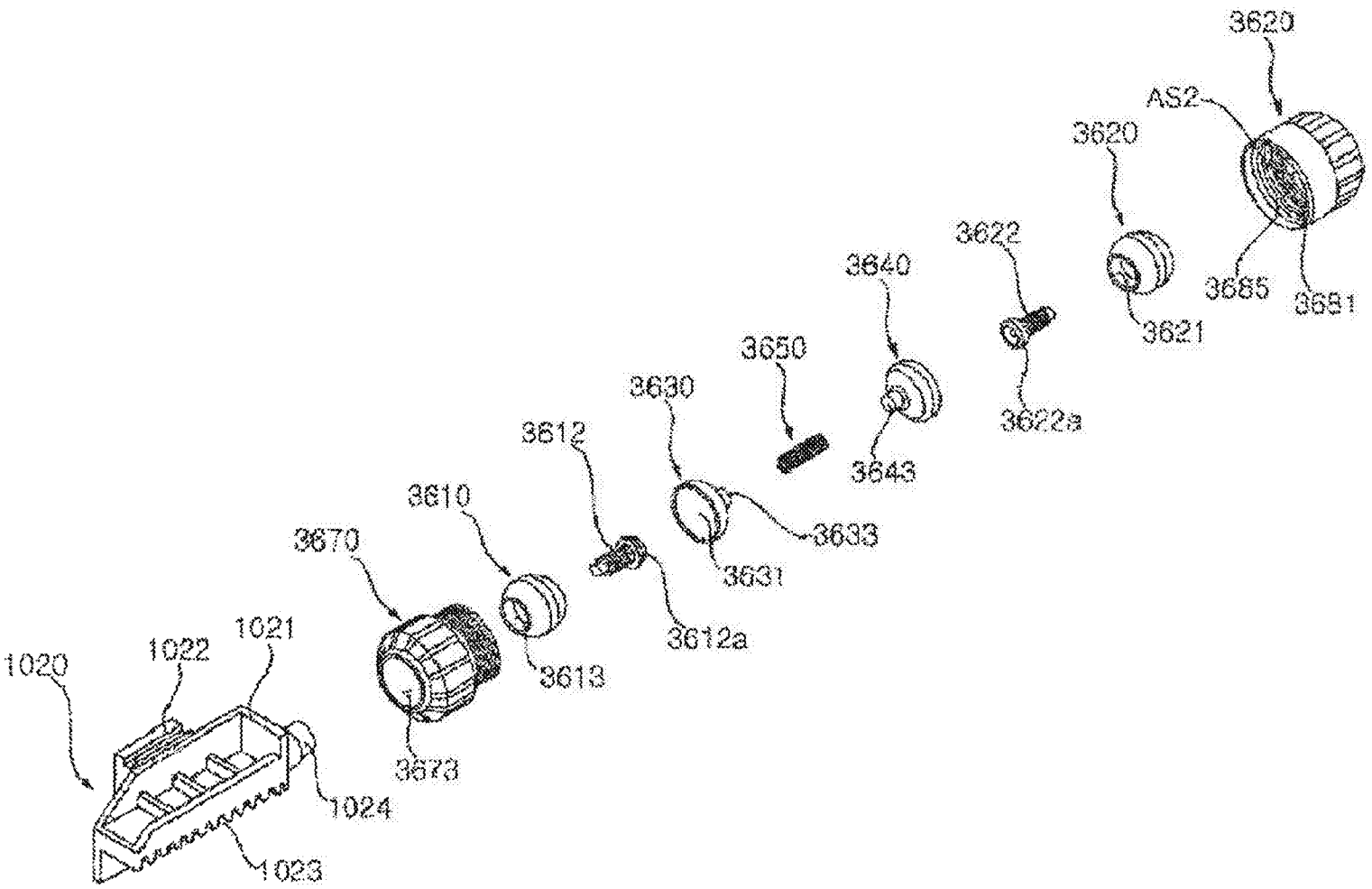
FIG. 50 is an exploded perspective view showing the steering assembly in FIG. 49 viewed from the rear.
Figure 51:
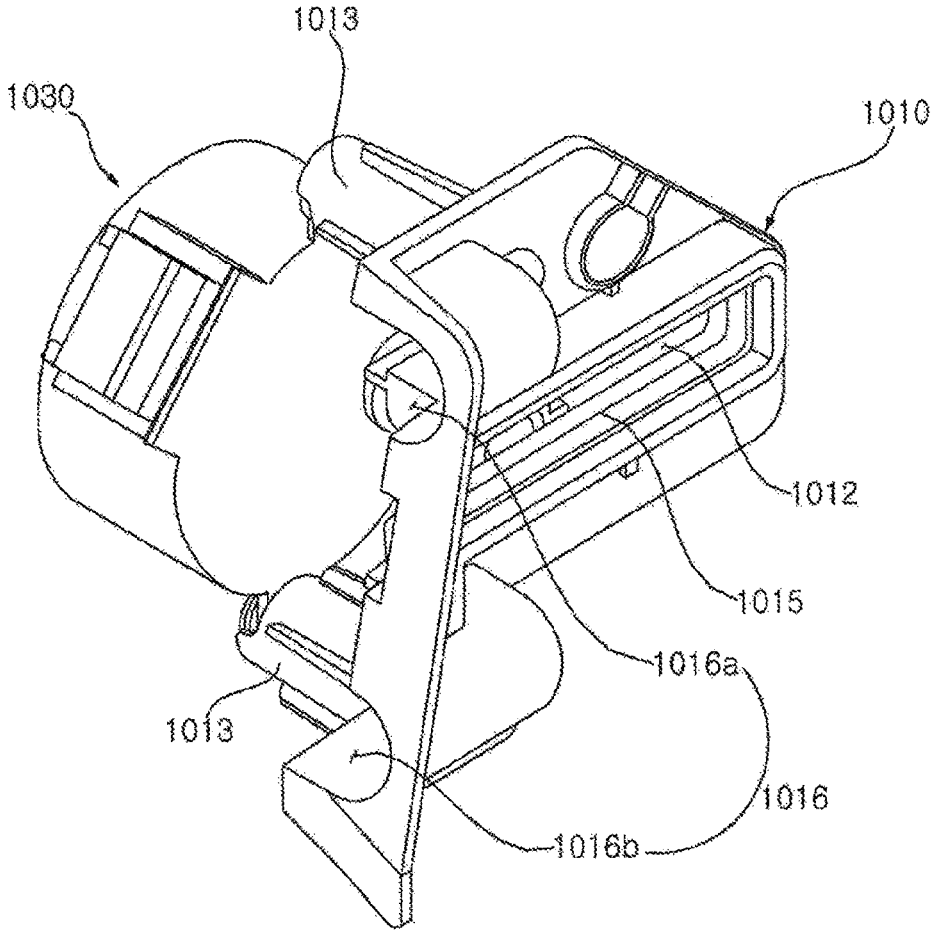
FIG. 51 is a perspective view showing an assembled steering body and steering motor in FIG. 49.
Figure 52:
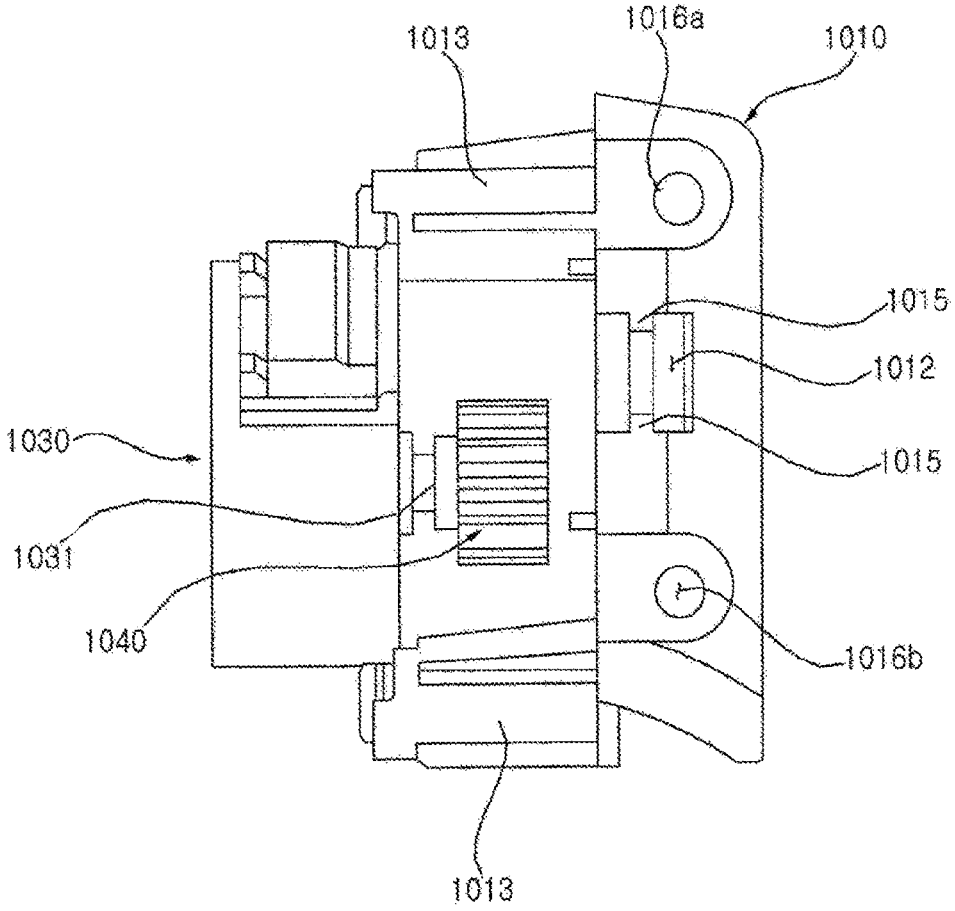
FIG. 52 is a front view showing the assembled steering body and steering motor in FIG. 51.
Figure 53:
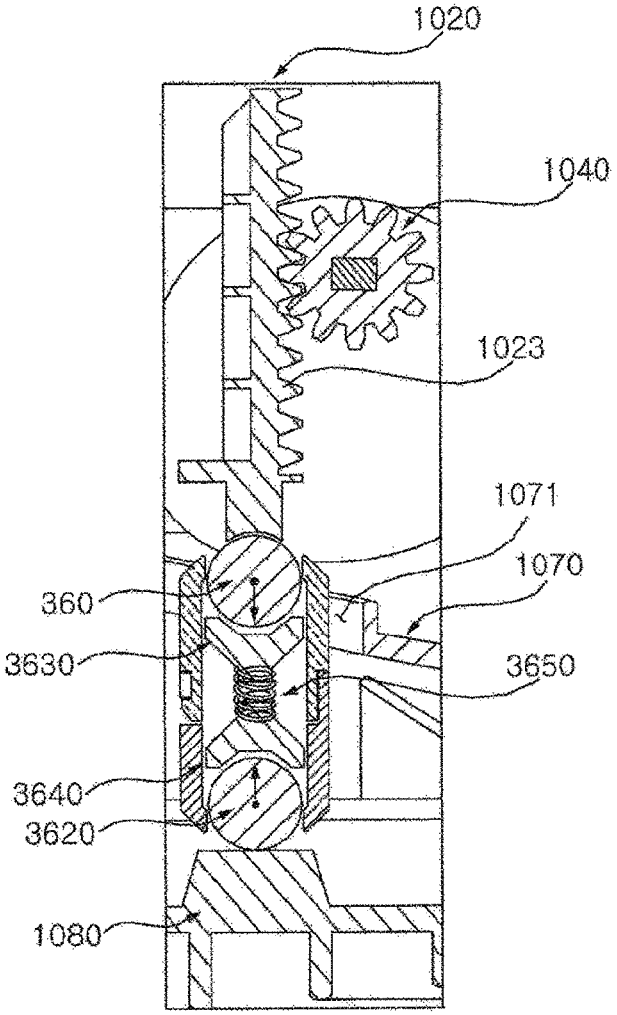
FIG. 53 is a cross-sectional view showing a coupling structure of a steering assembly according to an embodiment of the present disclosure.
Figure 54:
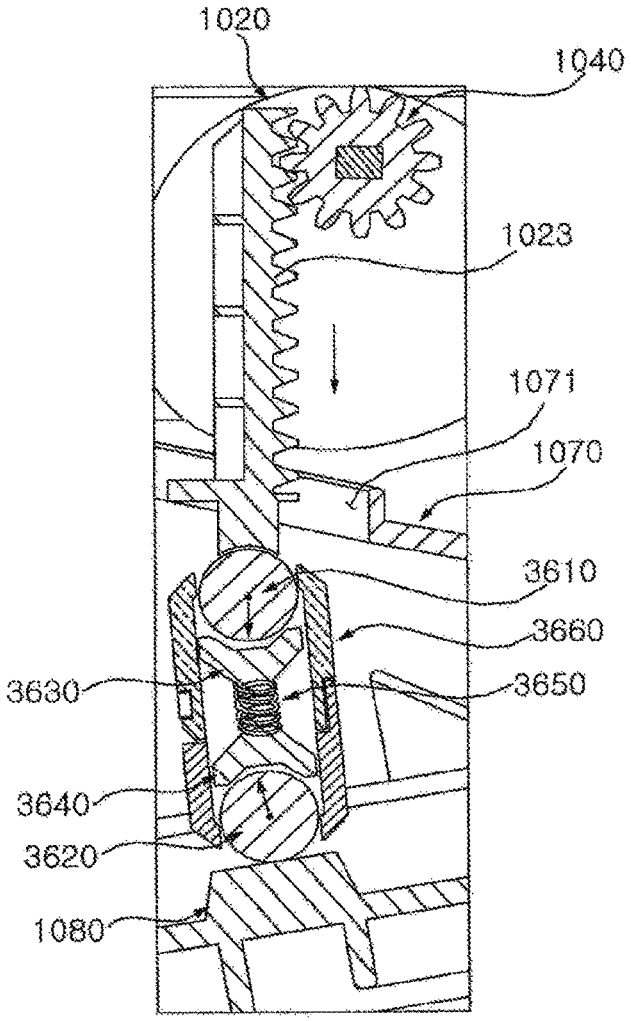
FIG. 54 is an exemplary view showing an operation of the steering assembly in FIG. 53.

FIG. 42 is a perspective view showing a steering grill in FIG. 31. FIG. 43 is a front view showing a steering grill separated from a fan housing assembly in FIG. 31. FIG. 44 is a perspective view showing a steering base in FIG. 36. FIG. 45 is a rear view showing the steering base in FIG. 44. FIG. 46 is an exploded perspective view showing a joint assembly in FIG. 36. FIG. 47 is an exploded perspective view showing a rear side of a steering grill and a steering assembly in FIG. 36. FIG. 48 is a rear perspective view showing a hub in FIG. 47. FIG. 49 is an exploded perspective view showing a steering assembly in FIG. 36. FIG. 50 is an exploded perspective view showing the steering assembly in FIG. 49 viewed from the rear. FIG. 51 is a perspective view showing an assembled steering body and steering motor in FIG. 49. FIG. 52 is a front view showing the assembled steering body and steering motor in FIG. 51. FIG. 53 is a cross-sectional view showing a coupling structure of a steering assembly according to an embodiment of the present disclosure. FIG. 54 is an exemplary view showing an operation of the steering assembly in FIG. 53.

<Configuration of Steering Grill>

The steering grill 3450 is disposed at a front side of the front fan housing 3430. A rear end of the steering grill 3450 is partially inserted into the front fan housing 3430. The steering grill 3450 may be tilted in an upward direction, a downward direction, a leftward direction, a rightward direction, or a diagonal direction when the steering grill 3450 is inserted into the front fan housing 3430.

The rear end of the steering grill 3450 is inserted into a space (S2) of the front fan housing 3430 through a first fan opening surface 3431 of the front fan housing 3430. The rear end of the steering grill 3450 is disposed in front of the inner fan housing 3434.

The steering grill 3450 has a shape corresponding to the first fan opening surface 3431 of the front fan housing 3430. When viewed from the front, the first fan opening surface 3431 has a circular shape and the steering grill 3450 has a circular shape having a less diameter than that of the first fan opening surface 3431.

The steering grill 3450 includes a steering housing 3452 having openings at a front surface and a rear surface thereof and defining a space (S4), a steering cover 3454 disposed inside the steering housing 3452 and facing towards the front surface thereof, and a plurality of vanes 3456 disposed in the space (S4) of the steering housing 3452 and connecting the steering housing 3452 to the steering cover 3454.

The front shape of the steering housing 3452 corresponds to the shape of the first fan opening surface 3431 of the outer fan housing 3432. When viewed from the front, the steering housing 3452 has a circular shape.

An outer surface 3451 of the steering housing 3452 has a surface curved in the forward and rearward direction. When the steering grill 3450 is tilted, the outer surface 3451 of the steering housing 3452 having the curved surface may maintain a constant distance from the front fan housing 3430 (e.g., in this embodiment, the outer fan housing 3432).

The outer surface 3451 of the steering housing 3452 may correspond to a radius of rotation of the steering grill 3450. A center of curvature of the outer surface 3451 of the steering housing 3452 may be disposed on the central axis (C1). For example, the outer surface 3451 may have an arc shape with the central axis (C1).

The steering grill 3450 is tilted when the steering grill 3450 is inserted into the front fan housing 3430. A uniform distance (P) between the outer surface 3451 of the steering housing 3452 and the inner surface of the outer fan housing 3432 may be maintained during tilting due to the structure of the outer surface 3451 of the steering housing 3452 having the arc shape.

During tilting, as the distance (P) between the outer surface 3451 of the steering housing 3452 and the inner surface of the outer fan housing 3432 is minimized, an amount of discharged air leaking to an outside of the steering grill 3450 may be minimized.

When the air discharged through the distance (P) is cooled air, the edge of the front discharge outlet 201 may be cooled to generate dew formation. When the distance (P) is minimized, the dew condensation generated at the edge of the front discharge outlet 201 may be minimized.

In this embodiment, an axis center of the steering housing 3452 is disposed on the axis center (C1) of the fan housing assembly 3400 and is identical to that of the motor shaft of the fan motor 3440.

The steering cover 3454 is disposed in the space (S4) and is vertically disposed. The area and the shape of the steering cover 3454 correspond to the area and the shape of the steering base 1070.

The first steering assembly 1001 and the second steering assembly 1002 described below are each disposed at a rear side of the steering cover 3454. The first steering assembly 1001 and the second steering assembly 1002 are each covered by the steering cover 3454. The steering cover 3454 has the area less than the area of the steering base 1070 and is disposed at the front side of the steering base 1070.

The discharged air flows between the outside of the steering cover 3454 and the inside of the steering housing 3452. As the steering cover 3454 is disposed at the front side of the steering base 1070, air does not flow directly to the steering cover 3454.

The steering cover 3454 is disposed between the front end 3452*a* and the rear end 3452*b* of the steering housing 3452.

The steering cover 3454 is connected to a steering assembly 1000 and receives an operating force of the steering assembly 1000.

The vane 3456 includes a circular vane 3457 and a blade vane 3458.

A plurality of circular vanes 3457 are provided, and the circular vanes 3457 have different diameters, and centers of the circular vanes 3457 are disposed on the central axis (C1). For example, the circular vanes 3457 are concentric with each other with respect to the central axis (C1).

A plurality of blade vanes 3458 are provided and the plurality of blade vanes 3458 are radially disposed with respect to the central axis (C1). The circular vane 3457 crosses with the blade vane 3458.

An inner end of the blade vane 3458 is coupled to the steering cover 3454 and an outer end thereof is coupled to the steering housing 3452.

In this embodiment, the steering housing 3452, the steering cover 3454, the circular vane 3457, and the blade vane 3458 are integrated with one another through injection molding.

The steering grill 3450 may be tilted in an upward direction, a downward direction, a leftward direction, a rightward direction, or in any diagonal direction with respect to the axis center (C1). The steering grill 3450 may protrude forward from the front discharge outlet 201.

When the fan housing assembly 3400 moves forward, the front end 3452*a* of the steering housing 3452 is disposed in front of the front discharge outlet 201 and the rear end 3452*b* of the steering housing 3452 is disposed behind the front discharge outlet 201.

Even when the steering grill 3450 is tilted, the front end 3452*a* of the steering housing 3452 is disposed in front of the front discharge outlet 201 and the rear end 3452*b* of the steering housing 3452 is disposed behind the front discharge outlet 201.

<Configuration of Steering Assembly>

The steering assembly 1000 is disposed between the steering grill 3450 and a front fan housing 3430. The steering assembly 1000 is disposed at a position where interference with discharged air is minimized.

The steering assembly 1000 is disposed at a front side of the inner fan housing 3434 to minimize interference with the discharged air. In particular, the steering assembly 1000 is disposed at a front side of the fan motor 3440.

In this embodiment, a steering base 1070 is disposed to cover a space (S3) of the inner fan housing 3434 and the steering assembly 1000 is disposed on the steering base 1070. In contrast to this embodiment, the steering assembly 1000 may be disposed on a structure of the front fan housing 3430. For example, the steering assembly 1000 may be disposed on an inner fan housing 3434 or a motor mount 3442 to tilt the steering grill 3450.

The steering assembly 1000 provides a structure in which the steering grill 3450 has no restriction on a tilting direction or sequence. For example, the steering assembly 1000 provides a structure capable of horizontally tilting the steering grill 3450 or tilting in a diagonal direction after vertically tilting the steering grill 3450.

The steering assembly 1000 may immediately tilt the steering grill 3450 from a first direction to a second direction, and as there is no restriction in the tilting direction, the steering of the steering grill 3450 may be immediately implemented.

In this embodiment, the first direction is set to be a horizontal direction and the second direction is set to be a vertical direction. In contrast to this embodiment, the first direction and the second direction may each be arbitrarily changed. In this embodiment, the first direction and the second direction form an angle of 90 degrees.

The steering assembly 1000 includes a steering base 1070 disposed on the front fan housing 3430 and coupled to the rear side of the steering grill 3450, a joint assembly 1100 coupled to each of the steering base 1070 and the steering grill 3450, tiltably assembled to each of the steering base 1070 and the steering grill 3450, a first steering assembly 1001 disposed on the steering base 1070, assembled to be rotatable with the steering grill 3450, to push or pull the steering grill 3450 through the operation of a first steering actuator (e.g., a steering motor 1030 in this embodiment), and tilt the steering grill 3450 around the joint assembly 1100, and a steering assembly 1002 disposed on the steering base 1070, assembled to be rotatable relative to the steering grill 3450, to push or pull the steering grill 3450 through the operation of a second steering actuator (e.g., in this embodiment, the steering motor 1030), and tilt the steering grill 3450 around the joint assembly 1100.

The first steering assembly 1001 and the second steering assembly 1002 are each disposed at the rear side of the steering grill 3450.

The first steering assembly 1001 is assembled to the rear surface of the steering grill 3450 and moves the assembled portion of the steering grill 3450 in the forward and rearward direction. The second steering assembly 1002 is also assembled to the rear surface of the steering grill 3450 and moves the assembled portion of the steering grill 3450 in the forward and rearward direction.

In this embodiment, the first steering assembly 1001 and the second steering assembly 1002 are each disposed in the forward and rearward direction.

When viewed from the front or the rear, a portion at which the first steering assembly 1001 pushes or pulls the steering grill 3450 and a portion at which the second steering assembly 1002 pushes or pulls the steering grill 3450 forms an angle of 90 degrees with respect to the central axis (C1).

In this embodiment, the portion where the first steering assembly 1001 pushes or pulls the steering grill 3450 is vertically disposed above the central axis (C1). The portion where the second steering assembly 1002 pushes or pulls the steering grill 3450 may be disposed on the left side or right side of the central axis (C1).

The joint assembly 1100 provides a tilting center of the steering grill 3450. The tilting center of the joint assembly 1100 is disposed on the central axis (C1) passing the center of the front discharge outlet 201 in the forward and rearward direction.

The joint assembly 1100 is coupled to the rear surface of the steering grill 3450. The joint assembly 1100 provides a rotational center in which the steering grill 3450 may be tilted in any direction. The joint assembly 1100 provides the rotational center to face the steering grill 3450 upward, downward, leftward, rightward, leftward and upward, leftward and downward, rightward and upward, and rightward and downward when viewed from the front.

A ball joint may be used as the joint assembly 1100. The ball joint may not provide a structure to support the load of the steering grill 3450, which generates deflection.

The joint assembly 1100 provides a structure to support the load of the steering grill 3450 when the steering grill 3450 is tilted.

In this embodiment, the joint assembly 1100 includes a first joint bracket 1110 assembled to the steering base 1070 and to provide a rotational axis in a first direction (e.g., in this embodiment, a horizontal direction), a second joint bracket 1120 assembled to the steering grill 3450 and to provide a rotational axis in a second direction (e.g., in this embodiment, a vertical direction), and a cross axle 1130 assembled to be rotatable relative to each of the first joint bracket 1110 and the second joint bracket 1120 and to provide the rotational axis in the first direction and the second direction.

As the first joint bracket 1110 and the second joint bracket 1120 have the same configuration, the installation positions thereof may be reversed. When the installation positions are reversed, the first joint bracket 1110 provides the rotational axis in the second direction and the second joint bracket 1120 provides the rotational axis in the first direction.

The first joint bracket 1110 includes a first bracket body 1112 assembled to the steering base 1070, a 1-1 shaft supporter 1113 disposed on the first bracket body 1112 and protruding towards the second joint bracket 1120, and a 1-2 shaft supporter 1114 disposed on the first bracket body 1112, protruding towards the second joint bracket 1120, and facing the 1-1 shaft supporter 1123.

The first bracket body 1112 extends longitudinally, and in this embodiment, the first bracket body 1112 is horizontally disposed. The first bracket body 1112 defines fastening grooves 1115 and 1116 at a first side and a second side of the first bracket body 1112, respectively. The first bracket body 1112 defines the fastening grooves 1115 and 1116 that are each concaved and face the steering base 1070.

In this embodiment, the 1-1 shaft supporter 1113 is disposed on the first bracket body 1112 and the 1-2 shaft supporter 1114 is disposed under first bracket body 1112. The 1-1 shaft supporter 1113 and the 1-2 shaft supporter 1114 are disposed vertically.

The second joint bracket 1120 includes a second bracket body 1122 assembled to the steering grill 3450, a 2-1 shaft supporter 1123 disposed on the second bracket body 1122 and protruding towards the first joint bracket 1110, and a 2-2 shaft supporter 1124 disposed on the second bracket body 1122, protruding towards the first joint bracket 1110, and facing the 2-1 shaft supporter 1123.

The second bracket body 1122 extends longitudinally, and in this embodiment, the second bracket body 1122 is vertically disposed. The second bracket body 1122 defines fastening grooves 1125 and 1126 at a first side and a second side of the second bracket body 1122. The fastening grooves 1125 and 1126 defined in the second bracket body 1122 are each concaved and are disposed towards the steering grill 3450.

The 2-1 shaft supporter 1123 and the 2-2 shaft supporter 1124 each define a shaft hole 1123*a* and a shaft hole (not shown) and the shaft hole 1123*a* and the shaft hole (not shown) face each other. The shaft hole 1123*a* and the shaft hole (not shown) are each horizontally disposed.

In this embodiment, the 2-1 shaft supporter 1123 is disposed on the right side thereof and the 2-2 shaft supporter 1124 is disposed on the left side thereof. The 2-1 shaft supporter 1123 and the 2-2 shaft supporter 1124 are horizontally disposed.

The cross axle 1130 provides a vertical rotary shaft and a horizontal rotary shaft. The cross axle 1130 is preferably disposed on the axis center (C1) line.

The cross axle 1130 includes a "+"-shaped cross body 1135, a 1-1 rotary shaft 1131 disposed on the cross body 1135 in the second direction (e.g., in this embodiment, the vertical direction) and rotatably assembled to the 1-1 shaft supporter 1113, a rotary shaft 1131 disposed on the cross body 1135 in the second direction (e.g., in this embodiment, the vertical direction), rotatably assembled to the 1-2 shaft supporter 1114, and disposed at an opposite side of the 1-1 rotary shaft 1131, a 2-1 rotary shaft 1133 disposed on the cross body 1135 in the first direction (e.g., in this embodiment, a horizontal direction) and rotatably assembled to the 2-1 shaft supporter 1123, and a 2-2 rotary shaft 1134 disposed on the cross body 1135 in the first direction (e.g., in this embodiment, the horizontal direction), rotatably assembled to the 2-2 shaft supporter 1124, and disposed at the opposite side of the 2-1 rotary shaft 1133.

The rotary shafts 1131, 1132, 1133, and 1134 may be inserted into the shaft supporters 1113, 1114, 1123, and 1124, respectively, and may rotate. In this case, due to the length of the cross axle 1130, the shaft supporters 1113, 1114, 1123, and 1124 may be separately manufactured and then assembled to the bracket bodies 1112 and 1122.

In this embodiment, for convenience of assembly and disassembly, the first joint bracket 1110 and the second joint bracket 1120 are integrated with each other through injection molding.

The rotary shafts 1131, 1132, 1133, and 1134 of the cross axle 1130 each include screw threads and shaft caps 1141, 1142, 1143, and 1144 are coupled to the rotary shafts 1131, 1132, 1133, and 1134 by the screws, respectively.

The shaft caps 1141, 1142, 1143, and 1144 have the same configuration, and for convenience of description, a shaft cap assembled to the 1-1 rotary shaft 1131 is referred to as a 1-1 shaft cap 1141. The shaft cap assembled to the 1-2 rotary shaft 1132 is referred to as a 1-2 shaft cap 1142, the shaft cap assembled to the 2-1 rotary shaft 1133 is referred to as a 2-1 shaft cap 1143, and the shaft cap assembled to the 2-2 rotary shaft 1134 is referred to as a 2-2 shaft cap 1144.

The shaft cap has a cylindrical shape and includes a shaft cap body 1145 inserted into and rotated in the shaft hole, a shaft cap supporter 1146 protruding radially and outwardly from the shaft cap body 1145, and supported by the shaft supporter, and a female screw thread 1147 disposed in the shaft cap body 1145.

The 1-1 shaft cap 1141 is inserted into the 1-1 shaft supporter 1113 and is assembled to the 1-1 rotary shaft 1131. The 1-2 shaft cap 1142 is inserted into the 1-2 shaft supporter 1114 and is assembled to the 1-2 rotary shaft 1132. An assembly direction of the 1-1 shaft cap 1141 and an assembly direction of the 1-2 shaft cap 1142 are opposite to each other.

In this embodiment, the 1-1 shaft cap 1141 and the 1-2 shaft cap 1142 are each vertically disposed and may be rotated in the horizontal direction.

The 2-1 shaft cap 1143 is inserted into the 2-1 shaft supporter 1123 and is assembled to the 2-1 rotary shaft 1133. The 2-2 shaft cap 1144 is inserted into the 2-2 shaft supporter 1124 and assembled to the 2-2 rotary shaft 1134. The assembly direction of the 2-1 shaft cap 1143 and the assembly direction of the 2-2 shaft cap 1144 are opposite to each other.

In this embodiment, the 2-1 shaft cap 1143 and the 2-2 shaft cap 1144 are each horizontally disposed and may be rotated in the vertical direction.

The steering grill 3450 defines, on a rear surface, fastening bosses 1125*a* and 1126*a* to which the second joint bracket 1120 is coupled. The fastening grooves 1125 and 1126 of the second joint bracket 1120 are inserted into the fastening bosses 1125*a* and 1126*a* of the steering grill 3450 and the second joint bracket 1120 is coupled to the steering grill 34350 through a fastening member (not shown).

The steering base 1070 covers the space (S3) of the inner fan housing 3434.

The steering base 1070 includes a base body 1075 coupled to the inner fan housing 3434, fastening bosses 1073 and 1074 defined on the front surface of the base body 1075 and to which the first joint bracket 1110 is assembled, a first through-hole 1071 penetrating the base body 1075 in the forward and rearward direction and through which the first steering assembly 1001 passes, a second through-hole 1072 penetrating the base body 1075 in the forward and rearward direction and through which the second steering assembly 1002 passes, a first base installation portion 1076 disposed on the rear surface of the base body 1075 and in which the first steering assembly 1001 is disposed, and a second base installation portion 1077 disposed on the rear surface of the base body 1075 and in which the second steering assembly 1002 is disposed.

The first steering assembly 1001 may be disposed at the front side of the steering base 1070. In this embodiment, the first steering assembly 1001 is disposed in the space (S3) to prevent an increase in the length of the fan housing assembly 3400 in the forward and rearward direction due to the installation of the first steering assembly 1001. The first steering assembly 1001 is disposed in the space (S3), is assembled to the rear surface of the steering base 1070, and is assembled to the steering grill 3450 through the first through-hole 1071.

For the same reason, the second steering assembly 1002 is disposed in the space (S3), is assembled to the rear surface of the steering base 1070, and is assembled to the steering grill 3450 through the first through-hole 1071.

The first steering assembly 1001 pushes or pulls the steering grill 3450 and the steering grill 3450 is tilted in the vertical direction with respect to the joint assembly 1100.

The second steering assembly 1002 pushes or pulls the steering grill 3450 and the steering grill 3450 is tilted in a horizontal direction with respect to the joint assembly 1100.

The steering grill 3450 may be tilted diagonally relative to the joint assembly 1100 by combining the operating direction of the first steering assembly 1001 with the operating direction of the second steering assembly 1002.

The first base installation portion 1076 fixes the first steering assembly 1001 and has a boss shape in this embodiment. The second base installation portion 1077 fixes the second steering assembly 1002 and has a boss shape in this embodiment.

The first base installation portion 1076 protrudes rearward from the rear surface of the steering base 1070 and is inserted into the steering body 1010 described below. A fastening member (not shown) is fastened through the steering body 1010 and the first base installation portion 1076.

When the steering body 1010 is fastened, the first base installation portions 1076 are disposed at two places to temporarily fix the fastening position of the steering body 1010. A first one thereof is referred to as a 1-1 base installation portion 1076*a* and a second one thereof is referred to as a 1-2 base installation portion 1076*b*.

The structure of the second base installation portion 1077 is the same as the structure of the first base installation portion 1076.

The second base installation portion 1077 is also disposed in two places. A first one thereof is referred to as a 2-1 base installation portion 1077*a* and a second one thereof is referred to as a 2-2 base installation portion 1077*b*.

<Steering Assembly Configuration>

The first steering assembly 1001 and the second steering assembly 1002 have the same components and positions thereof assembled to a steering grill 3450 are only different. In this embodiment, an example configuration of the first steering assembly 1001 is described. When the components of the first steering assembly 1001 are needed to be distinguished from the components of the second steering assembly 1002, they are classified into "the first" or "the second".

The first steering assembly 1001 includes a steering body 1010 coupled to the front fan housing 3430 or a steering grill 3450, a steering actuator (e.g., in this embodiment, a steering motor 1030) assembled to the steering body 1010, a moving rack 1020 movably assembled to the steering body 1010 and moving based on operation of the steering actuator, a rack guide 1012 disposed on the steering body 1010, movably assembled to the moving rack 1020 and to guide a moving direction of the moving rack 1020, a steering gear 1040 coupled to the motor shaft 1031 of the steering motor 1030, engaged with the moving rack 1020 and to provide a driving force to the moving rack 1020 based on the operation of the steering motor 1030, and an adjust assembly 3600 assembled to be rotatable relative to the moving rack 1020, assembled to be rotatable relative to the steering grill 3450, and to adjust a distance and an angle between the steering grill 3450 and the moving rack 1020 when the moving rack 1020 moves.

The steering body 1010 may be coupled to the front fan housing 3430 or the steering grill 3450. In this embodiment, the steering body 1010 is disposed on the structure of the front fan housing 3430 in consideration of power supply and cable connection of the steering actuator.

When the steering body 1010 is disposed on the steering grill 3450 which is tilted based on a control signal, there is a problem in that the cable is also tilted. In addition, when the steering body 1010 is assembled to the steering grill 3450, the load of the steering grill 3450 is increased, and there is a problem that a power of the steering actuator may also be increased to tilt the steering grill 3450.

In this embodiment, the steering actuator is disposed on the steering base 1070 coupled to the front fan housing 3430. In particular, the steering body 1010 is disposed on the rear surface of the steering base 1070 and the adjust assembly 3600 penetrates the steering base 1070 to minimize a separation distance between the steering grill 3450 and the steering base 1070.

The adjust assemblies 3600 pass through through-hole 1071 and 1072 of the steering base 1070 to minimize the distance between the steering base 1070 and the steering grill 3450. In addition, when the distance between the steering base 1070 and the steering grill 3450 is minimized, the length of the adjusting assembly 3600 may be minimized, and relative displacement and a relative angle of the adjusting assembly 3600 may be controlled more precisely.

The steering actuator moves the moving rack 1020 in the forward and rearward direction. A hydraulic cylinder may be used as the steering actuator. In this embodiment, a stepper motor is used as the steering actuator, which is referred to as a steering motor 1030.

The steering motor 1030 is assembled to the steering body 1010 and the moving rack 1020 is disposed between the steering motor 1030 and the steering body 1010.

The rack guide 1012 guides the moving direction of the moving rack 102, and in this embodiment, the rack guide 1012 is disposed in the forward and rearward direction. In this embodiment, the rack guide 1012 is integrated with the steering body 1010. The rack guide 1012 may have a groove or slit shape. In this embodiment, the rack guide 1012 has a slit shape penetrating the steering body 1010 and the movable rack 1020 is inserted into the slit.

The steering motor 1030 is assembled to the steering body 1010. The steering motor 1030 moves the moving rack 1020 in the forward and rearward direction when the steering motor 1030 is coupled to the steering body 1010.

A motor fixer 1013 fixes the steering motor 1030 to the steering body 1010. In this embodiment, the steering motor 1030 is coupled to the steering body 1010 by a fastening means (not shown).

The motor fixer 1013 protrudes from the steering body 1010 towards the steering motor 1030. The motor fixer 1013 is disposed in two places. The moving rack 1020 is disposed between the motor fixers 1013.

The motor fixer 1013 protrudes from the steering body 1010 to provide an installation space of the moving rack 1020. The rack guide 1012 is disposed between the motor fixers 1013. The motor fixer 1013 disposed at a first side thereof is referred to as "a first motor fixer" and the motor fixer 1013 disposed at a second side thereof is referred to as "a second motor fixer". A distance (M1) between the first motor fixer and the second motor fixer is greater than a height (M2) of the moving rack 1020.

The steering body 1010 includes a coupler 1016 to couple with the steering base 1070. The coupler 1016 is disposed in the forward and rearward direction. As the first base installation portion 1076 and the second base installation portion 1077 each have a boss shape, the coupler 1016 have a grooved shape corresponding thereto.

A number of couplers 1016 corresponds to a number of first base installation portions 1076 and the coupler 1016 is disposed in two places.

The coupler 1016 disposed on the steering body 1010 of the first steering assembly 1001 is referred to as "a 1-1 coupler 1016*a*" and "a 1-2 coupler 1016*b*". The coupler (not shown) disposed on the steering body 1010 of the second steering assembly 1002 is referred to as "a 2-1 coupler (not shown)" and "a 2-2 coupler (not shown)".

The coupler 1016 is disposed in front of the motor fixer 1013 or the rack guide 1012. The rack guide 1012 is disposed between the 1-1 coupler 1016*a* and the 1-2 coupler 1016*b*.

The steering gear 1040 is a pinion gear. The steering gear 1040 is coupled to the motor shaft 1031.

The moving rack 1020 is moved in the forward and rearward direction by the operation of the steering motor 1030. The moving rack 1020 is movably assembled to the steering body 1010 and moves forward or rearward along the rack guide 1012.

A moving distance of the moving rack 1020 is adjusted according to a number of revolutions of the steering gear 1040 and a moving direction of the moving rack 1020 is determined based on the rotation direction of the steering gear 1040.

The moving rack 1020 includes a moving rack body 1021, a moving rack gear 1023 disposed on the moving rack body 1021 and disposed in a longitudinal direction of the moving rack body 1021, a guide block 1022 disposed on the moving rack body 1021 and movably assembled to the rack guide 1012, and a moving rack coupler 1024 disposed on the moving rack body 1021 and coupled to the structure at the rear side of the adjust assembly 3600.

The guide block 1022, the moving rack gear 1023 and the adjust moving rack coupler 1024 are integrated with the moving rack body 1021.

The moving rack gear 1023 is disposed in the longitudinal direction of the moving rack body 1021. When considering the engagement with the steering gear 1040, the moving rack gear 1023 is preferably disposed on the upper surface or the lower surface of the moving rack body 1021, and in this embodiment, the moving rack gear 1023 is disposed on the lower surface of the moving rack body 1021.

In this embodiment, a total length of the moving rack body 1021 is 45.7 mm and a length in the forward and rearward direction of the moving rack gear 1023 is 36.7 mm. The moving rack gear 1023 may move forward or rearward by 13.7 mm and the steering grill 3450 may be tilted by up to 12 degrees.

The guide block 1022 is inserted into the rack guide 1012 and is moved. The guide block 1022 and the rack guide 1012 are not engaged with each other in the moving direction thereof, but are engaged with each other in other directions except for the moving direction thereof.

Cross-sections of the guide block 1022 and the rack guide 1012 correspond to each other, which are orthogonal to the moving directions thereof and the guide block 1022 is inserted into the rack guide 1012.

The guide block 1022 defines a guide protrusion 1025 in a moving direction and the rack guide 1012 defines a guide groove 1015 corresponding to the guide protrusion 1025. The guide groove 1015 and the guide protrusion 1025 are engaged with each other in the horizontal direction and the vertical direction except for the moving direction (e.g., in this embodiment, the forward and rearward direction).

In contrast to this embodiment, the guide groove 1015 may be defined in the guide block 1022 and the guide protrusion 1025 may be defined in the rack guide 1012.

<Adjust Assembly Configuration>

The adjust assembly 3600 is disposed on the first steering assembly 1001 and the second steering assembly 1002. The adjust assemblies 3600 have the same configuration.

When the adjust assembly 3600 disposed in the first steering assembly 1001 needs to be distinguished from the adjust assembly 3600 disposed in the second steering assembly 1002, they may be distinguished as a first adjust assembly 3601 and a second adjust assembly 3602. Components of the adjust assembly 3600 are also be distinguished in the same manner.

The adjust assembly 3600 corrects a distance and a direction between the steering body 1010 and the steering grill 3450 when the moving rack 1020 moves forward or rearward.

The adjust assembly 3600 connects the steering grill 3450 to the moving rack 1020.

When the steering grill 3450 is tilted, a relative distance between the steering grill 3450 and the moving rack 1020 is varied and the adjust assembly 3600 resolves the variable distance difference. The adjust assembly 3600 supports the tilted steering grill 3450 and maintains the tilted state.

The adjust assembly 3600 corrects the relative displacement and relative angle between the steering grill 3450 and the moving rack 1020 and maintains the tilted state of the steering grill 3450.

In this embodiment, the adjust assembly 3600 corrects the relative displacement and the relative angle through a multi-joint structure.

In this embodiment, the steering assembly 1000 further includes a hub 1080 assembled to the rear surface of the steering grill 3450 and assembled to the adjust assembly 3600. The first steering assembly 1001 and the second steering assembly 1002 are each coupled to the hub 1080.

The hub 1080 includes a hub body 1082 assembled to a steering grill 3450, a hub fitting portion 1084 disposed on the hub body 1082 and coupled to the steering grill 3450, a hub fastener 1086 disposed on the hub body 1082, fastened to the steering grill 3450, a first adjust coupler 1088 and a second adjust coupler 1089 each disposed on the hub body 1082 and coupled to the adjust assembly 3600.

In this embodiment, the first adjust assembly 3601 and the second adjust assembly 3602 are each assembled to the hub body 1082. The hub 1080 may be omitted and the first adjust assembly 3601 and the second adjust assembly 3602 may be directly assembled to the steering grill 3450. In this case, there is a problem in that an assembly process of the first adjust assembly 3601 and the second adjust assembly 3602 is complicated.

In this embodiment, the hub 1080 is assembled to the steering grill 3450 when the first adjust assembly 3601 and the second adjust assembly 3602 are each assembled to the hub 1080. In this case, regardless of the steering grill 3450, the first adjust assembly 3601, the second adjust assembly 3602, and the hub 1080 may be prepared in an assembled state.

As the hub 1080 is assembled to the steering grill 3450, to which the first adjust assembly 3601 and the second adjust assembly 3602 are assembled, assembly may be simplified. In particular, in the structure, when the steering grill 3450 needs to be replaced, the adjust assembly 3600 may not need to be disassembled and the assembled adjust assembly 3600 may be reused without change.

The adjust assembly 3600 includes a first ball hinge 3610 coupled to a moving rack coupler 1024 of the moving rack 1020, a second ball hinge 3620 coupled to the adjust couplers 1088 and 1089 of the hub 1080, a first ball cap 3630 disposed between the first ball hinge 3610 and the second ball hinge 3620 and to cover a portion of an outer surface of the first ball hinge 3610 and be rotatable relative to the first ball hinge 3610, a second ball cap 3640 disposed between the first ball cap 3630 and the second ball cap 3620 and to cover a portion of an outer surface of the second ball hinge 3620 and be rotatable relative to the second ball hinge 3620, an elastic member 3650 disposed between the first ball cap 3630 and the second ball cap 3640, to provide an elastic force to each of the first ball cap 3630 and the second ball cap 3640, contact the first ball cap 3630 to the first ball hinge 3610, and contact the second ball cap 3640 to the second ball hinge 3620, and an adjust housing 3660 to accommodate the first ball hinge 3610, the first ball cap 3630, the elastic member 3650, the second ball cap 3640, and the second ball hinge 3620, in which the adjust couplers 1088 and 1089 are inserted into the front side thereof and the moving rack coupler 1024 is inserted into the rear side thereof.

As the components of the adjust assembly 3600 rotate or move relative to one another, they generate friction and operation noise due to the friction. Therefore, a lubricant such as grease is preferably applied to each of the components of the adjust assembly 3600.

The elastic member 3650 uses a coil spring. In contrast to this embodiment, various types of elastic members may be used. The coil spring is disposed between the first ball cap 3630 and the second ball cap 3640 and may provide an elastic force when the coil spring is fitted to the first ball cap 3630 and the second ball cap 3640. The coil spring is effective to maintain a right position between the first ball cap 3630 and the second ball cap 3640.

In particular, when the coil spring has a strong elastic force, excessive friction may be generated between the ball caps 3630 and 3640 and the ball hinges 3610 and 3620 and wear and operating noise may be generated based on the friction. The lubricant may be applied between the ball caps 3630 and 3640 and the ball hinges 3610 and 3620.

The first ball hinge 3610 and the second ball hinge 3620 each function as a joint. Relative rotation may occur at the first ball hinge 3610 or the second ball hinge 3620.

The first ball hinge 3610 has a spherical shape. The first ball hinge 3610 is coupled to a moving rack coupler 1024 of the moving rack 1020.

The first ball hinge 3610 is coupled to the moving force coupler 1024 by a fastening member 3612. The fastening member 3612 penetrates the first ball hinge 3610 in the forward and rearward direction.

The first ball hinge 3610 defines a first groove 3611 and a second groove 3613 into which the fastening member 3612 is inserted and the first groove 3611 and the second groove 3613 each are concaved in the forward and rearward direction.

The first groove 3611 and the second groove 3613 have the same structure. In this embodiment, the fastening member 3612 is inserted into the first groove 3611. A head 3612*a* of the fastening member 3612 is inserted into the first groove 3611 to prevent the head 3612*a* of the fastening member 3612 from protruding outside the outer surface of the first ball hinge 3610.

A fastening hole (not shown) is connected to the first groove 3611, passes through the first ball hinge 3610, and the fastening hole is provided in a forward and rearward direction. The second groove 3613 is concaved from the rear side to the front side thereof, and the movable rack coupler 1024 is inserted into the second groove 3613.

The fastening member 3612 is coupled to the moving rack coupler 1024 through the first ball hinge 3610.

The second ball hinge 3620 has the same structure as the first ball hinge 3610.

The second ball hinge 3620 defines a first groove 3621 and a second groove 3623 into which the fastening member 3622 is inserted and the first groove 3621 and the second groove 3623 are each concaved in the forward and rearward direction.

The first groove 3621 and the second groove 3623 have the same structure. In this embodiment, the fastening member 3622 is inserted into the first groove 3621. The head 3622*a* of the fastening member 3622 is inserted into the first groove 3621 to prevent the head 3622*a* of the fastening member 3612 from protruding outside the outer surface of the second ball hinge 3620.

A fastening hole (not shown) is connected to the first groove 3621 and passes through the second ball hinge 3620, and is disposed in a forward and rearward direction. The second groove 3623 is concaved from the rear side to the front side thereof and the first adjust coupler 1088 or the second adjust coupler 1089 are inserted. The fastening member 3622 is coupled to the adjust coupler 1088 or the second adjust coupler 1089 through the second ball hinge 3620.

The first ball cap 3630 covers the first groove 3611 of the first ball hinge 3610 and surrounds the outer surface of the first ball hinge 3610. The first ball cap 3630 surrounds a front outer surface of the first ball hinge 3610.

The first ball cap 3630 includes a concave first ball cap groove 3631 corresponding to the outer surface of the first ball hinge 3610 and a first ball cap protrusion 3633 fitted to the elastic member 3650.

The first ball hinge 3610 is inserted into the first ball cap groove 3631 and the first ball cap groove 3631 minimizes friction with the first ball hinge 3610. The first ball hinge 3610 may contact the first ball cap groove 3631 and rotate.

The first ball cap protrusion 3633 protrudes toward the elastic member 3650. In this embodiment, the first ball cap protrusion 3633 is disposed in the forward and rearward direction and protrudes toward the front side thereof (e.g., toward the steering grill).

The second ball cap 3640 and the first ball cap 3630 have the same configuration and have the different directions.

The second ball cap 3640 covers the first groove 3621 of the second ball hinge 3620 and surrounds the outer surface of the second ball hinge 3620. The second ball cap 3640 surrounds the rear outer surface of the second ball hinge 3620.

The second ball cap 3640 includes a second ball cap groove 3641 that is concave and corresponding to the outer surface of the second ball hinge 3620 and a second ball cap protrusion 3643 fitted to the elastic member 3650.

The second ball hinge 3620 is inserted into the second ball cap groove 3641 and the second ball cap groove 3641 minimizes friction with the second ball hinge 3620. The second ball hinge 3620 may be rotated in contact with the second ball cap groove 3641.

The second ball cap protrusion 3643 protrudes toward the elastic member 3650. In this embodiment, the second ball cap protrusion 3643 is disposed in the forward and rearward direction and protrudes rearward (e.g., toward the moving rack).

The first ball cap protrusion 3633 and the second ball cap protrusion 3643 are disposed in a line, protrude toward each other, and are disposed in the forward and rearward direction in this embodiment.

The first ball cap groove 3631 and the second ball cap groove 3641 are disposed in opposite directions. For example, when the first ball cap groove 3631 is disposed towards the rear side thereof, the second ball cap groove 3641 is disposed towards the front side thereof.

The adjust housing 3660 accommodates the first ball hinge 3610, the first ball cap 3630, the elastic member 3650, the second ball cap 3640, and the second ball hinge 3620.

The adjust housing 3660 defines a first insertion hole 3673 into which the moving rack coupler 1024 is inserted, at a rear side thereof, and the moving rack coupler 1024 is inserted into the rear side of the adjust housing 3660 through the first insertion hole 3673.

The adjust housing 3660 defines a second insertion hole 3683 at a front side thereof, into which the first adjust coupler 1088 or the second adjust coupler 1089 is inserted and the first adjust coupler 1088 or the second adjust coupler 1089 are inserted into the front side of the adjust housing 3660 through the second insertion hole 3683.

In this embodiment, the adjust housing 3660 includes a first adjust housing 3670 and a second adjust housing 3680.

The first ball hinge 3610, the first ball cap 3630, the elastic member 3650, the second ball cap 3640, and the second ball hinge 3620 may be easily accommodated therein through assembly of the first adjust housing 3670 and the second adjust housing 3680.

The first adjust housing 3670 includes a first adjust housing body 3672 providing a space (AS1), the first insertion hole 3673 defined at a rear side of the first adjust housing body 3672 (e.g., in this embodiment, towards the moving rack coupler 1024) and communicating with the space (AS1), and a first opening surface 3671 disposed at a front side of the first adjust housing body 3672 (e.g., in this embodiment, towards the steering grill) and communicating with the space (AS1).

The second adjust housing 3680 includes a second adjust housing body 3682 providing a space (AS2), the second insertion hole 3683 disposed at the front side of the second adjust housing body 3682 (e.g., in this embodiment, towards the steering grill) and communicating with the space (AS2), and a second opening surface 3681 disposed at the rear side of the second adjust housing body 3682 (e.g., in this embodiment, towards the moving rack coupler 1024) and communicating with the space (AS2).

In this embodiment, the first adjust housing 3670 is coupled to the second adjust housing 3680 by the screw and any one thereof includes a female screw thread 3685 and the other one thereof includes a male screw thread 3675.

In this embodiment, the female screw thread 3685 is disposed on an inner surface of the second adjust housing body 3682 and the male screw thread 3675 is disposed on an outer surface of the first adjust housing body 3672.

The first ball hinge 3610 and the second ball hinge 3620 are each disposed inside the adjust housing 3660 and the first ball hinge 3610 and the second ball hinge 3620 may each be rotated.

The first ball hinge 3610 may be rotated relative to the steering grill 3450 and the second ball hinge 3620 may be rotated relative to the steering base 1070.

The movable rack coupler 1024 to which the first ball hinge 3610 is coupled may be rotated in the first insertion hole 3673 within a predetermined distance. The adjust couplers 1088 and 1089 to which the second ball hinge 3620 is coupled may be rotated in the second insertion hole 3685 within a predetermined distance.

The first ball hinge 3610 and the second ball hinge 3620 may be rotated independently of each other to respond to the tilting of the steering grill 3450.

The long-distance fan assembly 400 provides a projection state in which the long-distance fan assembly 400 protrudes forward from the front surface 200*a* of the door assembly 200 through the front discharge outlet 201. In the projection state, the direction of the steering grill 3450 is tilted.

In the projection state, the front end 3452*a* of the steering grill 3450 protrudes from the front surface 200*a* of the door assembly 200 and a protruding length (P) is provided between the front end 3452*a* of the steering grill 3450 and the front surface 200*a* of the door assembly 200. For example, the protruding length (P) may be a half of the thickness in the forward and rearward direction of the steering grill 3450.

In the projection state, a first half of the outer surface 3451 of the steering grill 3450 is disposed outside the front discharge outlet 201 and a second half thereof is disposed inside the front discharge outlet 201.

In particular, in the projection state, an outermost portion 3451*a* of the outer surface 3451 of the steering grill 3450 is disposed on the same line as the front discharge outlet 201 or the front surface 200*a* of the door assembly 200.

In the projection state, the joint assembly 1100 is preferably disposed in the front discharge outlet 201. More precisely, in the projection state, the cross axle 1030 preferably faces a front side thereof and is disposed on the same line as the front surface 200*a* of the door assembly 200.

When viewed from the front, the first steering assembly 1001 is disposed above the central axis (C1) and the second steering assembly 1002 is disposed on the left side of the central axis (C1).

When viewed from the front, the first steering assembly 1001 and the second steering assembly 1002 have an angle of 90 degrees with respect to the central axis (C1).

The arrangement is configured to minimize the operation of the first steering assembly 1001 or the second steering assembly 1002 when the steering grill 3450 is tilted.

A middle position between a maximum forward movement position and a maximum rearward movement position of the moving rack 1020 of the steering assembly is referred to as "an initial position". The moving rack 1020 of the first steering assembly 1001 or the second steering assembly 1002 is disposed at the initial position in the projection state.

In this embodiment, a steering angle of the steering grill 3450 is from 0 to 15 degrees.

When the front surface of the steering grill 3450 (e.g., in this embodiment, the steering cover 3454) is orthogonal to the central axis (C1) or is parallel to the front surface 200*a* of the door assembly 200, a steering angle is 0 degrees.

When the moving rack 1020 maximizes the forward movement or the rearward movement, the steering grill 3450 has a steering angle of 15 degrees.

For example, when the moving rack 1020 of the first steering assembly 1001 is moved rearward with a maximum level, an upper end of the steering grill 3450 is tilted to the rear side, and the steering grill 3450 faces upward. In this case, the steering cover 3454 of the steering grill 3450 forms an angle of 15 degrees with respect to the central axis (C1). The steering angle of the steering grill 3450 may be controlled based on the moving distance of the moving rack 1020.

The relation between the steering direction of the steering grill 3450, the moving rack 1020 of the first steering assembly 1001, and the moving rack 1020 of the second steering assembly 1002 is as follows.

TABLE 1

| | MOVING RACK OF FIRST STEERING ASSEMBLY | MOVING RACK OF SECOND STEERING ASSEMBLY |
|---|---|---|
| LEFTWARD | INITIAL POSITION | MOVING REARWARD |
| RIGHTWARD | INITIAL POSITION | MOVING FORWARD |
| UPWARD | MOVING REARWARD | INITIAL POSITION |
| DOWNWARD | MOVING FORWARD | INITIAL POSITION |
| LEFTWARD AND UPWARD | MOVING REARWARD | MOVING REARWARD |
| LEFTWARD AND DOWNWARD | MOVING FORWARD | MOVING REARWARD |
| RIGHTWARD AND UPWARD | MOVING REARWARD | MOVING FORWARD |
| RIGHTWARD AND DOWNWARD | MOVING FORWARD | MOVING FORWARD |

When the steering grill 3450 is tilted leftward with respect to a central axis (C1), only the second steering assembly 1002 is operated in this embodiment. The moving rack 1020 of the first steering assembly 1001 is disposed at an initial position and the moving rack 1020 of the second steering assembly 1002 is moved rearward. In this case, the steering grill 3450 is rotated leftward about the joint assembly 1100.

When the steering grill 3450 is tilted rightward with respect to the central axis (C1), only the second steering assembly 1002 is operated in this embodiment.

The moving rack 1020 of the first steering assembly 1001 is disposed at an initial position and the moving rack 1020 of the second steering assembly 1002 is moved forward. In this case, the steering grill 3450 is rotated rightward with respect to the joint assembly 1100.

When the steering grill 3450 is tilted upward with respect to the central axis (C1), only the first steering assembly 1001 is operated in this embodiment.

In the projection state, the moving rack 1020 of the first steering assembly 1001 is moved rearward and the moving rack 1020 of the second steering assembly 1002 is disposed at the initial position. In this case, the steering grill 3450 is rotated upward with respect to the joint assembly 1100.

When the steering grill 3450 is tilted downward with respect to the central axis (C1), only the first steering assembly 1001 is operated in this embodiment.

In the projection state, the moving rack 1020 of the first steering assembly 1001 is moved forward and the moving rack 1020 of the second steering assembly 1002 is disposed at the initial position. In this case, the steering grill 3450 is rotated downward with respect to the joint assembly 1100.

For example, when the steering grill 3450 is tilted upward, downward, leftward, or rightward with respect to the central axis (C1), only one of the first steering assembly 1001 or the second steering assembly 1002 is operated in this embodiment.

When the steering grill 3450 is tilted diagonally with respect to the central axis (C1), the first steering assembly 1001 and the second steering assembly 1002 are operated.

For example, when the steering grill 3450 is tilted diagonally leftward and downward with respect to the central axis (C1), in the projection state, the moving rack 1020 of the first steering assembly 1001 is moved forward and the moving rack 1020 of the second steering assembly 1002 is moved rearward. In this case, the steering grill 3450 is rotated leftward and downward with respect to the joint assembly 1100.

When the steering grill 3450 is tilted diagonally upward and rightward with respect to the central axis (C1), the moving rack 1020 of the first steering assembly 1001 is moved rearward and the moving rack 1020 of the second steering assembly 1002 is moved forward.

Although not shown, when the steering grill 3450 is tilted diagonally leftward and upward with respect to the central axis (C1), the moving rack 1020 of the first steering assembly 1001 is moved rearward and the motor rack 1020 of the second steering assembly 1002 is moved rearward.

Although not shown, when the steering grill 3450 is tilted diagonally rightward and downward with respect to the central axis (C1), the moving rack 1020 of the first steering assembly 1001 is moved forward and the moving rack 1020 of the second steering assembly 1002 is moved forward.

FIGS. 6 to 11 show maximum movement of the moving rack 1020 of the first steering assembly 1001 or the moving rack 1020 of the second steering assembly 1002.

The degree of steering may be controlled by adjusting the forward or rearward movement distance of each of the moving racks 1020.

In addition, according to this embodiment, when the steering assembly 1000 is changed from the steering state to the other steering state, the steering is immediately performed.

When the steering grill is tilted from the leftward steering in FIG. 6 to the diagonal rightward and upward in FIG. 11, the moving rack 1020 of the first steering assembly 1001 is moved rearward from the initial position thereof and the moving rack of the second steering assembly 1002 is moved forward from the rearward movement position.

As described above, according to this embodiment, there is an advantage in that the steering assembly 1000 may tilt the steering grill 3450 from a current steering direction to a target steering direction.

The steering grill 3450 may be tilted immediately to provide direct air flow to the target area even when the indoor target area is changed in real time.

For example, the location of the occupant may be determined in real time using the camera module, and when a direct wind tracking mode is selected, the direct air flow may be provided to the occupant even if the occupant moves in the indoor space.

For example, when a direct wind avoidance mode is selected, the direct air flow may be provided in a region with a greater temperature difference between a target temperature and a room temperature while avoiding the location of the occupant.

<Projection State and Steering State>

In this embodiment, a forward movement distance of the fan housing assembly 3400 by the actuator 3470 is 80 mm to provide the projection state.

In the projection state, a front end 3450*a* of the steering grill 3450 protrudes forward from a front surface 200*a* of a front panel 210. In this embodiment, the protruding length (Q) is 30 mm.

The front surfaces of the door assembly 200 and the cabinet assembly 100 may be spaced apart from each other by a predetermined distance (e.g., 2 mm in this embodiment). As the fan housing assembly 3400 may be disposed at rear side than the front surface of the cabinet assembly 100 by the predetermine distance, a thickness of the door assembly 200 in a forward and rearward direction may be substantially less than 298 mm.

In the projection state, the steering grill 3450 is preferably disposed on the front surface 200*a* in the forward and rearward direction. A length of an outer surface 3451 of the steering grill 3450 in the forward and rearward direction is 60 mm. The length of the outer surface 3451 of the steering grill 3450 is 68 mm and a radius of curvature of the outer surface 3451 is 152.5°. When viewed from the side, the outer surface of the steering grill 3450 may be a portion of a circle with the radius of curvature.

The radius of curvature of the outer surface 3451 is used to prevent interference with the structure of the door assembly 200 when the steering grill 3450 is rotated upward, downward, leftward, rightward, and diagonally.

A distance (D1) of the outer surface of the steering grill 3450 and an outer edge 201*a* of the front discharge outlet 201 may be 2 mm or more and 5 mm, and in this embodiment, 4 mm. If the distance (D1) is short due to design tolerance or assembly tolerance, interference with the structure of the door assembly 200 may be generated when the steering grill 3450 is tilted.

An angle (K) of the front end 3450*a* of the steering grill 3450 faces the central axis (C1) and the angle (K) of the front end 3450*a* is 8 degrees. The angle of the rear end 3450*b* of the steering grill 3450 is 8 degrees and faces the central axis (C1).

In this embodiment, a steering angle (A1) of the steering grill 3450 is a maximum of 12 degrees.

When the steering of the steering grill 3450 is maximized, the rear end 3450*b* of the steering grill 3450 is disposed in the door assembly 200. For example, even if the steering of the steering grill 3450 is maximized, the rear end 3450*b* of the steering grill 3450 is disposed in the front discharge outlet 201 and may not protrude outward from the front surface 200*a*.

The above steering is performed to prevent the discharged air from leaking between the rear end 3450*b* of the steering grill 3450 and the edge 201*a* of the front discharge outlet 201. When the rear end 3450*b* of the steering grill 3450 protrudes outward from the front surface 200*a*, dew formation may be generated at the outer edge of the front discharge outlet 201 due to the discharged cold air.

Meanwhile, an extension line (X6) of the hub 312 of the fan 3420 faces the steering housing 3452 of the steering grill 3450, and specifically, faces the inner surface of the steering housing 3452 to prevent the air discharged from the fan 3420 from leaking out of the steering housing 3452 and improve an air discharge efficiency.

In the projection state, the extension line (X6) of the hub 312 may face the edge 201*a* of the front discharge outlet 201.

A diameter (X5) of the front discharge outlet 201 is greater than a diameter (X4) of the steering grill 3450. The outer surface 3451 of the steering grill 3450 and the edge 201*a* of the front discharge outlet 201 are spaced apart from each other by distance (D1). The outer surface 3451 of the steering grill 3450 and the outer fan housing 3432 are spaced apart from each other by the length (P).

A diameter (X3) of the shroud 314 is greater than a diameter (X2) of the hub 312 and is less than the diameter (X4) of the steering grill 3450.

In this embodiment, the diameter of the steering base 1070 is the same as the diameter (X2) of the hub 312. The diameter of the steering base 1070 is greater than the diameter (X1) of the steering cover 3454 and is less than the diameter (X3) of the shroud 314.

The center of each of the steering grill 3450, the steering base 1070, the hub 312, the shroud 314, and the fan housing is disposed on the central axis (C1).

Figure 55:
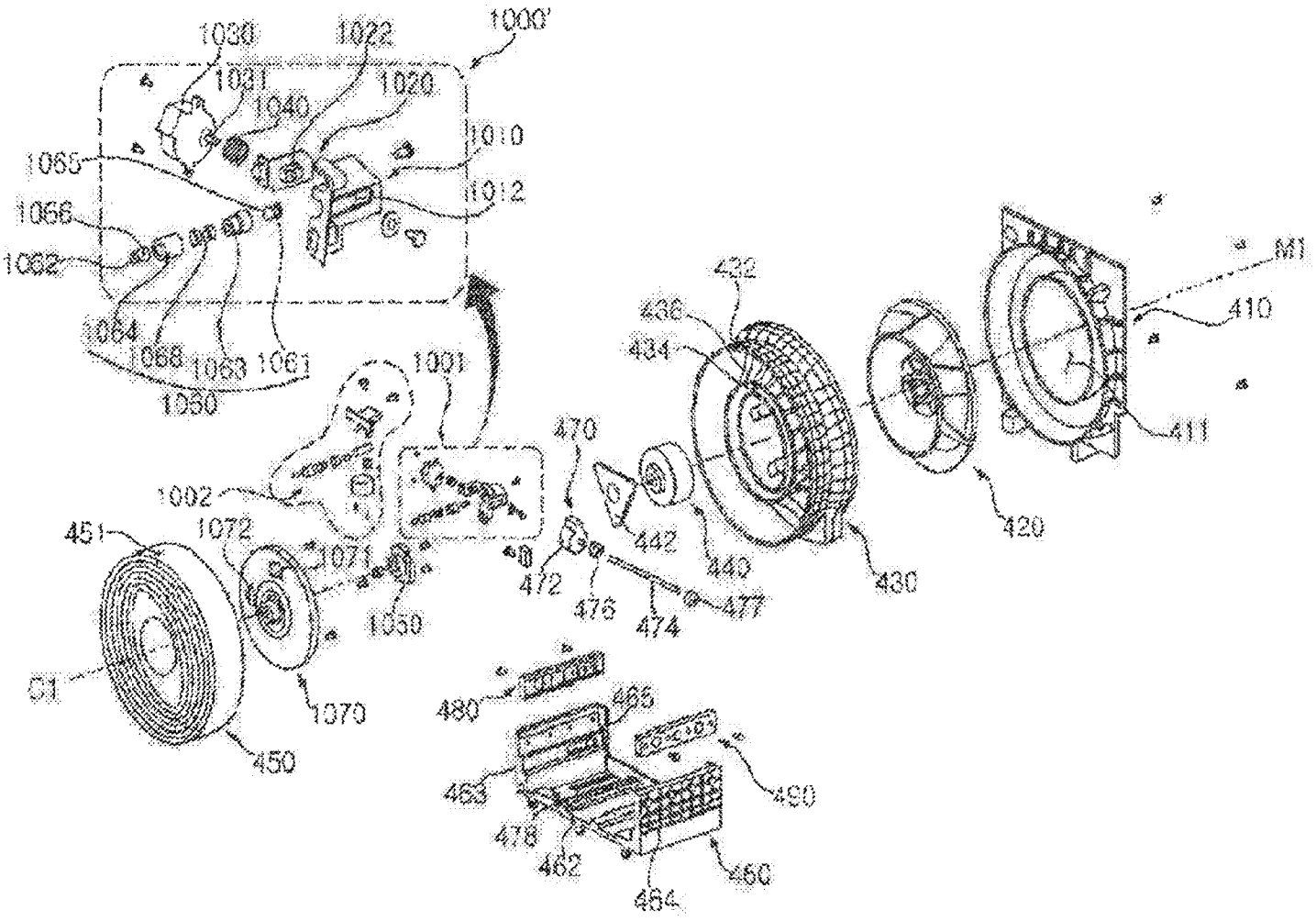
FIG. 55 is an exploded perspective view showing a fan housing assembly according to a second embodiment of the present disclosure.
Figure 56:
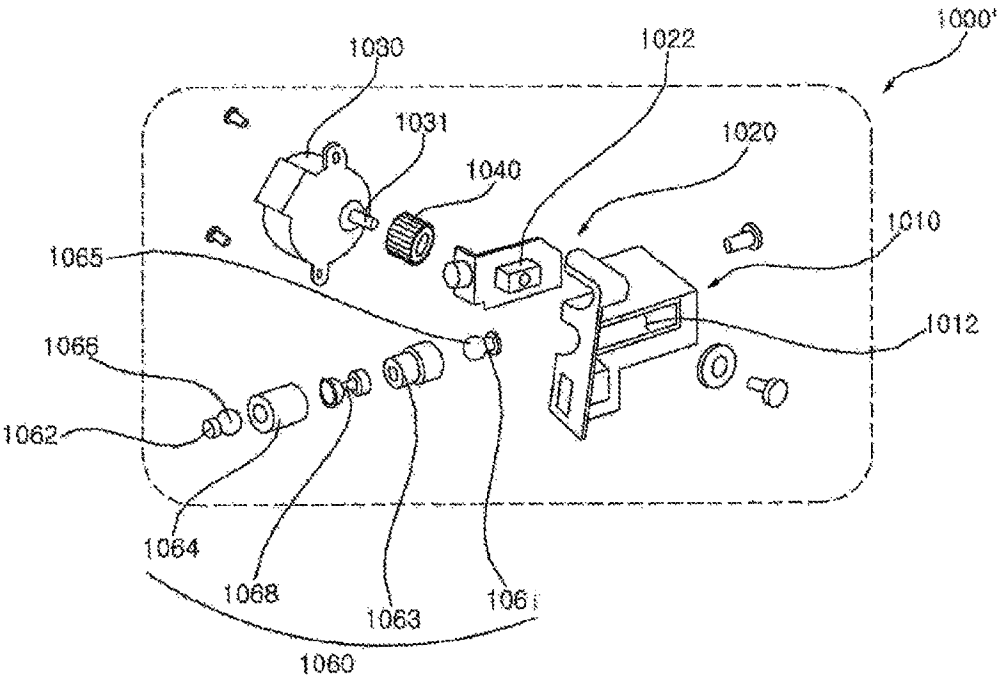
FIG. 56 is an enlarged view showing a steering assembly in FIG. 55.

FIG. 55 is an exploded perspective view showing a fan housing assembly according to a second embodiment of the present disclosure. FIG. 56 is an enlarged view showing the steering assembly in FIG. 55.

The steering assembly 1000' is disposed between the steering grill 450 and a fan housing 430. The steering assembly 1000' is disposed at a position at which interference with discharged air is minimized.

In this embodiment, the steering assembly 1000' is disposed at a front side of the inner fan housing 434 to minimize interference with discharged air. In particular, the steering assembly 1000' is disposed at the front side of the fan motor 440.

The steering assembly 1000' provides a structure to tilt the steering grill 450 without restriction on a tilting direction or sequence. For example, the steering assembly 1000' may be horizontally tilted after the steering assembly 1000' is vertically tilted. In addition, the steering assembly 1000' may be vertically tilted after the steering assembly 1000' is horizontally tilted.

According to the present disclosure, as the steering assembly 1000' has no restriction in the tilting direction, the steering assembly 1000' may immediately tilt the steering grill 450.

The steering assembly 1000' includes a joint 1050 having a rear surface coupled to the fan housing 430 and tiltably assembled to the steering grill 450, a first steering unit 1001' coupled to the fan housing 430 or the steering grill 450, rotatably coupled to the steering grill 450, moving in the forward and rearward direction, and to tilt the steering grill 450 in a first direction, and a second steering unit 1002' coupled to the fan housing 430 or the steering grill 450, rotatably coupled to the steering grill 450, moving in the forward and rearward direction, and to tilt the steering grill 450 in a second direction.

The joint 1050 is disposed on the axis center (C1). In this embodiment, the ball joint is used as the joint 1050. In contrast to this embodiment, a universal joint may be used instead of the ball joint.

The joint 1050 may be coupled to the fan housing 320 or may be coupled to the fan motor 440.

In this embodiment, the joint 1050 is disposed on a fan mounter 442 to couple the fan motor 440 to the fan housing 430.

The joint 1050 faces the front surface thereof and is disposed on the axis center (C1) of the steering grill 450 and an axis center (M1) of the fan motor 440.

The joint 1050 may be directly assembled to the rear surface of the steering grill 450. In this embodiment, the steering assembly 1000 further includes the steering base 1070 and the steering base 1070 is disposed between the steering grill 450 and the joint 1050.

The steering base 1070 is coupled to the rear surface of the steering grill 450. The steering base 1070 is tilted upward, downward, leftward, rightward or diagonally with the steering grill 450.

The steering base 1070 covers the open front surface of the inner fan housing 434. The steering base 1070 conceals the fan motor 440 inside the inner fan housing 434.

The joint 1050 is tiltably assembled to the rear surface of the steering base 1070. The steering base 1070 and the joint 1050 are coupled to each other by the ball joint to freely rotate the steering base 1070.

The steering grill 450 may be tilted vertically, horizontally, or diagonally when the steering base 1070 faces forward. The steering grill 450 is not restricted in the tilting direction when the steering grill 450 faces forward.

In this embodiment, the first direction is the vertical direction and the second direction is the horizontal direction. In contrast to this embodiment, the first direction and the second direction may be arbitrarily changed. In this embodiment, the first direction and the second direction form an angle of 90 degrees.

The first steering unit 1001' may push or pull the steering grill 450 and tilt the steering grill 450 in the vertical direction with respect to the joint 1050.

The second steering unit 1002' may push or pull the steering grill 450 and tilt the steering grill 450 in the horizontal direction with respect to the joint 1050.

The combination of the first steering unit 1001' and the second steering unit 1002' may be used to tilt the steering grill 450 diagonally relative to the joint 1050.

The first steering unit 1001' and the second steering unit 1002' include the same components. For example, the configuration of the first steering unit 1001' is described.

The first steering unit 1001' includes a bracket 1010 coupled to the fan housing 430 or the steering grill 450, a moving rack 1020 relatively coupled to the bracket 1010, a guide 1012 disposed on the bracket 1010, movably assembled to the moving rack 1020, and to guide a moving direction of the moving rack 1020, a steering motor 1030 to provide a driving force to move the moving rack 1020, a steering gear 1040 coupled to the motor shaft 1031 of the steering motor 1030 to be rotated and engaged with the moving rack 1020, and an adjust assembly 1060 to couple the moving rack 1020 to a discharge grill 450 and adjust a tilting angle of the discharge grill 450 when the moving rack 1020 moves.

The bracket 1010 may be coupled to the fan housing 430 or the steering grill 450. In this embodiment, the bracket 1010 is coupled to the steering base 1070 disposed on the steering grill 450. The bracket 1010 is coupled to the rear surface of the steering base 1070 and the adjust assembly 1060 passes through the steering base 1070.

The steering motor 1030 is disposed on the bracket 1010. The steering motor 1030 moves the moving rack 1020 in the forward and rearward direction when the steering motor 1030 is coupled to the bracket 1010.

The bracket 1010 includes a guide 102 extending in the forward and rearward direction and the movable rack 1020 slides along the guide 1012.

The guide 1012 has a slit shape penetrating in the horizontal direction. In contrast to this embodiment, the guide 1012 may have a groove shape.

The moving rack 1020 includes an insert 1022 inserted through the guide 1012. The insert 1022 may be moved along the guide 1012. The guide portion 1012 extends long in the forward and rearward direction and the insert 1022 is moved in the forward and rearward direction along the guide 1012.

The moving rack 1020 has a longitudinal shape and is engaged with the steering gear 1040. Depending on the rotation direction of the steering gear 1040, the movable rack 1020 may be moved forward or rearward.

The motor shaft 1031 of the steering motor 1030 faces the bracket 1010. The motor shaft 1031 is horizontally disposed. The steering gear 1040 and the moving rack 1020 are each disposed between the steering motor 1030 and the bracket 1010.

The adjust assembly 1060 connects the steering grill 450 to the moving rack 1020.

When the steering grill 450 is tilted, the distance between the steering grill 450 and the moving rack 1020 is variable and the adjust assembly 1060 solves the variable distance difference.

The adjust assembly 1060 corrects the relative displacement and the relative angle between the steering grill 450 and the moving rack 1020 and maintains the tilted state of the steering grill 450.

In this embodiment, the adjust assembly 1060 corrects the relative displacement and the relative angle through the multi-joint structure.

The adjust assembly 1060 includes a first ball stud 1061 having a rear side coupled to the moving rack 1020 and with a first ball hinge 1065 at a front side thereof, a first ball housing 1063 to accommodate the first ball hinge 1065 disposed at the front side of the first ball stud 1061, a second ball stud 1062 having a first side coupled to the steering grill 450 and including the second ball hinge 1066 at a rear side thereof, a second ball housing 1064 to accommodate the second ball hinge 1066 disposed at the rear side of the second ball stud 1062 and coupled to the first ball housing 1063, and a hinge bar 1068 disposed between the first ball housing 1063 and the second ball housing 1064 and to rotate the first ball hinge 1065 and the second ball hinge 1066 relative to each other.

The rear side of the first ball stud 1061 is coupled to the moving rack 1020. In this embodiment, the moving rack 1020 includes a first ball stud installation portion 1023 at the front side thereof, into which the first ball stud 1061 is fitted.

The first ball stud 1061 includes a spherical first ball hinge 1065 at the first side thereof.

The first ball hinge 1065 is inserted into the first ball housing 1063. The first ball hinge 1065 may be freely rotated relative to the first ball housing 1063 inside the first ball housing 1063.

Similarly, the front side of the second ball stud 1062 is coupled to the steering base 1070. A spherical second ball hinge 1066 is disposed at the rear side of the second ball stud 1062.

The second ball hinge 1066 is inserted into the second ball housing 1064. The second ball hinge 1066 may freely rotate relative to the second ball housing 1064 inside the second ball housing 1064.

The first ball housing 1063 and the second ball housing 1064 are combined to form a ball housing. The first ball hinge 1065 and the second ball hinge 1066 face each other in the ball housing.

The hinge bar 1068 is disposed between the first ball hinge 1065 and the second ball hinge 1066. The hinge bar 1068 maintains a minimum distance between the first ball hinge 1065 and the second ball hinge 1066. The hinge bar 1068 reduces friction between the first ball hinge 1065 and the second ball hinge 1066.

The hinge bar 1068 includes a first accommodator **1068*a*, at the rear side thereof, having a concaved shape such that the first accommodator 1068*a* accommodates a portion of the first ball hinge 1065 and a second accommodator 1068*b*, at the front side thereof, having a concaved shape such that the second accommodator 1068*b* accommodates the second ball hinge 1066**.

The hinge bar 1068 has a mortar shape at both sides thereof.

In this embodiment, the adjust assembly 1060 penetrates the steering base 1070 to connect the moving rack 1020 to the steering grill 450. To this end, the steering base 1070 defines through-holes 1071 and 1072 through which the adjust assembly 1060 passes.

Two through-holes 1071 and 1072 are provided for the first steering unit 1001' and the second steering unit 1002', respectively.

Hereinafter, as the remaining configuration is the same as that of the first embodiment, details thereof are omitted.

Embodiments of the present disclosure are described with reference to the accompanying drawings. The disclosure may, however, be embodied in many different manners and should not be construed as limited to the embodiments set forth herein. It is understood that a person having ordinary skill in the art to which the present disclosure art would implement this disclosure in other specific manners without changing the technical idea or necessary features of the present disclosure. For this reason, the disclosed embodiments are intended to be illustrative in all aspects, and not restrictive.

The invention claimed is:

1. An indoor unit of an air conditioner, comprising: a case defining a suction inlet and a discharge outlet to communicate an inner space of the case with an indoor space; a fan housing disposed in the case and comprising a fan to flow air, the fan housing including a rear fan housing and a front fan housing, the fan disposed in front of the rear fan housing and the front fan housing disposed in front of the fan; an actuator to move the fan housing towards the discharge outlet; a grill tiltably disposed in front of the front fan housing, and movable to have at least a portion thereof out of the discharge outlet based on an operation of the actuator and guide air expelled by the fan outside the discharge outlet; and at least a portion of a steering assembly disposed between the front fan housing and the grill to push or pull the grill to tilt the grill, the steering assembly configured to tilt the grill with respect to the front of the front fan housing, the steering assembly including: a joint assembly coupled to the grill to provide a tilting center axis, a steering base disposed at the fan housing and disposed at a rear side of the grill, wherein the joint assembly is rotatably assembled to each of the steering base and the grill, a first steering assembly disposed at the steering base or a structure of the fan housing, rotatably assembled to the grill, and to push or pull a first position of the grill and to tilt the grill with respect to the joint assembly; and a second steering assembly disposed at the steering base or a structure of the fan housing, rotatably assembled to the grill, and to push or pull a second position of the grill, that is different from the first position, and tilt the grill with respect to the joint assembly, wherein the actuator is configured to move the fan housing linearly forward in order for the grill to be in a projection state in which a front end of the grill protrudes forward from a front surface of the case through the discharge outlet and move the fan housing linearly rearward in order for the grill to be in a state in which the front end of the grill is disposed in the case.

2. The indoor unit of the air conditioner of claim 1, wherein the actuator is configured to move the fan housing forward so that a half of an outer surface of the grill is disposed out of the discharge outlet when the grill is in the projection state.

3. The indoor unit of the air conditioner of claim 1, wherein the actuator is configured to move the fan housing forward so that a rear end of the grill is disposed behind a front surface of the case when the grill is in the projection state.

4. The indoor unit of the air conditioner of claim 1, wherein, when the steering assembly maximizes tilting of the grill, a rear end of an outer surface of the grill is disposed behind the front surface of the case.

5. The indoor unit of the air conditioner of claim 1, wherein, when the steering assembly maximizes the tilting of the grill, all of the front end of an outer surface of the grill is disposed in front of the discharge outlet.

6. The indoor unit of the air conditioner of claim 1, wherein, when viewed from the front, the discharge outlet has a circular shape and the grill has a circular shape with a smaller diameter than a diameter of the discharge outlet, and a center of the grill is disposed on a central axis passing the discharge outlet in a forward and rearward direction.

7. The indoor unit of the air conditioner of claim 1, wherein the case comprises:

a front panel comprising the discharge outlet; and a cabinet disposed at a rear side of the front panel and coupled to the front panel to provide the inner space.

8. The indoor unit of the air conditioner of claim 1, wherein the actuator is configured to move the fan housing forward so that a front end of the fan housing is disposed at the front panel in order for the grill to be in the projection state.

9. The indoor unit of the air conditioner of claim 1, further comprising a door cover assembly disposed at the front panel, movable along the front panel, and configured to open and close the discharge outlet.

10. The indoor unit of the air conditioner of claim 9, wherein, in the projection state, the door cover assembly is disposed below the grill.

11. The indoor unit of the air conditioner of claim 9, wherein, in the projection state, the fan housing is disposed at the front panel and the door cover assembly is disposed below the fan housing.

12. The indoor unit of the air conditioner of claim 9, wherein the door cover assembly is disposed in front of the grill to close the discharge outlet.

13. The indoor unit of the air conditioner of claim 12, wherein the door cover assembly and the grill are spaced apart from each other by a predetermined distance in a forward and rearward direction.

14. The indoor unit of the air conditioner of claim 9, wherein, in the projection state, at least a portion of the steering assembly is disposed at the front panel.

15. The indoor unit of the air conditioner of claim 1, further comprising a guide housing disposed in the case, in which the fan housing is movable in a forward and rearward direction, and guides movement of the fan housing based on the operation of the actuator, wherein, in the projection state, a rear end of the fan housing is disposed behind a front end of a side wall of the guide housing.

16. The indoor unit of the air conditioner of claim 1, wherein the joint assembly comprises: a first joint bracket assembled to the grill; a second joint bracket assembled to the steering base; and a cross axle rotatably assembled to the first joint bracket through a first rotary shaft and rotatably assembled to the second joint bracket through a second rotary shaft; wherein the first rotary shaft intersects with the second rotary shaft; and the first joint bracket is rotated in a first direction with respect to the first rotary shaft and the second joint bracket is rotated in a second direction with respect to the second rotary shaft.

17. The indoor unit of the air conditioner of claim 1, wherein the case comprises: a front panel including the discharge outlet; and a cabinet disposed at a rear side of the front panel and coupled to the front panel to provide an inner space, and the joint assembly is disposed at the front panel in the projection state.

18. The indoor unit of the air conditioner of claim 1, wherein the first steering assembly is disposed above or below a central axis and the second assembly is disposed on the left side or the right side of the central axis, and the central axis is a central axis passing the discharge outlet in a forward and rearward direction, in the projection state.

* * * * *